US008985968B2

(12) United States Patent
Matsumoto et al.

(10) Patent No.: US 8,985,968 B2
(45) Date of Patent: Mar. 24, 2015

(54) HIGH PRESSURE PUMP WITH PRESSURIZING CHAMBER ENCLOSED WITHIN CYLINDER INSERTED INTO HOUSING

(75) Inventors: Teppei Matsumoto, Obu (JP); Masatoshi Kuroyanagi, Kariya (JP); Osamu Hishinuma, Toyota (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 335 days.

(21) Appl. No.: 13/360,476

(22) Filed: Jan. 27, 2012

(65) Prior Publication Data

US 2012/0195780 A1 Aug. 2, 2012

(30) Foreign Application Priority Data

Jan. 28, 2011 (JP) ..... 2011-16694
Mar. 31, 2011 (JP) ..... 2011-78146

(51) Int. Cl.

| | |
|---|---|
| ***F04B 17/00*** | (2006.01) |
| ***F04B 39/00*** | (2006.01) |
| ***F02M 59/10*** | (2006.01) |
| ***F02M 59/48*** | (2006.01) |
| ***F04B 1/04*** | (2006.01) |
| ***F04B 11/00*** | (2006.01) |
| ***F04B 53/00*** | (2006.01) |

(Continued)

(52) U.S. Cl.

CPC ..... *F02M 59/102* (2013.01); *F02M 59/48* (2013.01); *F04B 1/0404* (2013.01); *F04B 11/0016* (2013.01); *F04B 53/007* (2013.01); *F04B 53/16* (2013.01); *F04B 53/162* (2013.01); *F04B 53/22* (2013.01)

USPC ..... 417/415; 417/439; 417/454

(58) Field of Classification Search

CPC ..... F04B 1/0421; F04B 49/243; F04B 15/08
USPC ..... 417/454, 415, 439, 437
See application file for complete search history.

(56) References Cited

U.S. PATENT DOCUMENTS 4,618,077 A * 10/1986 Corsette ..... 222/383.1
5,067,881 A 11/1991 Maehara (Continued)

FOREIGN PATENT DOCUMENTS

CN 101109347 1/2008
JP 6-249133 9/1994

(Continued)

OTHER PUBLICATIONS

Office Action (1 page) dated Jan. 29, 2013, issued in corresponding Japanese Application No. 2011-016694 and English translation (2 pages).

(Continued)

*Primary Examiner* — Devon Kramer
*Assistant Examiner* — Christopher Brunjes
(74) *Attorney, Agent, or Firm* — Nixon & Vanderhye, P.C.

(57) ABSTRACT

A cylinder is configured into a bottomed tubular form and includes an inner peripheral wall, an inner bottom wall, an outer peripheral wall and an intake hole and a discharge hole. The inner peripheral wall slidably guides the plunger. The intake hole and the discharge hole communicate between the inner peripheral wall and the outer peripheral wall. A pump housing includes a cylinder receiving hole that includes an inner peripheral wall, into which the cylinder is inserted. A pressurizing chamber is formed by the inner peripheral wall and the inner bottom wall of the cylinder and a distal end outer wall of the plunger.

11 Claims, 34 Drawing Sheets

(51) Int. Cl.
F04B 53/16 (2006.01)
*F04B 53/22* (2006.01)

(56) References Cited

U.S. PATENT DOCUMENTS

| | | | | |
|---|---|---|---|---|
| 6,530,759 | B2 * | 3/2003 | Sano et al. | 417/470 |
| 6,631,706 | B1 | 10/2003 | Yamada et al. | |
| 7,540,274 | B2 | 6/2009 | Yamada et al. | |
| 7,707,996 | B2 | 5/2010 | Yamada et al. | |
| 7,744,353 | B2 | 6/2010 | Yamada et al. | |
| 8,382,458 | B2 * | 2/2013 | Hashida et al. | 417/454 |
| 2008/0019853 | A1 * | 1/2008 | Hashida et al. | 417/490 |

FOREIGN PATENT DOCUMENTS

| | | |
|---|---|---|
| JP | 11-351094 | 12/1999 |
| JP | 2005-036711 | 2/2005 |
| JP | 2007-170319 | 7/2005 |
| JP | 2008-525713 | 7/2008 |
| JP | 2009-185613 | 8/2009 |
| JP | 4478431 | 3/2010 |
| JP | 2010-255540 | 11/2010 |

OTHER PUBLICATIONS

Office Action (7 pages) dated Jan. 20, 2014, issued in corresponding Chinese Application No. 201210022700.1 and English translation (5 pages).

Office Action (2 pages) dated Feb. 22, 2013, issued in corresponding Japanese Application No. 2011-078146 and English translation (4 pages).

Chinese Office Action dated Sep. 29, 2014 with Search Report in Chinese Application No. 2012 1002 2700.1 (with partial English translation).

* cited by examiner

HIGH PRESSURE PUMP WITH PRESSURIZING CHAMBER ENCLOSED WITHIN CYLINDER INSERTED INTO HOUSING

CROSS REFERENCE TO RELATED APPLICATION

This application is based on and incorporates herein by reference Japanese Patent Application No. 2011-16694 filed on Jan. 28, 2011 and Japanese Patent Application No. 2011-78146 filed on Mar. 31, 2011.

BACKGROUND OF THE INVENTION

1. Field of the Invention

The present invention relates to a high pressure pump.

2. Description of Related Art

In a high pressure pump used for an internal combustion engine, fuel is pressurized in a pressurizing chamber by a plunger, which is reciprocated by rotation of a camshaft, and the pressurized fuel is pumped to fuel injectors. The plunger is reciprocatably supported by a cylinder, which is inserted in a housing of the high pressure pump. JP2008-525713A recites such a high pressure pump. In this high pressure pump, the cylinder, which is configured into a cylindrical tubular form and receives the plunger, is placed in the housing.

However, in the high pressure pump of JP2008-525713A, when the fuel is pressurized in the pressurizing chamber, a pressure of fuel generated in the pressurizing chamber, is applied to the cylinder through the plunger in a direction of removing the cylinder from the housing. Therefore, in order to limit the removal of the cylinder, a counter measure, such as swaging of the housing against the cylinder, needs to be taken.

In the case of the high pressure pump recited in JP2008-525713A, the pressurizing chamber is formed by an end surface of the plunger and an inner wall of the housing. In a case of a high pressure pump recited in WO0047888A1 (corresponding to U.S. Pat. No. 6,631,706B1), a housing contacts and holds a cylinder at a large diameter portion of the cylinder. A pressurizing chamber is formed by an inner wall of the cylinder and a cover member fixed to the housing with screws. In a case of a high pressure pump recited in JP4478431B2, a housing is joined to an upper portion of a cylinder, and a cover is joined between the housing and the cylinder to form a pressurizing chamber.

However, in the case of the high pressure pump recited in JP2008-525713A, a force of a pressure of fuel, which is pressurized in the pressurizing chamber, is applied to the inner wall of the housing, as discussed above. Lately, in order to meet demands of a large flow quantity of fuel and high fuel pressure performance, the pressure of the fuel applied to the inner wall of the housing is very high. Therefore, in order to achieve a sufficient rigidity of the housing against the high fuel pressure, a size of the housing is increased.

Furthermore, in the case of the high pressure pump recited in WO0047888A1 (corresponding to U.S. Pat. No. 6,631,706B1), the pressure of the fuel, which is generated in the pressurizing chamber, is upwardly applied to the cover member, which forms an upper portion of the pressurizing chamber. The cover member is fixed to the housing, so that the upwardly applied force is conducted to the housing. Therefore, in order to achieve a sufficient rigidity of the housing, a size of the housing is increased. Furthermore, in the case of the high pressure pump recited in WO0047888A1 (corresponding to U.S. Pat. No. 6,631,706B1), the large diameter portion of the cylinder contacts the housing, and a cylindrical fuel passage is formed between a small diameter portion of the cylinder and the inner wall of the housing. When rotational motion of a cam of the camshaft is converted into reciprocating motion of the cylinder, the plunger may possibly have precession motion or pendulum motion due to a deviation(s) in a contact position between the cam and a spring seat and/or a contact position between the spring seat and the plunger. The plunger slides in an inside of the small diameter portion of the cylinder. Therefore, when the small diameter portion of the cylinder is not held by the housing, the small diameter portion may possibly be deformed to cause occurrence of seizing of the plunger in the small diameter portion of the cylinder. In order to avoid occurrence of the seizing of the plunger, a wall thickness of the small diameter portion of the cylinder needs to be increased to limit the deformation of the small diameter portion, and thereby a size of the cylinder is increased. In other words, a size of the housing is increased.

Furthermore, in the case of the high pressure pump recited in JP4478431 B2, the force, which is exerted by the pressure of the fuel generated in the pressurizing chamber, is applied to a connection between the housing and the cylinder. Therefore, in order to achieve a sufficient rigidity of the housing, a size of the housing is increased, like in the case of JP2008-525713A and the case of WO0047888A1 (corresponding to U.S. Pat. No. 6,631,706B1).

SUMMARY OF THE INVENTION

The present invention addresses the above disadvantages.

According to the present invention, there is provided a high pressure pump, which includes a plunger, a cylinder and a pump housing. The plunger is adapted to reciprocate. The cylinder is configured into a bottomed tubular form and includes an inner peripheral wall, an inner bottom wall, an outer peripheral wall, an intake hole and a discharge hole. The inner peripheral wall slidably guides the plunger. The inner bottom wall is continuous from the inner peripheral wall. The intake hole and the discharge hole communicate between the inner peripheral wall and the outer peripheral wall. The pump housing includes a cylinder receiving hole, an intake passage and a discharge passage. The cylinder receiving hole includes an inner peripheral wall, into which the cylinder is inserted. The intake passage is communicated with the intake hole. The discharge passage is communicated with the discharge hole. A pressurizing chamber is formed by the inner peripheral wall and the inner bottom wall of the cylinder and a distal end outer wall of the plunger upon installation of the cylinder and the plunger into the cylinder receiving hole.

According to the present invention, there is also provided a high pressure pump, which includes a plunger, a cylinder, a housing and limiting means. The plunger is adapted to reciprocate. The cylinder is formed into a bottomed tubular form and includes a bottom portion and a tubular portion. The bottom portion closes one end of the tubular portion. The plunger is slidably supported by an inner wall of the tubular portion. A pressurizing chamber is formed by an upper end of the plunger, the inner wall of the tubular portion and an inner bottom wall of the bottom portion. An intake hole and a discharge hole are formed through at least one of the bottom portion and the tubular portion to radially communicate between an inside and an outside of the pressurizing chamber. The housing is engaged with an outer wall of the bottom portion and an outer wall of the tubular portion. The limiting means is for limiting movement of the cylinder toward the bottom portion of the cylinder relative to the housing when a pressure of the pressurizing chamber is increased.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

First Embodiment

A high pressure pump according to a first embodiment of the present invention will be described with reference to FIGS. 1 and 2. The high pressure pump of the first embodiment is installed to a vehicle (e.g., an automobile). The high pressure pump pressurizes fuel pumped by a low pressure pump from a fuel tank and supplies the pressurized fuel to a fuel rail connected to fuel injectors.

Figure 1:
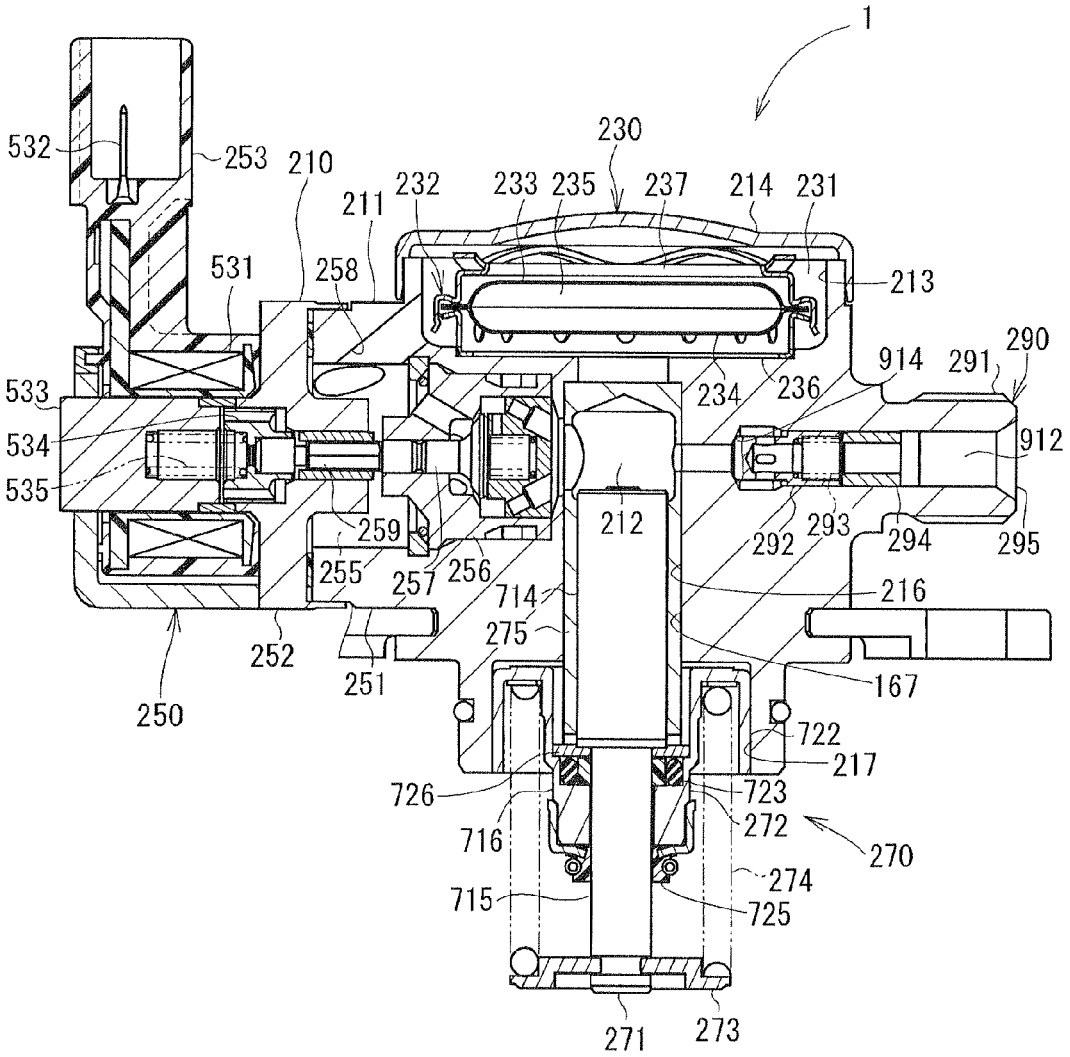
FIG. 1 is a cross-sectional view of a high pressure pump according to a first embodiment of the present invention.

As shown in FIG. 1, the high pressure pump 1 includes a main body 210, a fuel supplying arrangement 230, a metering valve arrangement 250, a plunger arrangement 270 and a discharge valve arrangement 290.

The main body 210 includes a pump housing 211, which forms an outer shell. The fuel supplying arrangement 230 is provided in a portion (an upper portion in FIG. 1) of the pump housing 211. The plunger arrangement 270 is provided to a portion (a lower portion in FIG. 1) of the pump housing 211, which is located on a side opposite from the fuel supplying arrangement 230. A pressurizing chamber 212 is formed at an intermediate location between the plunger arrangement 270 and the fuel supplying arrangement 230 in the pump housing 211 to pressurize fuel therein. Furthermore, the metering valve arrangement 250 and the discharge valve arrangement 290 are provided on one side (a left side in FIG. 1) and the other side (a right side in FIG. 1), respectively, of the pump housing 211 in a direction perpendicular to an axial direction, along which the fuel supplying arrangement 230 and the plunger arrangement 270 are arranged one after another.

Next, the structures of the fuel supplying arrangement 230, the metering valve arrangement 250, the plunger arrangement 270 and the discharge valve arrangement 290 will be described in detail.

The fuel supplying arrangement 230 includes a fuel gallery 231. The fuel gallery 231 is a space, which is surrounded by a recess 213 of the pump housing 211 and a cover 214. A damper unit 232 is placed in the fuel gallery 231. The damper unit 232 includes a damper member 235 and a support member 236. The damper member 235 includes two metal diaphragms 233, 234, which are joined together and are configured into a circular disk form. The damper unit 232 is urged by the cover 214 through a wave spring 237.

Next, the plunger arrangement 270 will be described.

As shown in FIG. 1, the plunger arrangement 270 includes a plunger 271, an oil seal holder 272, a spring seat 273, a plunger spring 274 and a cylinder 275.

A cylinder receiving hole 216 is formed in an inside of the pump housing 211. An inner peripheral wall (inner wall) of the cylinder receiving hole 216, which is parallel to the axial direction, is configured into a generally cylindrical tubular form. The cylinder 275, which slidably supports the plunger 271, is received in the cylinder receiving hole 216. The cylinder 275 will be described in detail later. The plunger 271 includes a large diameter portion 714 and a small diameter portion 715. The large diameter portion 714 is supported at an inside of the cylinder 275. The small diameter portion 715 has an outer diameter smaller than that of the large diameter portion 714. The small diameter portion 715 is surrounded by a plunger stopper 726, which is provided in the oil seal holder 272. One portion of the plunger stopper 726 is connected to and is fixed to the pump housing 211. The large diameter portion 714 and the small diameter portion 715 are formed integrally and is reciprocated in the axial direction.

The oil seal holder 272 is placed at an end portion of the cylinder 275 and includes a base portion 716 and a press-fitting portion 722. The base portion 716 is located on a radially outer side of the small diameter portion 715 of the plunger 271, and the press-fitting portion 722 is press fitted into the pump housing 211.

The base portion 716 includes a seal member 723, which is placed in an inside of the base portion 716 and is configured into a ring form (annular form). The seal member 723 is installed such that the seal member 723 surrounds the small diameter portion 715 of the plunger 271. The seal member 723 includes a Teflon ring (Teflon is a registered trademark and brand name of the DuPont company) and an O-ring. The O-ring is placed radially outward of the Teflon ring. The seal member 723 adjusts a thickness of a fuel oil film around the small diameter portion 715 of the plunger 271 and thereby limits leakage of fuel toward the engine.

Furthermore, the based portion 716 includes an oil seal 725 at a distal end part of the base portion 716. The oil seal 725 is installed such that the oil seal 725 surrounds a portion of the small diameter portion 715 located on the spring seat 273 side. The oil seal 725 limits a thickness of an oil film around the small diameter portion 715 of the plunger 271 and limits inflow of oil from the engine.

The press-fitting portion 722 is a cylindrical tubular portion, which is located around the base portion 716 on a radially outer side thereof and has a U-shaped longitudinal cross section. A cylinder recess 217, which corresponds to the press-fitting portion 722, is formed in the pump housing 211. Thereby, the oil seal holder 272 is press fitted such that the press-fitting portion 722 is press fitted to an inner wall of the cylinder recess 217.

The spring seat 273 is placed at an end portion of the plunger 271. The end portion of the plunger 271 contacts a tappet (not shown). The tappet contacts an outer peripheral surface of a cam, which is installed to a camshaft (not shown). When the camshaft is rotated, the tappet is axially reciprocated according to a cam profile of the cam. In this way, the plunger 271 is axially reciprocated.

One end of the plunger spring 274 is engaged to the spring seat 273, and the other end of the plunger spring 274 is engaged to a depth part of the press-fitting portion 722 of the oil seal holder 272. In this way, the plunger spring 274 functions as a return spring of the plunger 271 and thereby urges the plunger 271 against the tappet.

With the above construction, the plunger 271 is reciprocated in response to the rotation of the camshaft. At this time, the large diameter portion 714 of the reciprocating plunger 271 changes a volume of the pressurizing chamber 212.

Next, the metering valve arrangement 250 will be described.

As shown in FIG. 1, the metering valve arrangement 250 includes a metering valve tubular portion 251, a valve cover 252 and a connector 253. The metering valve tubular portion 251 is formed integrally in the pump housing 211. The valve cover 252 covers an opening of the metering valve tubular portion 251. Fuel is supplied from the fuel supplying arrangement 230 to the metering valve arrangement 250 through a fuel passage 258.

The metering valve tubular portion 251 is configured into a generally cylindrical tubular form, and an intake chamber 255 is formed in the metering valve tubular portion 251. A seat body 256, which is configured into a generally cylindrical tubular form, is placed in the intake chamber 255. An intake valve 257 is slidably supported in an inside of the seat body 256.

A needle 259 contacts the intake valve 257. The needle 259 extends into an inside of the connector 253 through the valve cover 252. The connector 253 includes a coil 531 and a plurality of terminals 532. An electric current is supplied to the coil 531 through the terminals 532. A stationary core 533, a movable core 534 and a spring 535 are placed on a radially inner side of the coil 531. The stationary core 533 is held in a predetermined location. The spring 535 is interposed between the stationary core 533 and the movable core 534. The needle 259 is fixed to the movable core 534. That is, the movable core 534 and the needle 259 are formed integrally.

Next, the discharge valve arrangement 290 will be described.

As shown in FIG. 1, the discharge valve arrangement 290 includes a receiving portion 291, which is formed by the pump housing 211 and is configured into a cylindrical tubular form. A discharge valve 292, a spring 293 and an engaging portion 294 are received in the discharge valve receiving chamber 912, which is formed by the receiving portion 291. An opening of the discharge valve receiving chamber 912 forms a discharge outlet 295. A valve seat 914 is formed in a depth portion of the discharge valve receiving chamber 912 on a side opposite from the discharge outlet 295.

The discharge valve 292 is urged against the valve seat 914 by an urging force of the spring 293 and a pressure of fuel applied from a fuel rail side. In this way, when a pressure of fuel in the pressurizing chamber 212 is low, discharging of fuel from the discharge valve 292 is stopped. In contrast, when the pressure of fuel in the pressurizing chamber 212 is increased to overcome the urging force of the spring 293 and the pressure of fuel on the fuel rail side, the discharge valve 292 is moved toward the discharge outlet 295. In this way, fuel, which is supplied from the pressurizing chamber 212 into the discharge valve receiving chamber 912, is discharged from the discharge outlet 295.

The structure of the high pressure pump 1 has been described above. Next, the shape of the cylinder 275 will be described with reference to FIG. 2.

Figure 2:
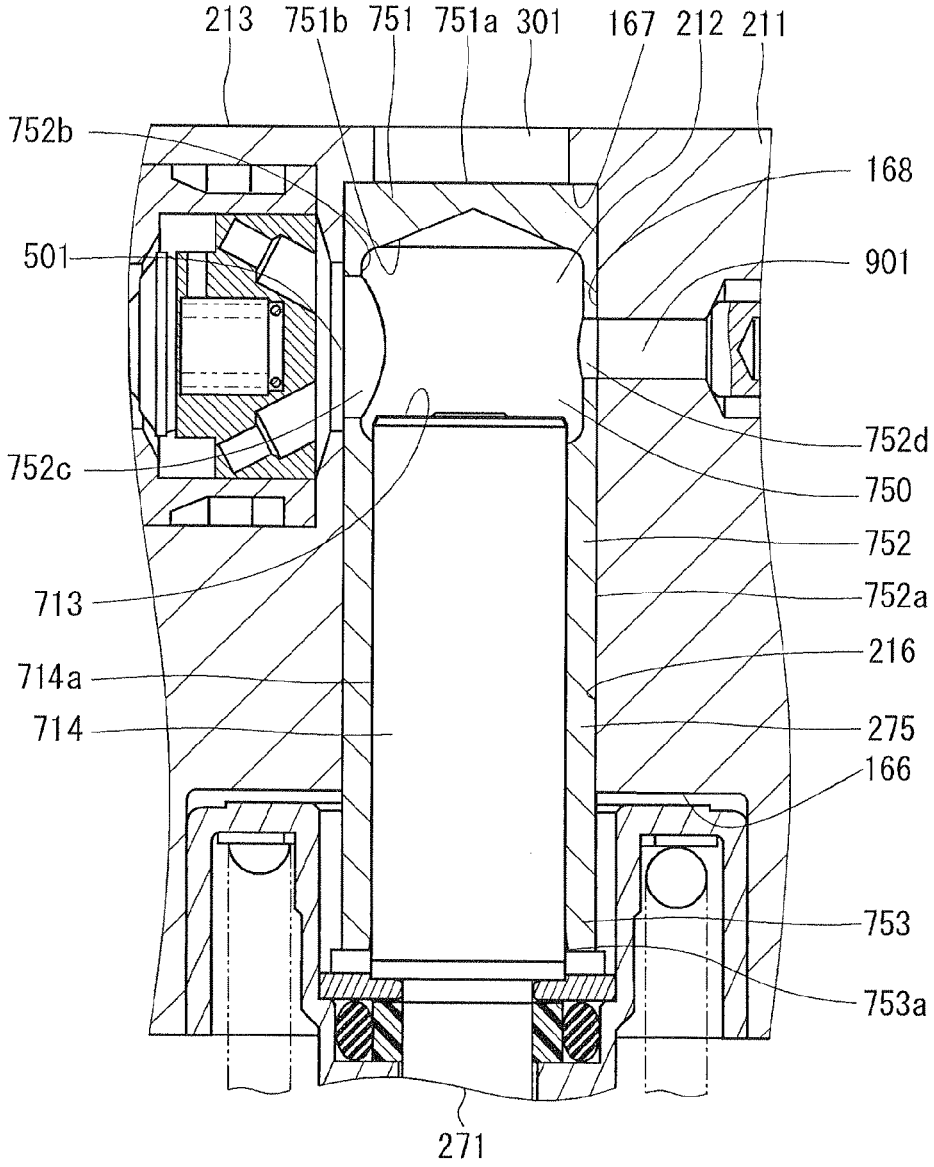
FIG. 2 is an enlarged cross-sectional view indicating an area around a cylinder of the high pressure pump of the first embodiment.

As shown in FIG. 2, the cylinder 275 is received in the cylinder receiving hole 216, which is formed in the pump housing 211. The cylinder 275 is inserted into the pump housing 211 by press fit. The cylinder 275 is configured into a bottomed cylindrical tubular form. Specifically, the cylinder 275 includes a cylinder closing portion 751, a cylinder tubular portion 752 and a cylinder opening 753. The cylinder tubular portion 752 is parallel to a central axis of the cylinder 275, and the cylinder closing portion 751 closes one end part of the cylinder tubular portion 752. The cylinder opening 753 is formed at the other end part of the cylinder tubular portion 752 and has an opening end 753*a*. The plunger 271 is inserted into the cylinder 275 through the cylinder opening 753.

A cylinder outer bottom wall 751*a* of the cylinder closing portion 751 is configured into a generally planar form having a generally planar outer surface and contacts a bottom surface 167 of the cylinder receiving hole 216. A communication passage 301, which is communicated with the fuel gallery 231, is formed in the bottom surface 167. The communication passage 301 returns leaked fuel, which is leaked into a space between the cylinder 275 and the cylinder receiving hole 216, to the fuel gallery 231. A cylinder inner bottom wall 751*b* of the cylinder closing portion 751 is configured into a generally conical form, which has an increasing diameter toward a lower side in FIG. 2. The cylinder outer bottom wall 751*a* may serve as an outer bottom wall of the cylinder. The cylinder inner bottom wall 751*b* may serve as an inner bottom wall of the cylinder.

The cylinder tubular portion 752 is configured into a generally cylindrical tubular form. The cylinder outer peripheral wall (cylinder outer wall) 752*a* of the cylinder tubular portion 752 is generally parallel to the central axis of the cylinder 275. The cylinder outer peripheral wall 752*a* contacts an inner peripheral wall (inner wall) 168 of the cylinder receiving hole 216.

A cylinder inner peripheral wall 752*b* of the cylinder tubular portion 752 is generally parallel to the central axis of the cylinder 275. The cylinder inner peripheral wall 752*b* of the cylinder tubular portion 752 contacts an outer peripheral wall 714*a* of the large diameter portion 714 of the plunger 271. The cylinder outer peripheral wall 752*a* may serve as an outer peripheral wall (outer wall) of the cylinder. The cylinder inner peripheral wall 752*b* may serve as an inner peripheral wall (inner wall) of the cylinder.

An intake hole (intake opening) 752*c* and a discharge hole (discharge opening) 752*d* are formed as openings, which communicate between an inside space 750 of the cylinder 275 and an outside of the cylinder 275, in the cylinder tubular portion 752. The intake hole 752*c* and the discharge hole 752*d* are formed in the cylinder tubular portion 752 at generally the same height measured from the cylinder closing portion 751. The intake hole 752*c* is connected to an intake passage 501, which is formed in the inner peripheral wall 168 of the cylinder receiving hole 216 and through which fuel supplied from the metering valve arrangement 250 passes. The discharge hole 752*d* is connected to a discharge passage 901, which is formed in the inner peripheral wall 168 of the cylinder receiving hole 216 on a side opposite from the intake passage 501 and is connected to the discharge valve arrangement 290.

The pressurizing chamber 212, in which fuel is pressurized, is a space that is formed in the inside space 750 of the cylinder 275. Specifically, the pressurizing chamber 212 is formed by the cylinder inner bottom wall 751*b*, the cylinder inner peripheral wall 752*b* and a distal end outer wall 713 of the plunger 271.

Next, the operating the high pressure pump 1 will be described.

(1) Intake Stroke

When the plunger 271 is moved downward from a top dead center toward a bottom dead center, a pressure of the pressurizing chamber 212 is reduced. At this time, the energization of the coil 531 is stopped, and thereby the intake valve 257 is placed in a valve open state. Thus, the intake chamber 255 and the pressurizing chamber 212 are communicated with each other. The discharge valve 292 is seated against the valve seat 914 to close the discharge valve receiving chamber 912. In this way, fuel of the fuel gallery 231 is drawn into the pressurizing chamber 212 through the intake chamber 255.

(2) Metering Stroke

When the plunger 271 is moved upward from the bottom dead center toward the top dead center, the energization of the coil 531 is stopped until predetermined timing (predetermined time point). Thereby, the intake valve 257 is maintained in a valve open state. Therefore, the low pressure fuel of the pressurizing chamber 212 is returned into the fuel gallery 231 through the intake chamber 255.

When the coil 531 is energized through the terminals 532 of the connector 253 at the predetermined timing in the middle of the metering stroke, a magnetic attractive force is generated between the stationary core 533 and the movable core 534 by the magnetic filed generated by the coil 531. Thus, the movable core 534 and the needle 259, which are integrated together, are moved toward the stationary core 533. Then, the needle 259 is spaced away from the intake valve 257, so that the intake valve 257 is moved toward the seat body 256 by the force generated by the flow of the low pressure fuel, which is discharged from the pressurizing chamber 212 toward the fuel gallery 231. As a result, the intake valve 257 is seated against the seat body 256, so that the intake valve 257 is placed into a valve closed state.

When the intake valve 257 is closed, the flow of fuel in the intake chamber 255 is blocked, and the metering stroke, which returns the low pressure fuel from the pressurizing chamber 212 toward the fuel gallery 231, is terminated. Specifically, the energization time of the coil 531 is adjusted, and thereby the amount of low pressure fuel, which is returned from the pressurizing chamber 212 into the fuel gallery 231, is adjusted. In this way, the amount of fuel, which is pressurized in the pressurizing chamber 212, is determined.

(3) Pressurizing Stroke

In the state where the flow of fuel between the pressurizing chamber 212 and the fuel gallery 231 is blocked, when the plunger 271 is further moved upward toward the top dead center, the pressure of fuel in the pressurizing chamber 212 is increased. At this time, the pressure of fuel is applied to all of the cylinder inner bottom wall 751*b* and the cylinder inner peripheral wall 752*b* of the cylinder 275 and the distal end outer wall 713 of the plunger 271, which form the pressurizing chamber 212. When the pressure of fuel in the pressurizing chamber 212 becomes equal to or larger than a predetermined pressure, the discharge valve 292 is opened against the resilient force of the spring 293 and the pressure of fuel at the discharge outlet 295 side. In this way, the pressurized fuel, which is pressurized in the pressurizing chamber 212, is discharged from the discharge outlet 295 through the discharge valve receiving chamber 912.

When the plunger 271 is moved upward to the top dead center, the energization of the coil 531 is stopped, and thereby the intake valve 257 is placed in the valve open state once again. Then, the plunger 271 is moved downward to have the intake stroke once again.

When the intake stroke, the metering stroke and the pressurizing stroke are repeated in the above described manner, the fuel, which is drawn into the high pressure pump 1, is pressurized and is discharged from the high pressure pump 1.

Next, advantages of the high pressure pump 1 of the present embodiment will be described in comparison to a high pressure pump of a comparative example shown in FIG. 7.

Figure 7:
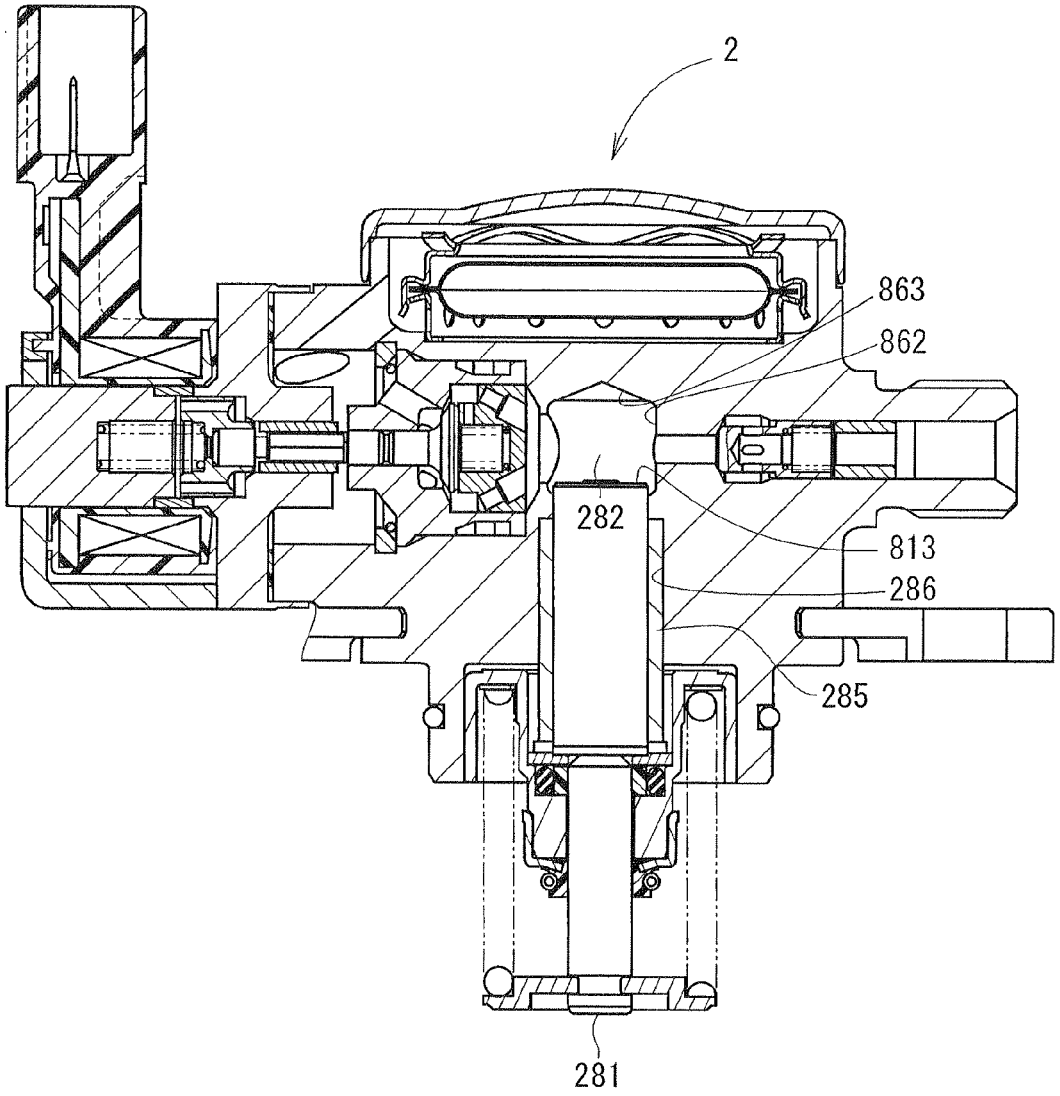
FIG. 7 RELATED ART
FIG. 7 is a cross-sectional view indicating a structure of a high pressure pump in a comparative example.
Figure 8:
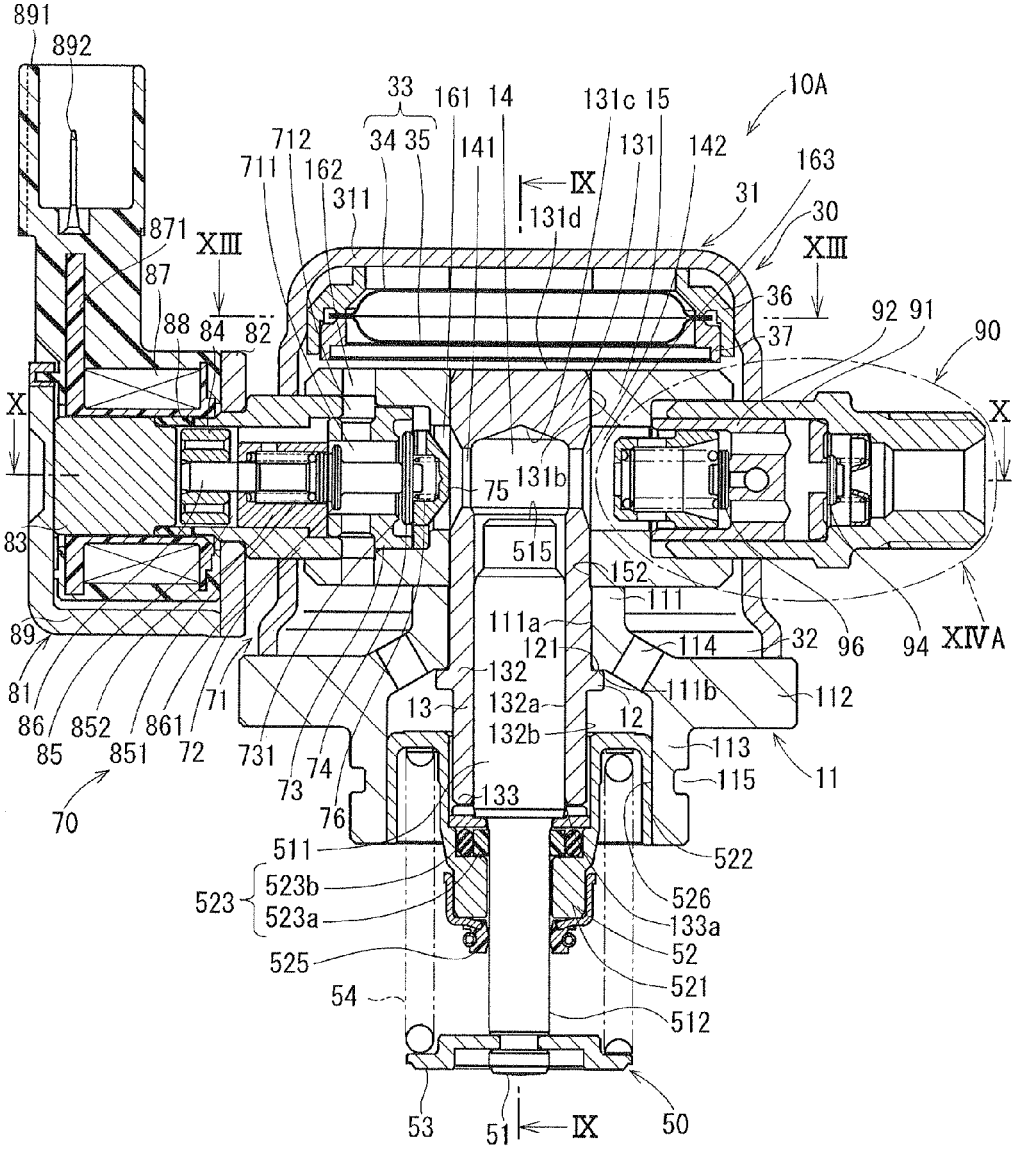
FIG. 8 is a schematic cross-sectional view of a high pressure pump taken along line VIII-VIII in FIG. 10 according to a sixth embodiment of the present invention.

(A) In the high pressure pump 2 of the comparative example shown in FIG. 7, a cylinder 285 is received in a cylinder receiving hole 286. The cylinder 285 of the comparative example is configured into a generally cylindrical tubular form. Thereby, a pressurizing chamber 282, in which fuel is pressurized, is formed by a bottom surface 863 of the cylinder receiving hole 286, an inner peripheral wall 862 of the cylinder receiving hole 286 and an outer wall 813 of a plunger 281. In contrast, the cylinder 275 of the high pressure pump 1 of the present embodiment is configured to have a generally U-shaped longitudinal cross section. Thereby, in the present embodiment, the pressurizing chamber 212 is formed by the cylinder inner bottom wall 751*b* and the cylinder inner peripheral wall 752*b* of the cylinder 275 and the distal end outer wall 713 of the plunger 271.

When the fuel is pressurized in the pressurizing chamber, the pressure of the fuel is applied to all of the wall surfaces, which form the pressurizing chamber. In the high pressure pump 2 of the comparative example, a downward force is exerted in the cylinder 285 by the amount, which corresponds to a product of the cross-sectional area of the cylinder 285 multiplied by the pressure of fuel. Thus, the downward direction of the force is the removing direction of the cylinder 285 from the cylinder receiving hole 286. Therefore, in the high pressure pump 2 of the comparative example, the counter measure, such as swaging of the cylinder 285, needs to be taken to limit the removal of the cylinder 285 from the cylinder receiving hole 286. In contrast, in the embodiment of the present invention, the pressure of fuel, which generated in the pressurizing chamber 212, is exerted not only to the distal end outer wall 713 of the plunger 271 but also to the cylinder inner bottom wall 751*b* of the cylinder 275. The pressure of fuel, which is exerted to the cylinder inner bottom wall 751*b*, is exerted in the upward direction in FIG. 1. This upward direction is the inserting direction of the cylinder 275 into the cylinder receiving hole 216. Therefore, in the present embodiment, the removal of the cylinder 275 can be effectively limited without a need for a process (e.g., a swaging process), which limits the removal of the cylinder 275. In other words, the frictional force between the cylinder 275 and the cylinder receiving hole 216 may be sufficient or effective to limit the removal of the cylinder 275 from the cylinder receiving hole 216.

Second Embodiment

Next, a second embodiment of the present invention will be described with reference to FIG. 3. In the second embodiment, the shape of the cylinder is partially modified from that of the first embodiment. In the following description, components, which are similar to those of the first embodiment, will be indicated by the same reference numerals and will not be described further.

Figure 3:
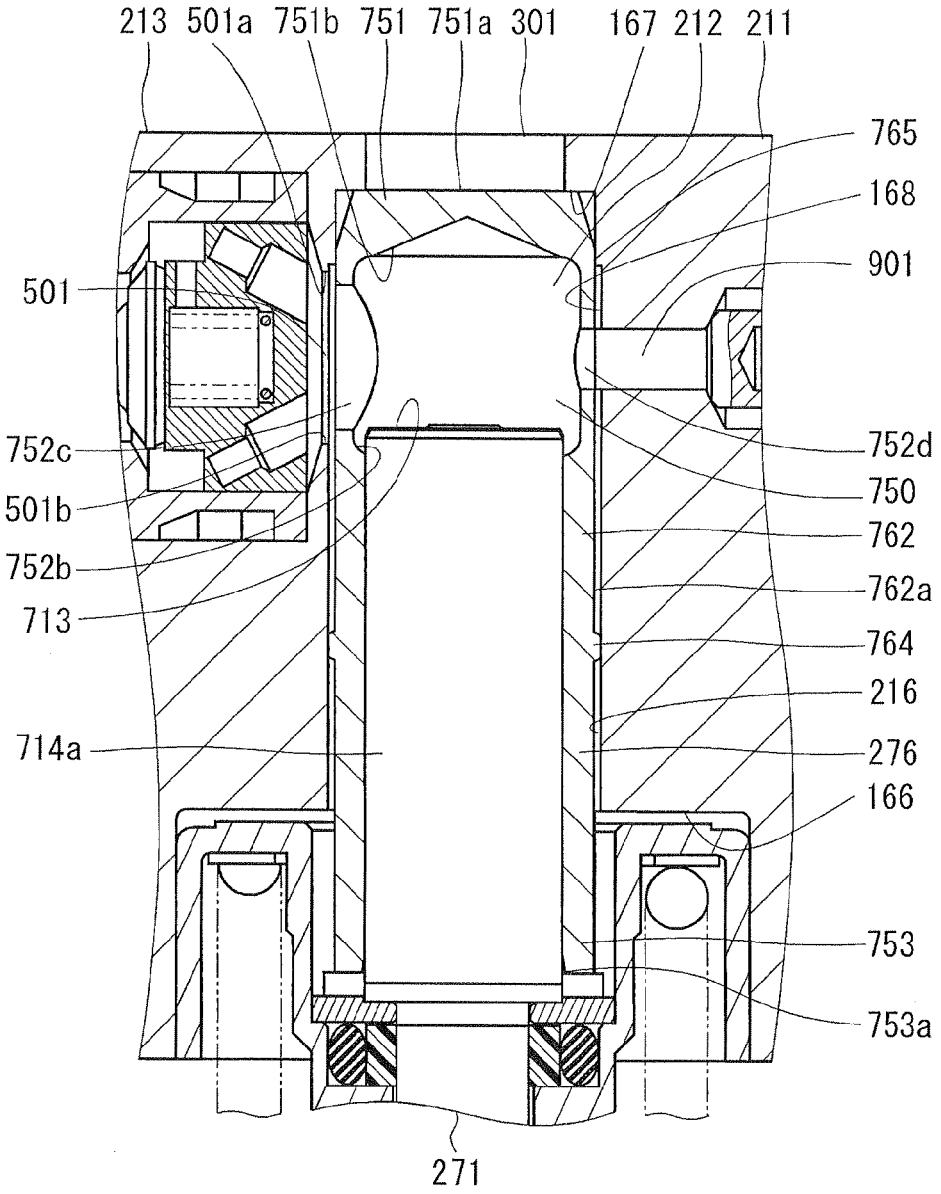
FIG. 3 is an enlarged cross-sectional view indicating an area around a cylinder of a high pressure pump according to a second embodiment of the present invention.

As shown in FIG. 3, a cylinder 276 of the second embodiment includes a first projection 764, which radially outwardly projects from a cylinder outer peripheral wall 762*a* of the cylinder 276. The first projection 764 is provided between a lower end surface 501*b* of the intake passage 501 of the cylinder tubular portion 762 and an opening surface 166 of the cylinder receiving hole 216. The first projection 764 is configured into an annular form (ring form), which circumferentially extends along the cylinder outer peripheral wall 762*a*, and the first projection 764 contacts the inner peripheral wall 168 of the cylinder receiving hole 216. The cylinder outer peripheral wall 762*a* includes a contact portion 765, which contacts the inner peripheral wall 168 of the cylinder receiving hole 216 at a location, which is on an upper side of an upper end surface 501*a* of the intake passage 501. The first projection 764 may serve as a projection of the present invention.

Now, advantages of the second embodiment will be described.

(B) In the second embodiment, the cylinder 276 includes the first projection 764, which is configured into the annular form and is located on the radially outer side of the cylinder outer peripheral wall 762*a*. The first projection 764 contacts the inner peripheral wall 168 of the cylinder receiving hole 216, so that a contact surface area between the inner peripheral wall 168 of the cylinder receiving hole 216 and the cylinder 276 is reduced. Thereby, a required load, which is required for press-fitting of the cylinder 276 into the cylinder receiving hole 216, is reduced. Thus, in addition to the advantage discussed in the section (A) of the first embodiment, the press-fitting of the cylinder 276 into the cylinder receiving hole 216 is eased.

Third Embodiment

Next, a third embodiment of the present invention will be described with reference to FIGS. 4A and 4B. In the third embodiment, the number of the projections is different from that of the second embodiment. In the following description, components, which are similar to those of the second embodiment, will be indicated by the same reference numerals and will not be described further.

Figure 4A:
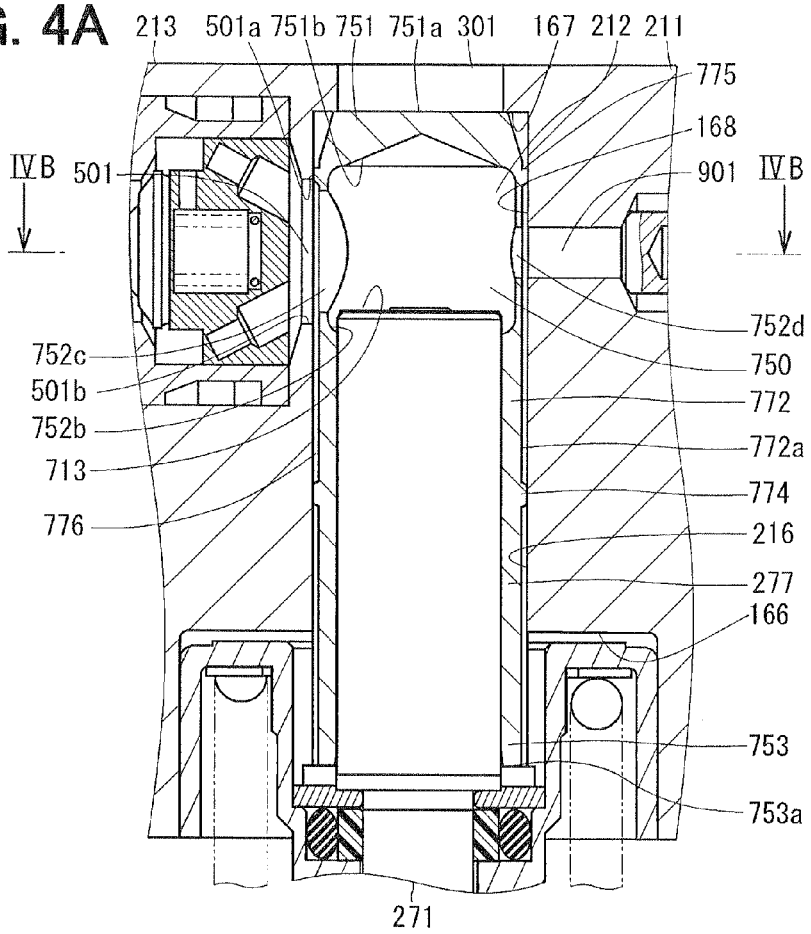
FIG. 4A is an enlarged cross-sectional view indicating an area around a cylinder of a high pressure pump according to a third embodiment of the present invention.
Figure 4B:
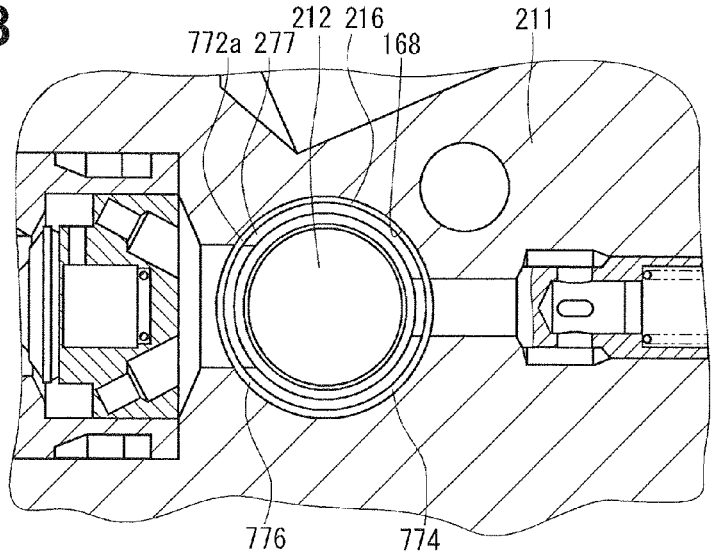
FIG. 4B is a cross-sectional view taken along line IVB-IVB in FIG. 4A.

As shown in FIG. 4A, the cylinder 277 of the third embodiment includes a second projection 775, which projects radially outward from a cylinder outer peripheral wall 772*a* of a cylinder tubular portion 772. The second projection 775 is formed at a location, which is above the upper end surface 501*a* of the intake passage (fuel supply passage) 501. The second projection 775 is configured into an annular form (ring form), which circumferentially extends along the cylinder outer peripheral wall 772*a*, and the second projection 775 contacts the inner peripheral wall 168 of the cylinder receiving hole 216. In this way, as shown in FIG. 4B, a recessed portion (annular gap) 776 is formed by the cylinder outer peripheral wall 772*a*, the inner peripheral wall 168 of the cylinder receiving hole 216, the first projection 774 and the second projection 775 (see FIG. 4A). The recessed portion 776 is communicated with the pressurizing chamber 212 through the intake hole 752*c* and the discharge hole 752*d*, which are formed in the cylinder tubular portion 772. The second projection 775 may serve as a projection of the present invention.

Now, advantages of the third embodiment will be described.

(C) When fuel is supplied to the pressurizing chamber 212, the fuel flows into the recessed portion 776, which is formed between the cylinder 277 and the cylinder receiving hole 216. The fuel, which is supplied into the recessed portion 776, does not leak to an outside of the recessed portion 776 because of the provision of the first projection 774 and the second projection 775. Thus, in addition to the advantage discussed in the section (A) of the first embodiment and the advantage discussed in the section (B) of the second embodiment, it is possible to seal or block the leaked fuel, which is leaked from the pressurizing chamber 212.

(D) The first projection 774 and the second projection 775, which are formed in the cylinder outer peripheral wall 772*a*, contact the inner peripheral wall 168 of the cylinder receiving hole 216. When the cylinder 277 is press fitted into the cylinder receiving hole 216, the first projection 774 and the second projection 775 maintain the gap between the cylinder outer peripheral wall 772*a* of the cylinder 277 and the inner peripheral wall 168 of the cylinder receiving hole 216. The first projection 774 and the second projection 775 are formed, so that the central axis of the cylinder receiving hole 216 can be coincided with the central axis of the cylinder 277. Thus, in addition to the advantage discussed in the section (A) of the first embodiment and the advantage discussed in the section (B) of the second embodiment, it is possible to limit tilting of the cylinder 277 in the cylinder receiving hole 216.

Fourth Embodiment

Figure 5:
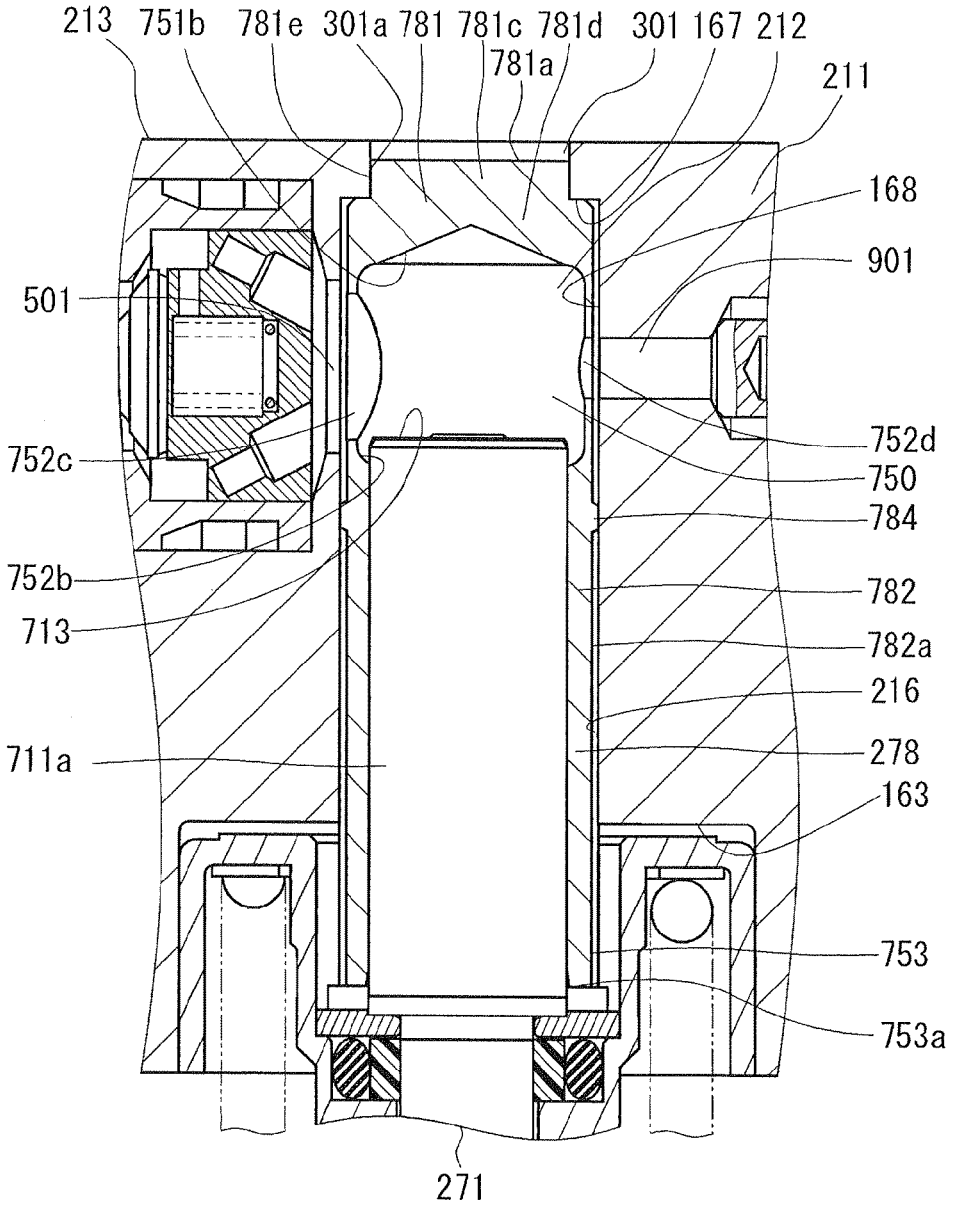
FIG. 5 is an enlarged cross-sectional view indicating an area around a cylinder of a high pressure pump according to a fourth embodiment of the present invention.

Next, a fourth embodiment of the present invention will be described with reference to FIG. 5. The fourth embodiment differs from the second embodiment with respect the shape of the cylinder and the contact position between the cylinder and the pump housing. In the following description, components, which are similar to those of the second embodiment, will be indicated by the same reference numerals and will not be described further.

A cylinder closing portion 781 of a cylinder 278 of a fourth embodiment of the present invention is formed by a small diameter portion 781*c* and a large diameter portion 781*d*. An end wall 781*a* of the small diameter portion 781*c* forms an outer bottom wall of the cylinder 278. The large diameter portion 781*d* has an outer diameter, which is substantially the same as that of the cylinder tubular portion 782 of the cylinder 278. The large diameter portion 781*d* is connected to the cylinder tubular portion 782, which has a cylinder outer peripheral wall 782*a*. The small diameter portion 781*c* is connected to a part of the large diameter portion 781*d*, which is opposite from the cylinder tubular portion 782. An outer peripheral wall surface 781*e* of the small diameter portion 781*c* contacts an inner peripheral wall 301*a* of the communication passage 301. When the cylinder 278 is press fitted into the cylinder receiving hole 216, the small diameter portion 781*c* is fitted into the communication passage 301.

The cylinder 278 is supported by the small diameter portion 781*c* and the first projection 784. At this time, the small diameter portion 781*c* is press fitted into the communication passage 301, which is formed in the pump housing 211. When the small diameter portion 781*c* is press fitted into the communication passage 301, the small diameter portion 781*c* receives a compressive stress from the inner peripheral wall 301*a* of the communication passage 301. The small diameter portion 781*c* is solid and thereby does not have a space therein, so that the small diameter portion 781*c* is not deformed by the compressive stress. Thereby, in addition to the advantage discussed in the section (A) of the first embodiment and the advantage discussed in the section (B) of the second embodiment, it is possible to limit the compressive stress caused by the press fitting.

Fifth Embodiment

Next, a fifth embodiment of the present invention will be described with reference to FIG. 6. The fifth embodiment differs from the third embodiment such that a fuel return flow passage, which returns fuel supplied to the discharge valve arrangement to the recessed portion, is provided in the fifth embodiment. In the following description, components, which are similar to those of the third embodiment, will be indicated by the same reference numerals and will not be described further.

Figure 6:
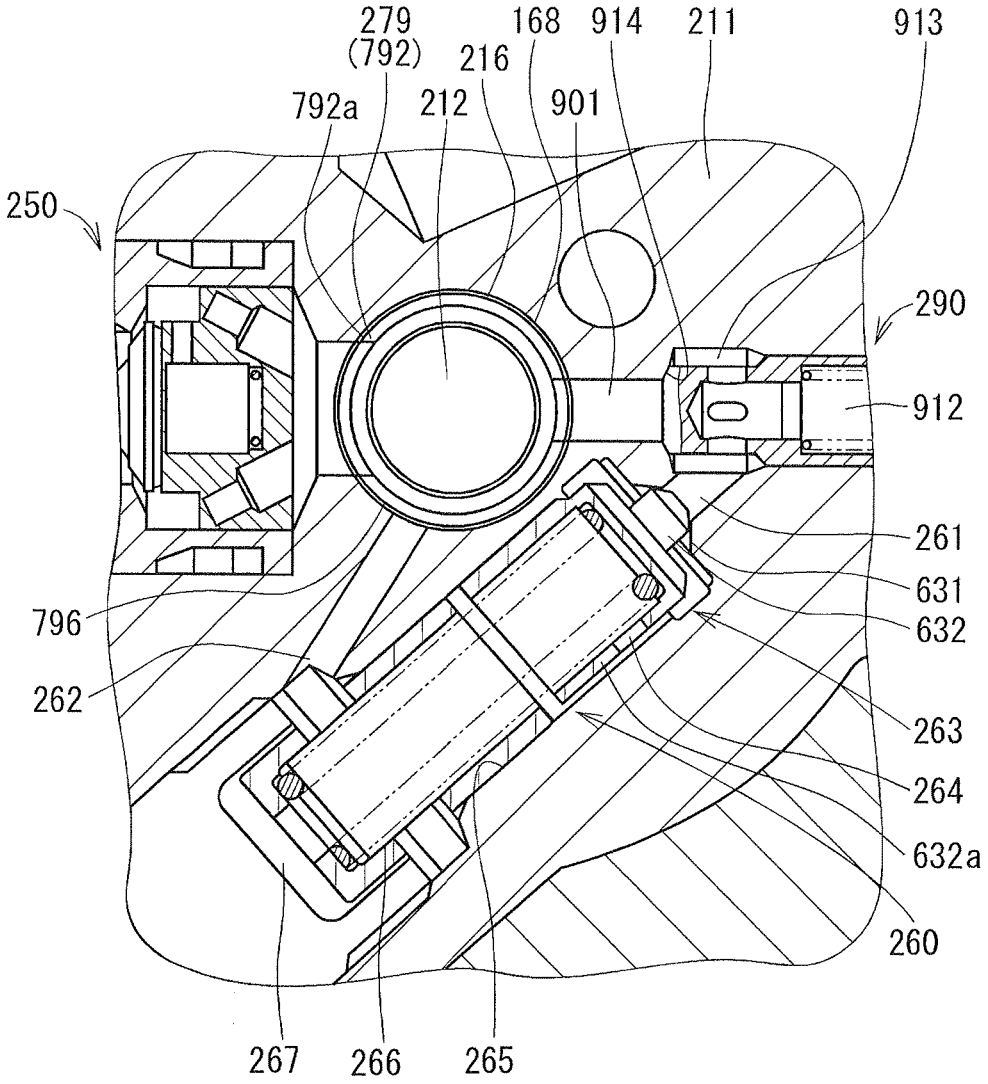
FIG. 6 is an enlarged cross-sectional view indicating an area around a cylinder of a high pressure pump according to a fifth embodiment of the present invention taken in a direction parallel to a central axis of the cylinder.

FIG. 6 is an enlarged partial cross-sectional view of a high pressure pump of the fifth embodiment seen from an upper side of the high pressure pump.

The metering valve arrangement 250 and the discharge valve arrangement 290 are provided on the left side and the right side, respectively, of the pressurizing chamber 212 in FIG. 6. A relief valve receiving arrangement 260 includes a relief valve receiving chamber 265, which connects between the discharge valve receiving chamber 912 and a recessed portion 796. In FIG. 6, the relief valve receiving arrangement 260 is placed on a downstream side of the pressurizing chamber 212 in FIG. 6.

The relief valve receiving arrangement 260 includes connection passages 261, 262 that connect the discharge valve receiving chamber 912 to the recessed portion 796. The discharge valve receiving chamber 912 is located on the downstream side of the valve seat 914, against which a discharge valve element 913 is seatable.

The relief valve receiving arrangement 260 includes a relief valve 263 of a mechanical type. The relief valve 263 is placed in the relief valve receiving chamber (also referred to as a fuel passage) 265 that is connected to the connection passage 261. An inner diameter of the relief valve receiving chamber (fuel passage) 265 is larger than an inner diameter of the connection passage 261. The connection passage 262 communicates between the relief valve receiving chamber (fuel passage) 265 and the recessed portion 796.

The relief valve 263 includes a relief valve element 632 and a spring 266. The relief valve element 632 is configured into a tubular form and has a valve element main body 632*a*, which receives the spring 266 and has a relief flow passage 264, which extends through a wall of the valve element main body 632*a*. The spring 266 urges the relief valve element 632. The relief valve element 632 is axially movably supported in the relief valve receiving chamber (fuel passage) 265.

One end of the spring 266 is engaged with an engaging portion 267, which is placed on a downstream side of the relief valve element 632. The other end of the spring 266 is engaged with the relief valve element 632. Furthermore, a valve seat 631 is formed in a connecting portion, which connects between the connection passage 261 and the relief valve receiving chamber (fuel passage) 265. A distal end portion of the relief valve element 632, which is urged by the spring 266, contacts the valve seat 631.

The relief valve element 632 is normally seated against the valve seat 631. When the pressure of fuel in the discharge valve receiving chamber 912 becomes equal to or larger than a permissible pressure range, the pressure of fuel, which is applied to the distal end portion of the relief valve element 632, lifts the relief valve element 632 away from the valve seat 631 against the urging force of the spring 266.

In the fifth embodiment, the relief valve receiving chamber (fuel passage) 265 is communicated with the recessed portion 796 through the connection passage 262. The recessed portion 796 is formed by an outer peripheral wall 792*a* of a tubular portion 792 of a cylinder 279, the inner peripheral wall 168 of the cylinder receiving hole 216, a first projection (not shown in FIG. 6 but similar to the first projection 774 of the third embodiment) and a second projection (not shown in FIG. 6 but similar to the second projection 775 of the third embodiment). Furthermore, the recessed portion 796 is also communicated with the pressurizing chamber 212.

When the pressure in the discharge valve receiving chamber 912 becomes a high pressure due to, for example, abnormality of the fuel injector, the relief valve 263 is opened to return the high pressure fuel to the pressurizing chamber 212 through the connection passage (fuel passage) 262. At this time, the high pressure fuel, which flows in the connection passage 262, is supplied into the recessed portion 796 and is then returned to the pressurizing chamber 212. In this way, a damage of a rail chamber can be limited without forming a relief through-hole in the cylinder 279.

Now, modifications of the above embodiments will be described.

In the above embodiments, the cylinder is inserted into the cylinder receiving hole by press-fitting the cylinder into the pump housing. However, the way of inserting the cylinder is not limited to this. For instance, cooling fit, shrink fit or a combination of the cooling fit and the shrink fit may be used. In the case of the cooling fit, the cylinder is cooled before the insertion of the cylinder into the housing. In the case of the shrink fit, the housing is heated before the insertion of the cylinder into the housing.

In the second embodiment, the number of the projection, which is formed in the cylinder outer peripheral wall, is one, and this one projection is placed on a lower side of the lower end surface of the intake passage in the cylinder outer peripheral wall. However, the number of the projection(s) is not limited to one and may be modified to any other appropriate number. For instance, the number of the projection(s) may be two or more.

In the third embodiment, the number of the projections, which are formed in the cylinder outer peripheral wall, is two. However, the number of the projection(s) is not limited to two and may be modified to any other appropriate number. For instance, the number of the projection(s) may be changed to more than two.

In the fourth embodiment, the cylinder closing portion includes the large diameter portion and the small diameter portion. However, the shape of the cylinder closing portion is not limited to this. For instance, the cylinder closing portion may include only the large diameter portion or may include only the small diameter portion.

In the fourth embodiment, the cylinder is fitted into the pump housing at the communication passage. However, the portion of the pump housing, into which the cylinder is fitted, is not limited to this. For instance, the cylinder may be fitted to an inner peripheral wall of the cylinder receiving hole.

Sixth Embodiment

Figure 12A:
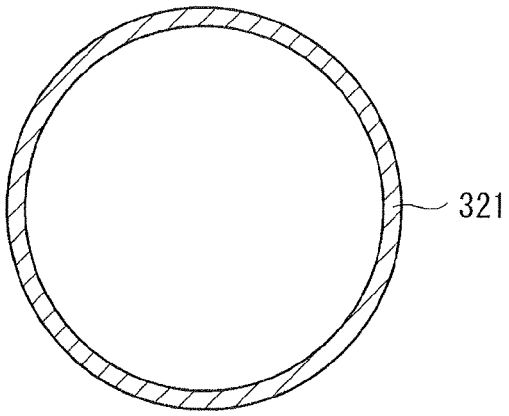
FIG. 12A is a cross-sectional view of the cover of the high pressure pump taken along line XIIA-XIIA in FIG. 11.
Figure 12B:
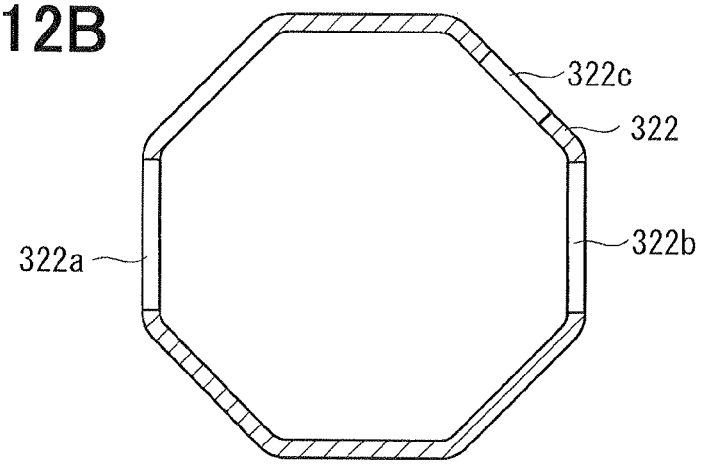
FIG. 12B is a cross-sectional view of the cover of the high pressure pump taken along line XIIB-XIIB in FIG. 11.
Figure 12C:
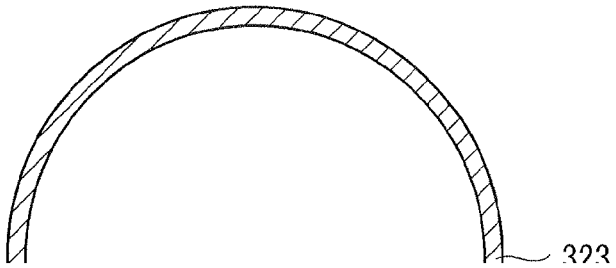
FIG. 12C is a cross-sectional view of the cover of the high pressure pump taken along line XIIC-XIIC in FIG. 11.
Figure 13:
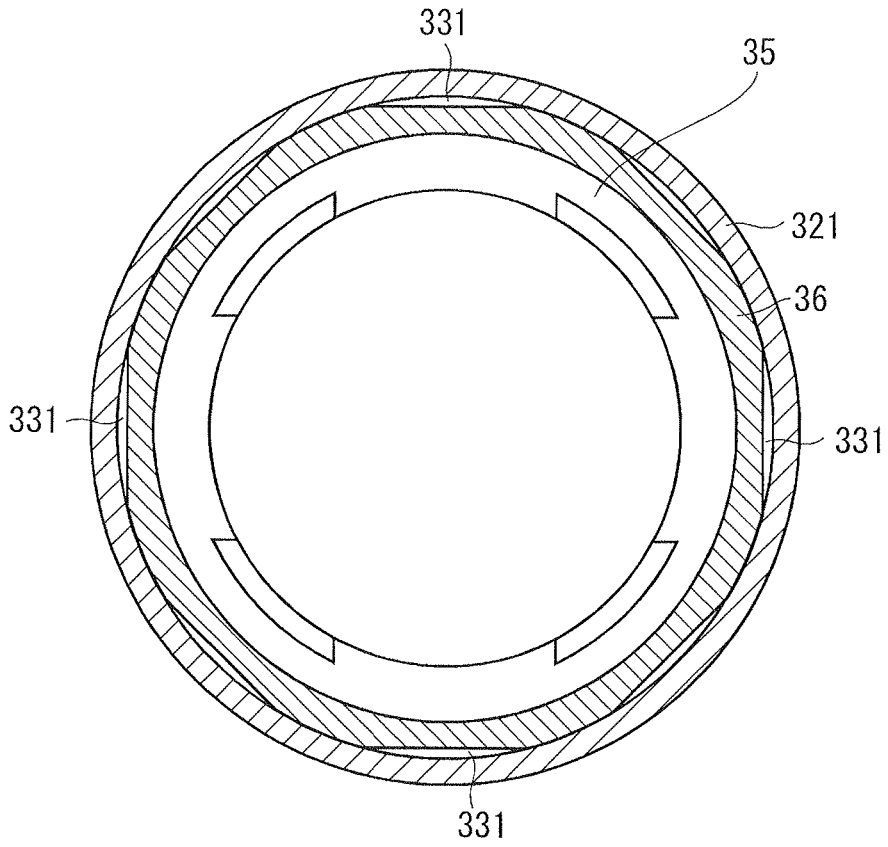
FIG. 13 is a cross-sectional view taken along line XIII-XIII in FIG. 8.
Figure 14A:
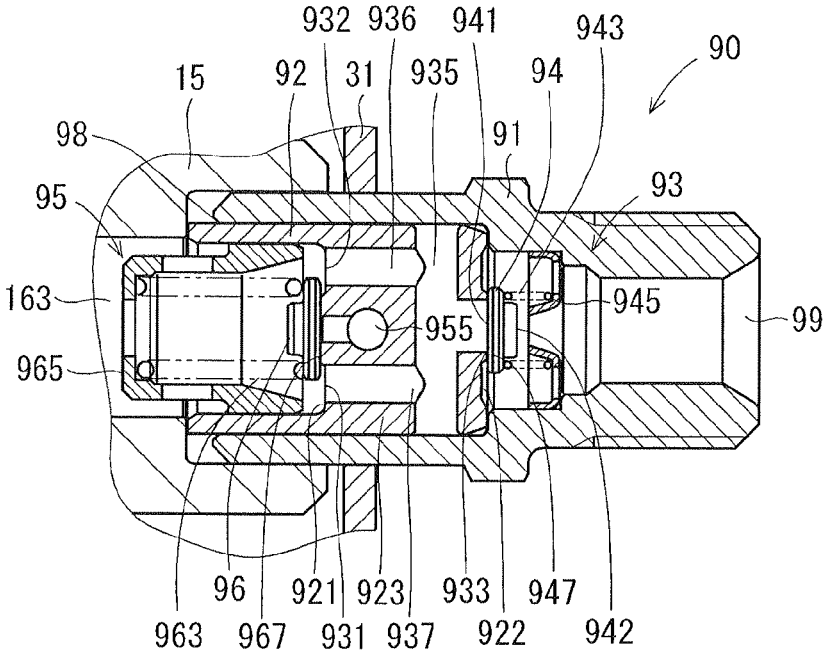
FIG. 14A is an enlarged cross-sectional view of an area XIVA in FIG. 8, indicating a fuel discharge relief arrangement of the high pressure pump of the sixth embodiment.
Figure 14B:
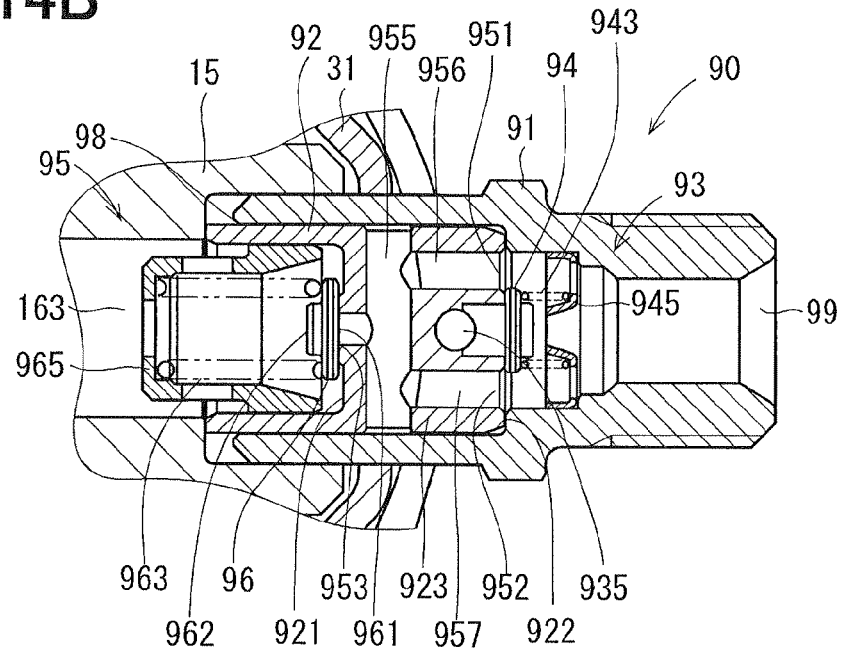
FIG. 14B is an enlarged cross-sectional view of an area XIVB in FIG. 10, indicating the fuel discharge relief arrangement of the sixth embodiment.

FIGS. 8 to 14B show a structure of a high pressure pump 10A according to a sixth embodiment of the present invention. The high pressure pump 10A receives fuel, which is pumped by a low pressure pump (not shown) from a fuel tank (not shown). In the high pressure pump 10A, the fuel, which is received from the low pressure pump, is supplied to and is pressurized in a pressurizing chamber 14. Then, the pressurized fuel is discharged from the pressurizing chamber 14 to a fuel rail (not shown) through a discharge valve 93 (FIGS. 14A and 14B). The fuel rail is connected to fuel injectors. In the following description, an upper side of FIG. 8 will be described as an upper side of the high pressure pump 10A, and a lower side of FIG. 8 will be described as a lower side of the high pressure pump 10A.

The high pressure pump 10A includes a main body 10 (FIG. 9), a fuel supplying arrangement 30, a plunger arrangement 50, a fuel intake arrangement (metering valve arrangement) 70 and a fuel discharge relief arrangement 90.

The main body 10 includes a lower housing 11, a cylinder 13 and an upper housing 15.

The lower housing 11 includes a cylinder holding portion 111, an engine mount portion 112 and a fitting portion 113. The cylinder holding portion 111 is configured into a cylindrical tubular form. The engine mount portion 112 is configured into a planar annular form and radially outwardly projects from a lower part of the cylinder holding portion 111 to continuously extend in a circumferential direction. The fitting portion 113 is configured into a cylindrical tubular form having a diameter larger than that of the cylinder holding portion 111 and projects from the engine mount portion 112 toward a side, which is opposite from the cylinder holding portion 111 in an axial direction of the cylinder 13. A plurality of fuel passages 114 is formed to extend through the engine mount portion 112 in a thickness direction (a direction of a thickness of a wall) of the engine mount portion 112 at a location, which is radially outward of the cylinder holding portion 111 and is radially inward of the fitting portion 113. In the present embodiment, the number of the fuel passages 114 is two, and these fuel passages 114 are arranged one after another at equal intervals. Furthermore, an O-ring groove 115 is formed in an outer peripheral wall (outer wall) of the fitting portion 113. An O-ring (not show) is installed in the O-ring groove 115 to fluid-tightly seal a gap, which is formed between the fitting portion 113 and an engine (not shown). The lower housing 11 may correspond to a part of a housing (also referred to as a pump housing) of the present invention.

The cylinder 13 is configured into a bottomed cylindrical tubular form (a cylindrical cup form, i.e., a cylindrical tubular form having a bottom at one end and an opening at the other end), which opens on an engine mount portion 112 side of the cylinder holding portion 111. The bottomed cylindrical tubular form of the cylinder 13 may be simply referred to as a bottomed tubular form. An inner peripheral wall (inner wall) 132*a* of a tubular portion 132 of the cylinder 13 slidably holds, i.e., guides a plunger 51, and an outer peripheral wall (outer wall) 132*b* of the tubular portion 132 of the cylinder 13 contacts an inner peripheral wall (inner wall) 111*a* of the cylinder holding portion 111, which serves as an inner peripheral wall of a cylinder receiving hole 111*c* of the cylinder holding portion 111. Furthermore, an annular projection 12, which is configured into an annular form (ring form), radially outwardly projects from the outer peripheral wall 132*b* of the cylinder 13. An upper surface 121 of the projection 12, which is located on a bottom portion 131 side, contacts a lower surface 111*b* of the cylinder holding portion 111. In the state where the cylinder 13 (more specifically, the projection 12) axially contacts the lower housing 11, upward movement of the cylinder 13 is limited, and the cylinder 13 supports the lower housing 11. Specifically, the projection 12 functions as limiting means for limiting axially upward movement of the cylinder 13.

The cylinder 13 includes the pressurizing chamber 14. The pressurizing chamber 14 is formed by an upper end surface (also serves as a surface of a distal end outer wall) 515 of a large diameter portion 511 of the plunger 51 and the inner peripheral wall 132*a* and an inner bottom wall 131*c* of the cylinder 13. The upper end surface 515 of the large diameter portion 511 of the plunger 51 is inserted from an opening 133 (also referred to as an opening end indicated in FIG. 8) side of the cylinder 13. The pressurizing chamber 14 is a chamber, in which fuel is pressurized. In the present embodiment, an inner diameter of the pressurizing chamber 14 is set to be larger than an inner diameter of the cylinder 13. Furthermore, the cylinder 13 includes an intake hole 141 and a discharge hole 142. The intake hole 141 radially extends through a part of the tubular portion 132, which is located at a bottom portion 131 side, from the pressurizing chamber 14 toward the fuel intake arrangement 70. The discharge hole 142 radially extends through the part of the tubular portion 132, which is located at the bottom portion 131 side, from the pressurizing chamber 14 toward the fuel discharge relief arrangement 90. An inner diameter of the intake hole 141 increases toward a radially outer side of the intake hole 141. Also, an inner diameter of the discharge hole 142 increases toward a radially outer side of the discharge hole 142. The upper end surface 515 of the plunger 51 may correspond to a distal end of the plunger of the present invention.

Figure 10:
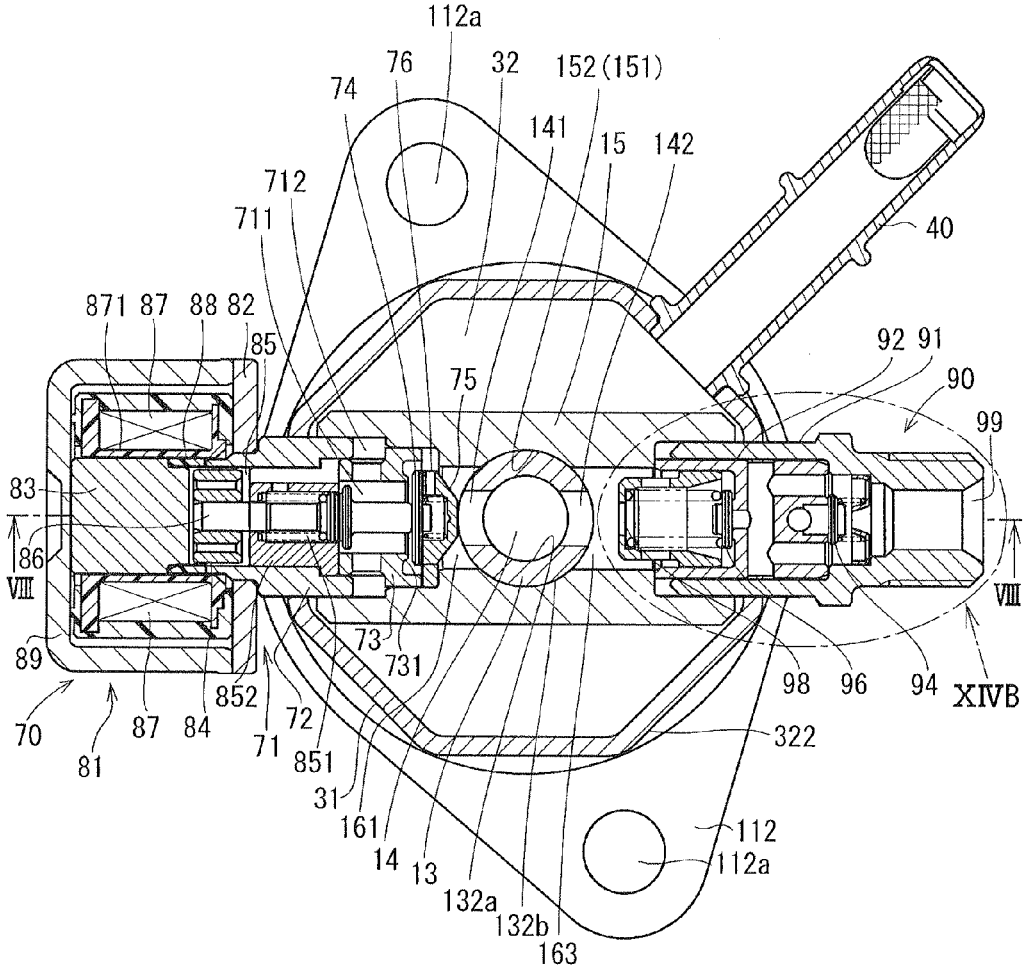
FIG. 10 is a cross-sectional view taken along line X-X in FIG. 8.

The upper housing 15 is configured into a rectangular parallelepiped form, which is elongated in a direction generally perpendicular to the axial direction of the cylinder 13, as shown in FIG. 10. The cylinder 13 is press fitted into a cylinder receiving chamber (also referred to as a cylinder receiving hole) 151 (FIG. 10) of the upper housing 15, which is located at a longitudinal center part of the upper housing 15, such that fuel, which is pressurized in the pressurizing chamber 14, does not leak outward through a connection between the outer peripheral wall 132*b* of the tubular portion 132 of the cylinder 13 and a cylinder receiving surface 152 of the cylinder receiving chamber 151 as well as a connection between an outer peripheral wall (outer wall) 131*b* of the bottom portion 131 of the cylinder 13 and the cylinder receiving surface 152 of the cylinder receiving chamber 151. The outer peripheral wall 131*b* of the bottom portion 131 of the cylinder 13 is axially located between the inner bottom wall 131*c* and an outer bottom wall 131*d* of the bottom portion 131. The upper housing 15 may correspond to a part of the housing (also referred to as the pump housing) of the present invention.

The upper housing 15 includes a first intake passage 161 and a plurality of second intake passages 162. The first intake passage 161 is stepped and extends through a wall of the upper housing 15 in the longitudinal direction of the upper housing 15 toward a side of the intake hole 141, which is opposite from the pressurizing chamber 14. The second intake passages 162 radially extend through the upper housing 15 from the first intake passage 161 toward an outer wall of the upper housing 15. The fuel intake arrangement 70 is fixed to the first intake passage 161 by means of, for example, press-fitting.

The upper housing 15 further includes a first discharge passage 163. The first discharge passage 163 is stepped and extends through a wall of the upper housing 15 in the longitudinal direction of the upper housing 15 toward a side of the discharge hole 142, which is opposite from the pressurizing chamber 14. The fuel discharge relief arrangement 90 is securely press fitted to the first discharge passage 163.

Next, the fuel supplying arrangement 30 will be described.

The fuel supplying arrangement 30 includes a cover 31, a pulsation damper 33 and a fuel inlet 40.

Figure 9:
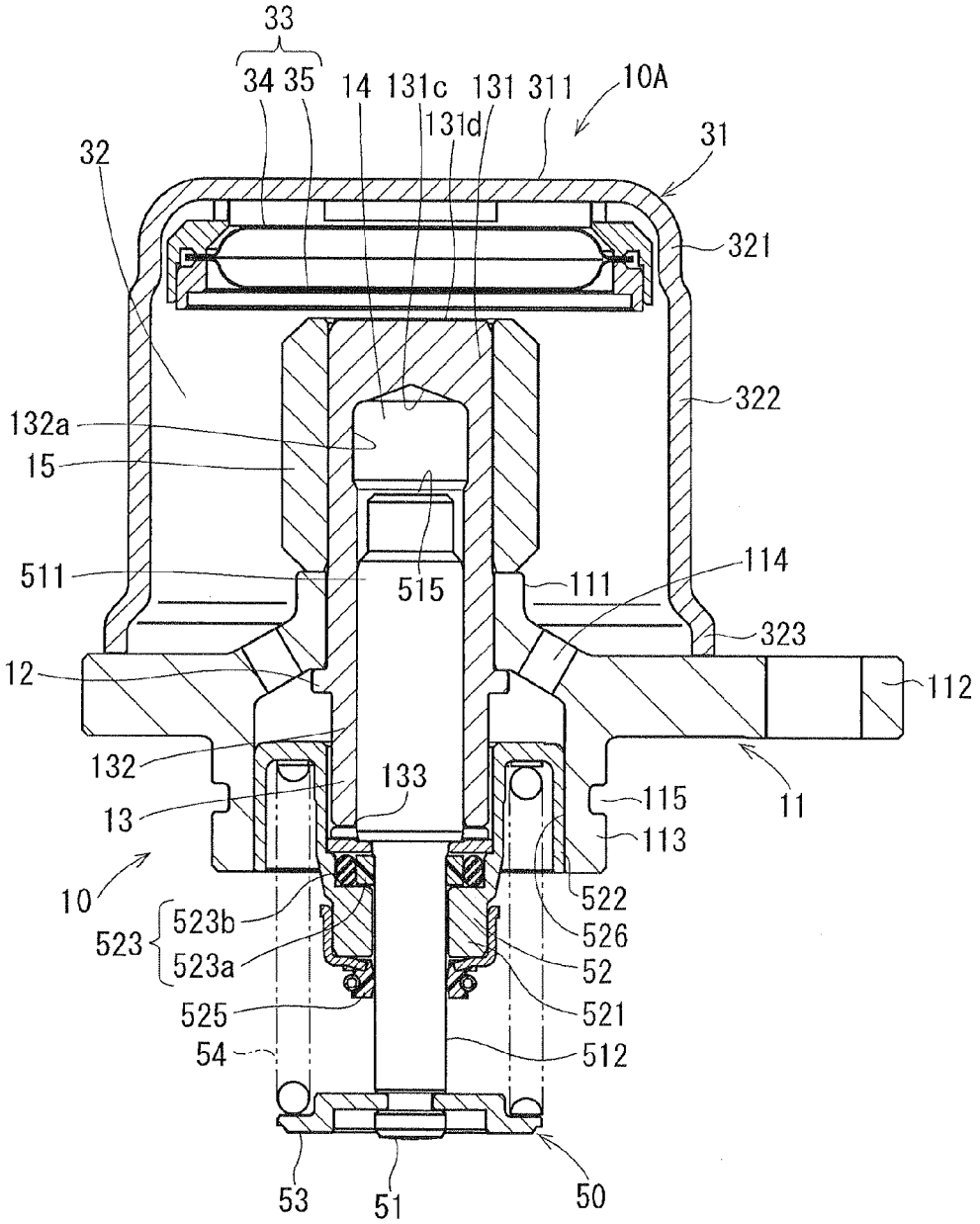
FIG. 9 is a cross-sectional view taken along line IX-IX in FIG. 8.
Figure 11:
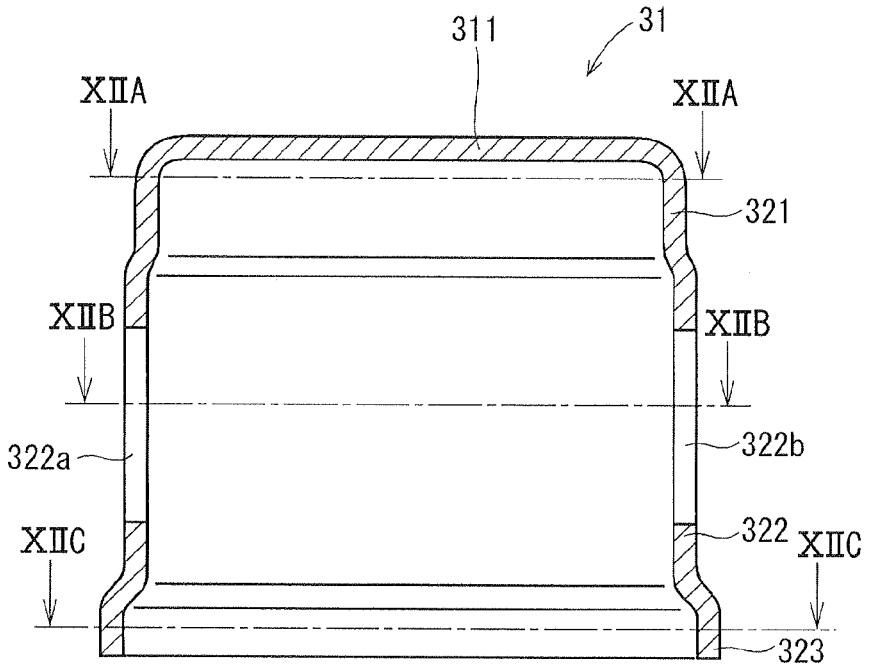
FIG. 11 is a cross-sectional view of a cover of the high pressure pump of the sixth embodiment.

As shown in FIG. 9, the cover 31 is configured into a bottomed cylindrical tubular form, which opens on an engine mount portion 112 side. The cover 31 receives the upper housing 15. As shown in FIG. 11, a peripheral wall of the cover 31 includes a first peripheral wall portion 321, a second peripheral wall portion 322 and a third peripheral wall portion 323. The first peripheral wall portion 321 is located adjacent to a bottom portion 311 of the cover 31 and is connected to an outer peripheral edge of the bottom portion 311. The third peripheral wall portion 323 forms a portion of the peripheral wall of the cover 31 at a side where the engine mount portion 112 is located. The second peripheral wall portion 322 is located on a side of the first peripheral wall portion 321, which is opposite from the bottom portion 311. The second peripheral wall portion 322 is interposed between the first peripheral wall portion 321 and the third peripheral wall portion 323 to connect therebetween. FIGS. 12A to 12C show cross-sectional views of the peripheral wall of the cover 31, which are taken along line XIIA-XIIA, line XIIB-XIIB and line XIIC-XIIC, respectively, in FIG. 11 in a direction perpendicular to the axial direction of the cylinder 13. The first peripheral wall portion 321 (FIG. 12A) is configured into a generally circular shape, and the third peripheral wall portion 323 (FIG. 12C) is also configured into a generally circular shape. An inner diameter of the third peripheral wall portion 323 is larger than an inner diameter of the first peripheral wall portion 321. The second peripheral wall portion 322 is configured into a generally octagon shape, as shown in FIG. 12B. A first through-hole 322*a* is formed to extend through the second peripheral wall portion 322 on a side of the first intake passage 161, which is opposite from the pressurizing chamber 14. The fuel intake arrangement 70 is inserted through the first through-hole 322*a*. Furthermore, a second through-hole 322*b* is formed to extend through the second peripheral wall portion 322 on a side of the first discharge passage 163, which is opposite from the pressurizing chamber 14, and also on side opposite from the first through-hole 322*a*. The fuel discharge relief arrangement 90 is inserted through the second through-hole 322*b*. Furthermore, a third through-hole 322*c* is formed to extend through the second peripheral wall portion 322 in a surface section of the second peripheral wall portion 322, which is different from surface sections of the second peripheral wall portion 322, in which the first through-hole 322*a* and the second through-hole 322*b* are respectively formed. The third through-hole 322*c* receives the fuel inlet 40, through which fuel is externally supplied to a fuel gallery 32, which is formed in the cover 31.

The cover 31 is joined to the engine mount portion 112 through, for example, welding, such that a gap between the engine mount portion 112 and an end part of the third peripheral wall portion 323 located on the engine mount portion 112 side is fluid-tightly sealed. Furthermore, the cover 31 is joined to the intake valve body 72 and the fuel discharge relief housing 91 through, for example, welding such that a gap between the first through-hole 322*a* and the fuel intake arrangement 70 inserted therein and a gap between the second through-hole 332*b* and the fuel discharge relief arrangement 90 inserted therein are fluid-tightly sealed.

As shown in FIGS. 9 and 10, the fuel gallery 32 is formed by an inner wall of the cover 31, a side wall (upper wall) of the engine mount portion 112 located on a cover 31 side and an outer wall of the upper housing 15. The fuel gallery 32 is communicated with the second intake passages 162 and is communicatable with the pressurizing chamber 14 through the second intake passage 162 and the first intake passage 161. A pulsation damper 33 is received and fixed to an inner side of the bottom portion 311 of the cover 31. The pulsation damper 33 reduces, i.e., damps a pressure pulsation of fuel in the fuel gallery 32. The cover 31 functions as a receiving member of the pulsation damper 33.

The pulsation damper 33 includes two diaphragms 34, 35, which are joined together along outer peripheral edges thereof. A gas of a predetermined pressure is sealed in an inside space of the pulsation damper 33, which is formed between the diaphragms 34, 35. The pulsation damper 33 reduces the pressure pulsation when the diaphragms 34, 35 are resiliently deformed in response to a change in a fuel pressure in the fuel gallery 32. As shown in FIG. 13, a plurality of fuel passages 331 is formed between the pulsation damper 33 and the cover 31. When fuel in the fuel gallery 32 is outputted to an upper side of the pulsation damper 33 through the fuel passages 331, the pressure pulsation of the fuel is reduced.

A lower end of a cover side support member 36 contacts an outer peripheral edge portion of the pulsation damper 33 from the bottom portion 311 side of the cover 31. An upper end of a fuel gallery side support member 37 contacts the outer peripheral edge portion of the pulsation damper 33 from the upper housing 15 side. In this way, the cover side support member 36 and the fuel gallery side support member 37 clamp the pulsation damper 33 from the upper side and the lower side of the pulsation damper 33.

Next, the plunger arrangement 50 will be described.

The plunger arrangement 50 includes the plunger 51, an oil seal holder 52, a spring seat 53 and a plunger spring 54.

The plunger 51 is placed to oppose the bottom portion 131 of the cylinder 13 such that the pressurizing chamber 14 is interposed between the plunger 51 and the bottom portion 131 of the cylinder 13. The plunger 51 is a solid cylindrical member, which is axially reciprocatable in the inside of the cylinder 13. The plunger 51 includes the large diameter portion 511 and a small diameter portion 512, which are formed integrally. The large diameter portion 511 has a relatively large outer diameter, and the small diameter portion 512 has a relatively small outer diameter that is smaller than that of the large diameter portion 511. The large diameter portion 511, which is formed on the pressurizing chamber 14 side, slides along the inner peripheral wall (inner wall) 132*a* of the cylinder 13. The small diameter portion 512, which is formed on the side opposite from the pressurizing chamber 14 in the axial direction, is inserted into the oil seal holder 52.

The oil seal holder 52 is placed at the end portion of the cylinder 13 and includes a base portion 521 and a press-fitting portion 522. The base portion 521 is located on a radially outer side of the small diameter portion 512 of the plunger 51. The press-fitting portion 522 is press fitted to an inner peripheral wall (inner wall) of the fitting portion 113 of the lower housing 11.

The base portion 521 includes a seal 523, which is configured into a ring shape and is placed in an inside of the base portion 521. The seal 523 includes a Teflon ring (Teflon is a registered trademark and brand name of the DuPont company) 523*a* and an O-ring 523*b*. The ring 523*a* is placed on a radially inner side. The O-ring 523*b* is placed on a radially outer side of the ring 523*a*. The seal 523 adjusts a thickness of a fuel oil film around the small diameter portion 512 of the plunger 51 and thereby limits leakage of fuel toward the engine. Furthermore, the base portion 521 includes an oil seal 525 at a distal end part of the base portion 521. The oil seal 525 limits a thickness of an oil film around the small diameter portion 512 of the plunger 51 and thereby limits leakage of the oil.

The press-fitting portion 522 is a cylindrical tubular portion, which is located around the base portion 521 on a radially outer side thereof and has a U-shaped longitudinal cross section. A recess 526, which corresponds to the press-fitting portion 522, is formed in the lower housing 11. The oil seal holder 52 is press fitted such that the press-fitting portion 522 is urged against the inner peripheral wall (inner wall) of the recess 526 located on a radially outer side of the press-fitting portion 522.

The spring seat 53 is placed at an end portion (lower end portion in FIG. 8) of the plunger 51. The end portion of the plunger 51 contacts a tappet (not shown). The tappet contacts an outer peripheral surface of a cam, which is installed to a camshaft (not shown). When the camshaft is rotated, the tappet is axially reciprocated according to a cam profile of the cam.

One end of the plunger spring 54 is engaged to the spring seat 53, and the other end of the plunger spring 54 is engaged to a depth part of the press-fitting portion 522 of the oil seal holder 52. In this way, the plunger spring 54 functions as a return spring of the plunger 51 and thereby urges the plunger 51 against the tappet.

With the above construction, the plunger 51 is reciprocated in response to the rotation of the camshaft. At this time, a volume of the pressurizing chamber 14 is changed through the movement of the large diameter portion 511 of the plunger 51.

Next, the fuel intake arrangement 70 will be described.

The fuel intake arrangement 70 includes an intake valve arrangement 71 and an electromagnetic drive arrangement 81.

The intake valve arrangement 71 includes an intake valve body 72, a seat body 73, an intake valve member (also simply referred to as an intake valve) 74, a first spring holder 75 and a first spring 76.

The intake valve body 72 is connected to the upper housing 15 by, for example, securely press-fitting the intake valve body 72 into the first intake passage 161. The intake valve body 72 has an intake chamber 711 in an inside of the intake valve body 72. The intake chamber 711 is communicated with the fuel gallery 32 through the intake passage 712. The seat body 73, which is configured into a generally cylindrical tubular form, is placed in the intake chamber 711. A valve seat 731 is formed in the seat body 73 on a pressurizing chamber 14 side and is engageable with the intake valve member 74.

The intake valve member 74 is placed on the pressurizing chamber 14 side of the seat body 73. The intake valve member 74 reciprocates in the intake chamber 711. When the intake valve member 74 is lifted away from the valve seat 731, the intake chamber 711 and the pressurizing chamber 14 are communicated with each other. When the intake valve member 74 is seated against the valve seat 731, the intake chamber 711 is discommunicated from the pressurizing chamber 14.

The first spring holder 75 is fixed to the fuel intake arrangement 70 on the pressurizing chamber 14 side. The first spring holder 75 limits movement of the intake valve member 74 in a valve opening direction thereof (the right direction in FIG. 8). The first spring 76 is placed between an inside of the first spring holder 75 and an end surface of the intake valve member 74. The first spring 76 urges the intake valve member 74 in a valve closing direction thereof (the left direction in FIG. 8).

The electromagnetic drive arrangement 81 includes a flange 82, a stationary core 83 and a movable core 84.

The flange 82 is installed on a radially outer side of the intake valve body 72. A movable core chamber 85, which is configured into a generally cylindrical tubular form, is provided in the inside of the intake valve body 72, to which the flange 82 is installed.

The movable core 84, which is configured into a generally cylindrical tubular form, is axially reciprocatably received in the movable core chamber 85. A needle 86 is connected to the movable core 84. The needle 86 is reciprocatably supported by a second spring holder 852, which is fixed to an inner peripheral wall (inner wall) of the intake valve body 72. One end portion of the needle 86 is fixed to the movable core 84, and the other end portion of the needle 86 is contactable with an end surface of the intake valve member 74. The second spring holder 852 includes a second spring 851. One end of the second spring 851 contacts an axial wall surface of the second spring holder 852, and the other end of the second spring 851 contacts a wall surface of the needle 86, which is located on a side of a step portion 861 of the needle 86, which is opposite from the pressurizing chamber 14. The second spring 851 exerts an urging force, which is larger than the urging force of the first spring 76 in the valve closing direction of the intake valve member 74, to urge the movable core 84 in the valve opening direction of the intake valve member 74.

The stationary core 83 is provided at a location, which is on a radially inner side of a coil 87 and is on a side of the movable core 84, which is opposite from the intake valve member 74. A tubular member 88, which is made of a non-magnetic material, is provided between the stationary core 83 and the intake valve body 72. The tubular member 88 limits short circuit of a magnetic flux between the stationary core 83 and the intake valve body 72 and increases the amount of the magnetic flux, which flows through a magnetic gap between the movable core 84 and the stationary core 83.

A bobbin 871, which is made of a resin material, is provided on a radially outer side of the stationary core 83. The coil 87 is wound around the bobbin 871. A case 89, which is configured into a tubular form, covers a radially outer side of the coil 87 to form a magnetic circuit in cooperation with the stationary core 83, the movable core 84 and the flange 82. A connector 891 projects outward in a radially outward direction of the case 89. When the coil 87 is energized upon receiving an electric current through terminals 892 of the connector 891, the coil 87 generates a magnetic field.

When the coil 87 is not energized, the movable core 84 and the stationary core 83 are spaced from each other by a resilient force of the second spring 851. Thereby, the needle 86, which is integrated with the movable core 84, is moved toward the pressurizing chamber 14 side, so that the end surface of the needle 86 urges the intake valve member 74 to open the intake valve member 74.

When the coil 87 is energized, the magnetic flux is generated and flows through the magnetic circuit made of the stationary core 83, the movable core 84, the flange 82 and the case 89. Thereby, the movable core 84 is magnetically attracted toward the stationary core 83 against the resilient force of the second spring 851. In this way, the needle 86 releases the urging force against the intake valve member 74.

Next, the fuel discharge relief arrangement 90 will be described with reference to FIGS. 14A and 14B. FIG. 14A is an enlarged cross-sectional view of an area XIVA in FIG. 8 indicating the fuel discharge relief arrangement 90 shown in the cross-sectional view of the high pressure pump 10A of FIG. 8. FIG. 14B is an enlarged cross-sectional view of an area XIVB in FIG. 10 indicating the fuel discharge relief arrangement 90 shown in the cross-sectional view of the high pressure pump 10A of FIG. 10.

The fuel discharge relief arrangement 90 includes the fuel discharge relief housing 91, a valve body 92, the discharge valve 93 and a relief valve 95.

The fuel discharge relief housing 91 is configured into a generally cylindrical tubular form and receives the valve body 92, the discharge valve 93 and the relief valve 95. The fuel discharge relief housing 91 is fixed to the first discharge passage 163, which is formed in the upper housing 15, by means of, for example, press-fitting. A fuel inlet 98 is formed in the fuel discharge relief housing 91 at the first discharge passage 163 side of the fuel discharge relief housing 91 to receive the fuel, which is pressurized in the pressurizing chamber 14. A fuel discharge outlet 99 is formed in the fuel discharge relief housing 91 at a side, which is opposite from the first discharge passage 163.

The valve body 92 is inserted into and is positioned in the fuel discharge relief housing 91 on the pressurizing chamber 14 side. The valve body 92 is configured into a bottomed tubular form. The bottom portion 923 of the valve body 92 is located on a fuel discharge outlet 99 side, and an opening of the valve body 92 is located on a pressurizing chamber 14 side. A relief valve outlet 953 and a plurality of discharge valve inlets 931, 932 are formed in the bottom portion 923 of the valve body 92 at an end surface 921 of the bottom portion 923 located on the pressurizing chamber 14 side. The relief valve outlet 953 is formed along a central axis of the valve body 92. The discharge valve inlets 931, 932 are formed on a radially outer side of the central axis of the valve body 92 and are arranged one after another at generally equal intervals in a circumferential direction about the central axis of the valve body 92. A discharge valve outlet 933 and a plurality of relief valve inlets 951, 952 are formed in the bottom portion 923 of the valve body 92 at an end surface 922 of the bottom portion 923 located on the fuel discharge outlet 99 side. The discharge valve outlet 933 is formed along the central axis of the valve body 92. The relief valve inlets 951, 952 are formed on the radially outer side of the central axis of the valve body 92 and are arranged one after another at generally equal intervals in the circumferential direction about the central axis of the valve body 92.

The discharge valve inlets 931, 932 are communicated with the discharge valve outlets 933 through a first discharge valve passage 935 and a plurality of second discharge valve passages 936, 937, which are formed in the bottom portion 923 of the valve body 92. The first discharge valve passage 935 extends in a direction generally perpendicular to the central axis of the valve body 92. The second discharge valve passages 936, 937 extend generally in parallel with the central axis of the valve body 92 and are placed at a location radially outwardly displaced from the central axis of the valve body 92. The first discharge valve passage 935 and the second discharge valve passages 936, 937 are formed in the valve body 92 by a drilling process.

The relief valve outlet 953 is communicated with the relief valve inlets 951, 952 through a first relief valve passage 955 and second relief valve passages 956, 957, which are formed in the bottom portion 923 of the valve body 92. The first relief valve passage 955 extends in a direction generally perpendicular to the central axis of the valve body 92. The second relief valve passages 956, 957 extend generally in parallel with the central axis of the valve body 92 and are placed at a location radially outwardly displaced from the central axis of the valve body 92. The first relief valve passage 955 and the second relief valve passages 956, 957 are formed in the valve body 92 by a drilling process.

The first discharge valve passage 935 is located on the fuel discharge outlet 99 side of the first relief valve passage 955. The first discharge valve passage 935 and the first relief valve passage 955 are displaced from each other in the circumferential direction of the valve body 92 and are thereby skewed relative to each other.

The discharge valve 93 is placed adjacent to the fuel discharge outlet 99 in the inside of the fuel discharge relief housing 91. The discharge valve 93 includes a discharge valve member (also simply referred to as a discharge valve) 94, a discharge valve spring 943 and a discharge valve spring holder 945.

The discharge valve member 94 is configured into a generally planar form and is placed to contact the end surface 922 of the valve body 92, at which the discharge valve outlet 933 is formed. Specifically, the opening of the valve body 92, which forms the discharge valve outlet 933, forms a discharge valve seat 947 for the discharge valve member 94. One end of the discharge valve spring 943 contacts the discharge valve member 94 on a side, which is opposite from the end surface 922 of the valve body 92. The other end of the discharge valve spring 943 contacts the discharge valve spring holder 945, which contacts the inner wall of the fuel discharge relief housing 91. The discharge valve spring 943 exerts an urging force, which urges the discharge valve member 94 from the fuel discharge outlet 99 side toward the pressurizing chamber 14 side. Specifically, the discharge valve spring 943 urges the discharge valve member 94 in the valve closing direction of the discharge valve member 94 for closing the discharge valve outlet 933. The discharge valve spring holder 945 is configured into a cylindrical tubular form having a U-shaped cross section. A plurality of openings is formed in the discharge valve spring holder 945 such that the openings do not disturb or interfere with a flow of fuel from the pressurizing chamber 14 side toward the fuel discharge outlet 99 side or from the fuel discharge outlet 99 side toward the pressurizing chamber 14 side.

The discharge valve member 94 is seated against the discharge valve seat 947 to close the opening of the discharge valve seat 974 (the discharge valve outlet 933) when a first receiving pressure, which is exerted against the surface 941 of the discharge valve member 94 located on the pressurizing chamber 14 side, is equal to or smaller than a discharge valve closing force that is a sum of a force of a pressure of fuel exerted on the surface 942 of the discharge valve member 94 at the fuel discharge outlet 99 side and the urging force of the discharge valve spring 943. In contrast, the discharge valve member 94 is lifted away from the discharge valve seat 947 to open the opening of discharge valve seat 947 (the discharge valve outlet 933) when the first receiving pressure becomes larger than the discharge valve closing force. In this way, fuel, which is supplied from the pressurizing chamber 14 into the fuel discharge relief arrangement 90, is discharged from the fuel discharge outlet 99 through the second discharge valve passages 936, 937 and the first discharge valve passage 935.

The relief valve 95 is placed at the pressurizing chamber 14 side part of the valve body 92. The relief valve 95 includes a relief valve member 96, a relief valve spring 963 and a relief valve spring holder 965. The relief valve member 96 is configured into a generally planar form.

The relief valve member 96 is placed to contact the end surface 921 of the valve body 92, which forms the relief valve outlet 953. Specifically, the opening of the valve body 92, which forms the relief valve outlet 953, forms a relief valve seat 967. One end of the relief valve spring 963 contacts the relief valve member 96 on a side opposite from the end surface 921. The relief valve spring holder 965 is configured into a bottomed tubular form (cup form) and is securely press fitted into the valve body 92. The other end of the relief valve spring 963 contacts the bottom portion of the relief valve spring holder 965. The relief valve spring 963 exerts an urging force, which urges the relief valve member 96 from the pressurizing chamber 14 side toward the fuel discharge outlet 99 side. Specifically, the relief valve spring 963 urges the relief valve member 96 in the closing direction of the relief valve member 96 for closing the relief valve outlet 953. The relief valve spring holder 965, which is configured into the bottomed tubular form, has the tubular portion and the bottom portion, in which a plurality of openings is formed to conduct fuel from the pressurizing chamber 14 side toward the fuel discharge outlet 99 side or from the fuel discharge outlet 99 side toward the pressurizing chamber 14 side. The urging force of the relief valve spring 963 is set such that the urging force of the relief valve spring 963 is larger than the urging force of the discharge valve spring 943. Furthermore, the relief valve member 96 and the discharge valve member 94 are arranged in series, i.e., are arranged one after another in the axial direction of the valve body 92.

At the relief valve 95, the relief valve member 96 is seated against the relief valve seat 967 to close the opening of the relief valve seat 967 (the relief valve outlet 953) when a third receiving pressure, which is exerted against a surface 961 of the relief valve member 96 located on the fuel discharge outlet 99 side, is equal to or smaller than a relief valve closing force that is a sum of a force of a pressure of fuel exerted on a surface 962 of the relief valve member 96 at the pressurizing chamber 14 side and the urging force of the relief valve spring 963. In contrast, the relief valve member 96 is lifted away from the relief valve seat 967 to open the opening of the relief valve seat 967 (the relief valve outlet 953) when the third receiving pressure becomes larger than the relief valve closing force. In this way, fuel, which is supplied from the fuel discharge outlet 99 side into the fuel discharge relief arrangement 90, is returned to the pressurizing chamber 14 through the second relief valve passages 956, 957 and the first relief valve passage 955.

Next, a manufacturing method of the high pressure pump 10A of the sixth embodiment will be described with reference to FIGS. 15 to 24.

Figure 15:
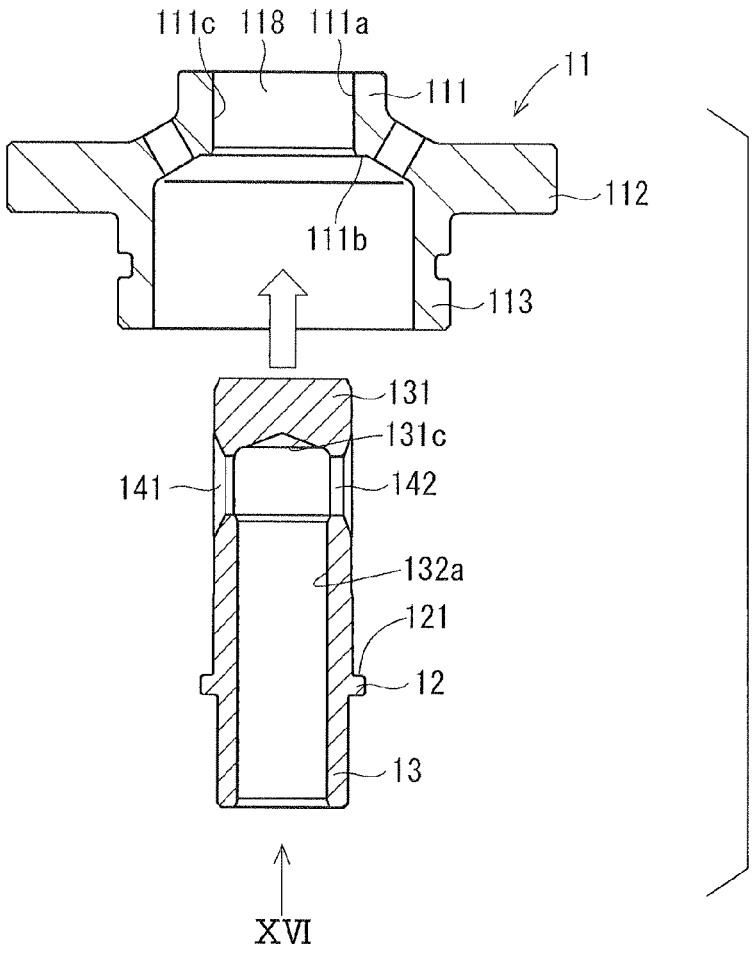
FIG. 15 is a schematic cross-sectional view indicating a cylinder and a lower housing of the high pressure pump of the sixth embodiment for describing a manufacturing operation of the high pressure pump.
Figure 16A:
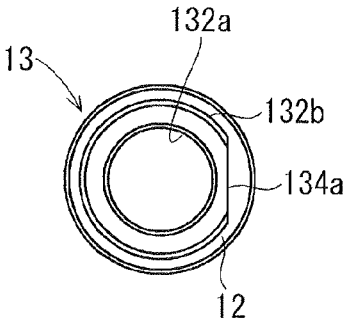
FIGS. 16A and 16B are bottom views of a cylinder of the high pressure pump of the sixth embodiment taken in a direction of an arrow XVI in FIG. 15.
Figure 16B:
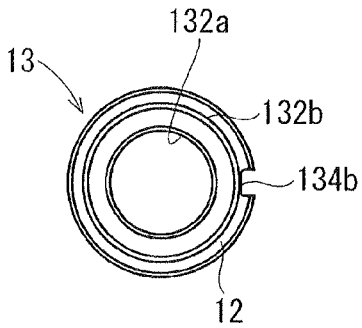
Figure 17:
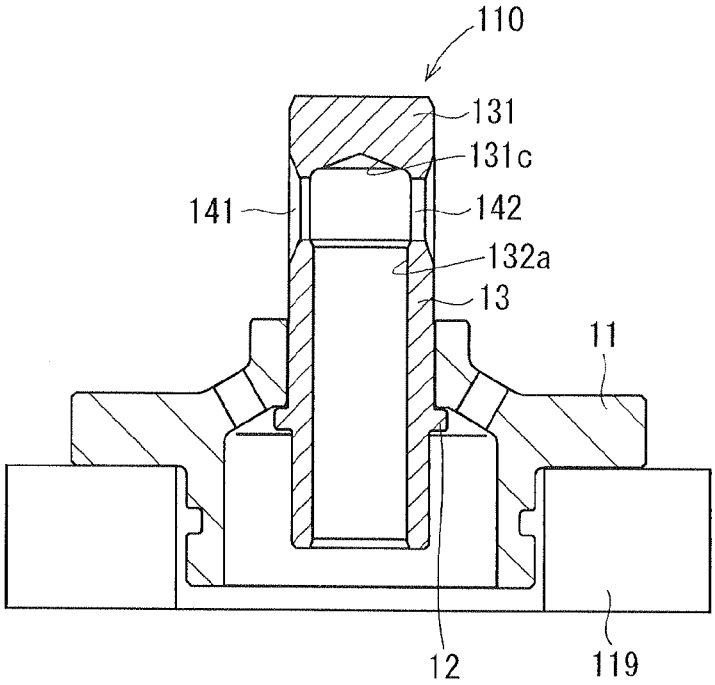
FIG. 17 is a schematic diagram showing a different state in the manufacturing operation of the high pressure pump of the sixth embodiment, which is different from that of FIG. 15.

As shown in FIG. 15, the cylinder 13 is inserted into the lower housing 11 to form a cylinder subassembly 110. This process will be referred to as a first cylinder subassembly forming process. More specifically, a cylinder receiving hole 118 is formed in the cylinder holding portion 111 of the lower housing 11. The cylinder 13 is inserted into the cylinder receiving hole 118 from a lower side of the lower housing 11. In this instance, it is desirable to form positioning portions 134*a*, 134*b*, which are shown in FIGS. 16A and 16B, in the cylinder 13 to enable relative positioning (alignment) between the mount holes 112*a* (see FIG. 10) of the engine mount portion 112 of the lower housing 11 and the intake hole 141 and the discharge hole 142 of the tubular portion 132 of the cylinder 13 at the time of assembling. Furthermore, in a case where the upper housing 15 and the cover 31 are installed to the cylinder subassembly 110 in a later process, the lower housing 11 may be fixed to a jig 119 shown in FIG. 17 to install the cylinder 13 to the lower housing 11 in the first cylinder subassembly forming process to enable the relative positioning (aligning) of the intake hole 141 and the discharge hole 142. In FIG. 17, the jig 119 is placed on the lower side of the lower housing 11. Alternatively, the jig 119 may be placed on an upper side of the lower housing 11. At this time, the lower housing 11 and the jig 119 are fixed relative to each other by the mount holes 112*a* of the engine mount portion 112. The relative position (alignment) of the intake hole 141 and the discharge hole 142 may be checked with a laser sensing device 300 (FIG. 18A) and/or an image processing device 400 (FIG. 18B) in order to check the relative position between the lower housing 11 and the cylinder 13 in the state where the lower housing 11 is fixed to the jig 119. Furthermore, in the case where the positions of the intake hole 141 and the discharge hole 142 are checked with the above-described device(s), the positioning portions may not be required in the cylinder.

Figure 19:
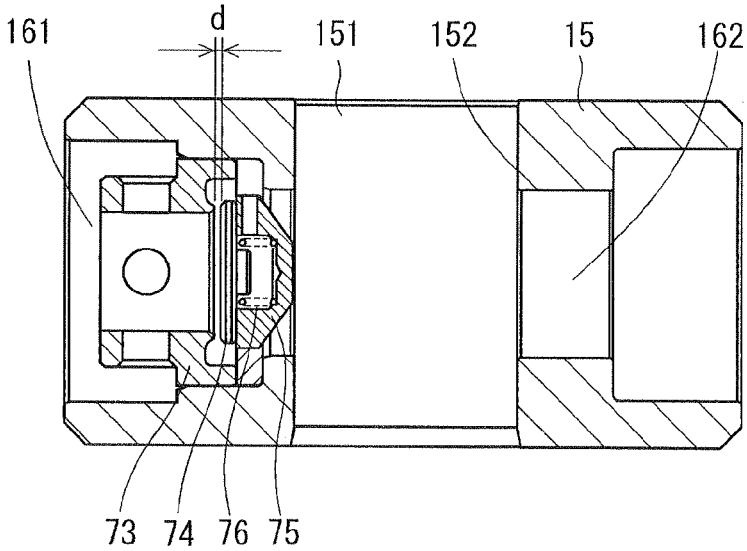
FIG. 19 is a schematic diagram, showing a state of the manufacturing operation of the high pressure pump of the sixth embodiment, in which an intake valve is installed to an upper housing.
Figure 18A:
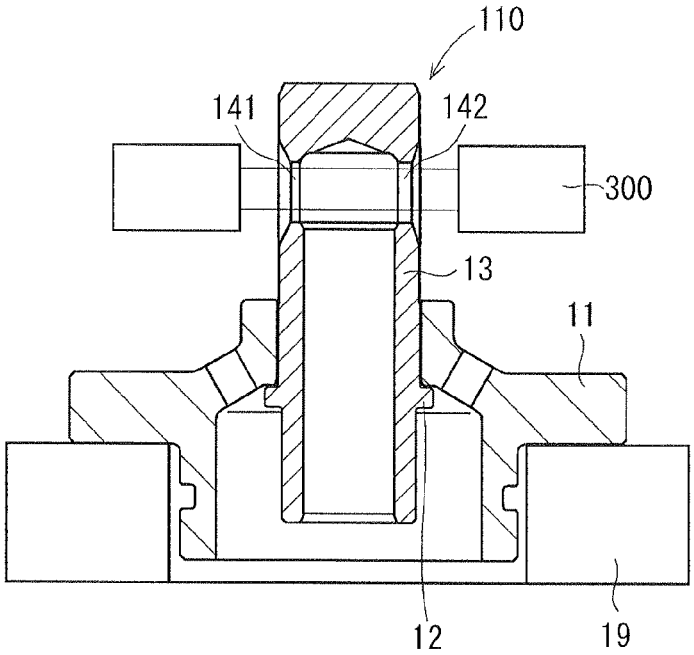
FIGS. 18A and 18B are schematic diagrams, each showing a different state in the manufacturing operation of the high pressure pump of the sixth embodiment, which is different from that of FIG. 17.
Figure 18B:
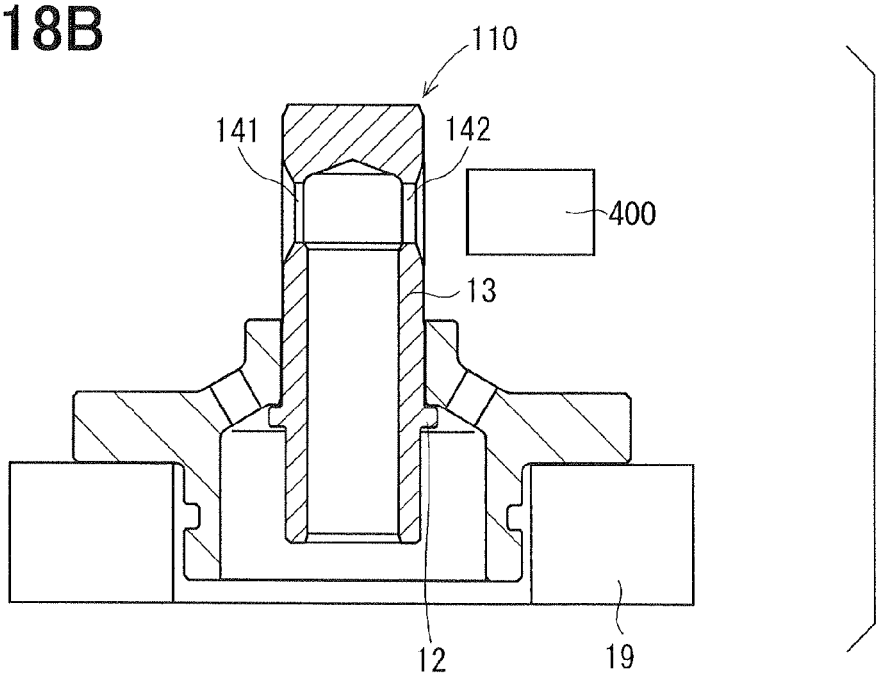

Next, as shown in FIG. 19, the first spring holder 75, the first spring 76, the intake valve member 74 and the seat body 73, which are the components of the intake valve arrangement 71, are installed to the upper housing 15. This process will be hereinafter referred to as an intake valve forming process. At this time, the seat body 73 is fixed to the upper housing 15 by, for example, press-fitting or bonding. Furthermore, since the amount d of lifting of the intake valve member 74 is determined by an insertion depth of the seat body 73, the seat body 73 is installed to the upper housing 15 to implement a predetermined amount of lifting of the intake valve member 74.

Figure 20A:
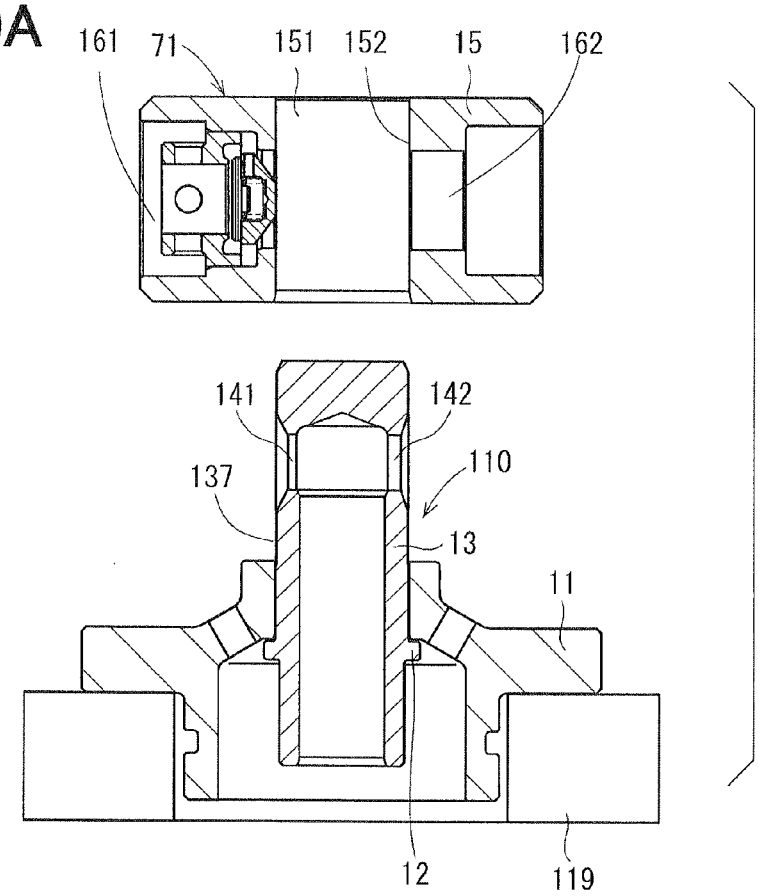
FIGS. 20A and 20B are schematic diagrams, showing further states in the manufacturing operation of the high pressure pump of the sixth embodiment, which are after the state of FIG. 19.
Figure 20B:
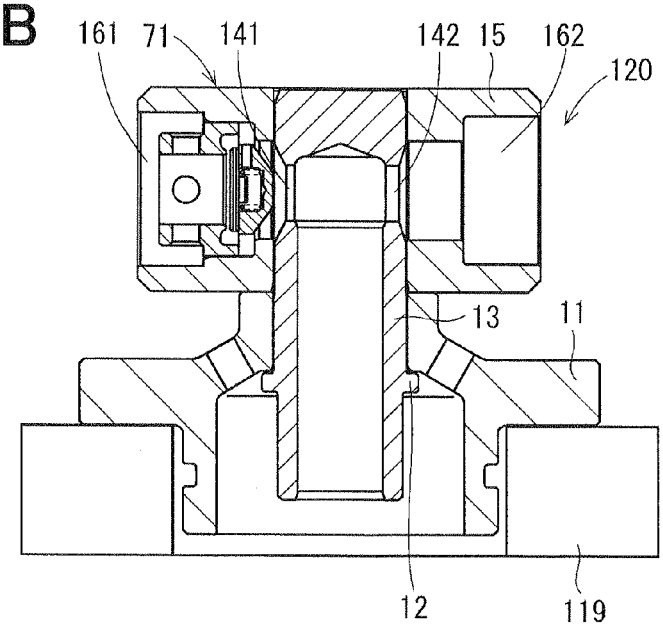

As shown in FIGS. 20A and 20B, the upper housing 15, to which the intake valve arrangement 71 is assembled, is then installed to the cylinder subassembly 110 to form a housing subassembly 120. This process will be hereinafter referred to as a housing subassembly forming process. Specifically, as shown in FIG. 20A, the upper housing 15, to which the intake valve arrangement 71 is assembled, is inserted into the cylinder subassembly 110, which is fixed to the jig 119, from the upper side of the cylinder subassembly 110. Here, the cylinder receiving surface 152 of the upper housing 15 is fixed to an upper housing receiving surface 137 of the cylinder 13 by, for example, press fit, shrink fit, cooling fit or bonding. Furthermore, in order to check the relative position (alignment) between the upper housing 15 and the cylinder 13, the positions of the intake hole 141 and the discharge hole 142 of the cylinder 13 may be checked with the laser sensing device 300 (FIG. 18A) and/or the image processing device 400 (FIG. 18B) in the state of FIG. 20B.

Figure 21:
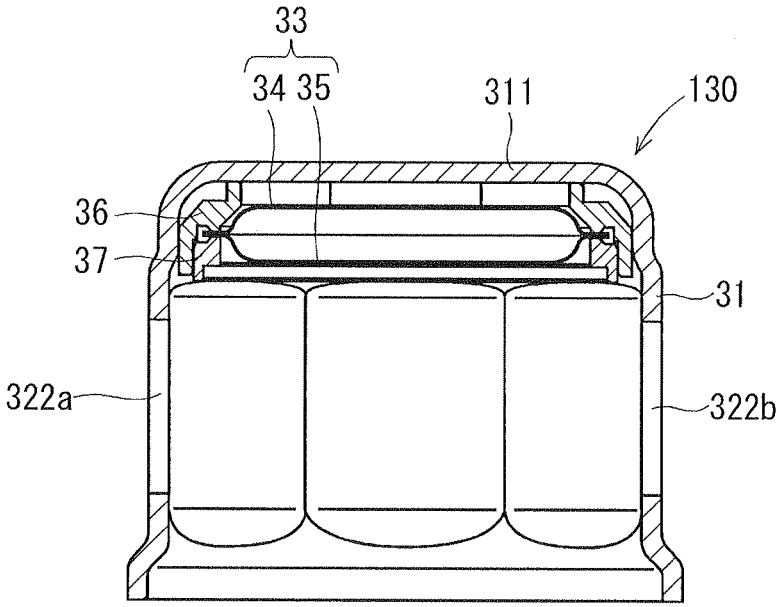
FIG. 21 is a schematic diagram, showing another state of the manufacturing operation of the high pressure pump of the sixth embodiment, in which a pulsation damper subassembly is installed to the cover.

Next, as shown in FIG. 21, a pulsation damper subassembly is installed to the cover 31 to form a cover subassembly 130. The pulsation damper subassembly includes the pulsation damper 33, the cover side support member 36 and the fuel gallery side support member 37. As discussed above, the pulsation damper 33 is made of the two diaphragms 34, 35. The cover side support member 36 and the fuel gallery side support member 37 support the diaphragms 34, 35. At the inside of the cover 31, the pulsation damper subassembly is installed to the bottom portion 311 by, for example, press fit, bonding or welding.

Figure 22A:
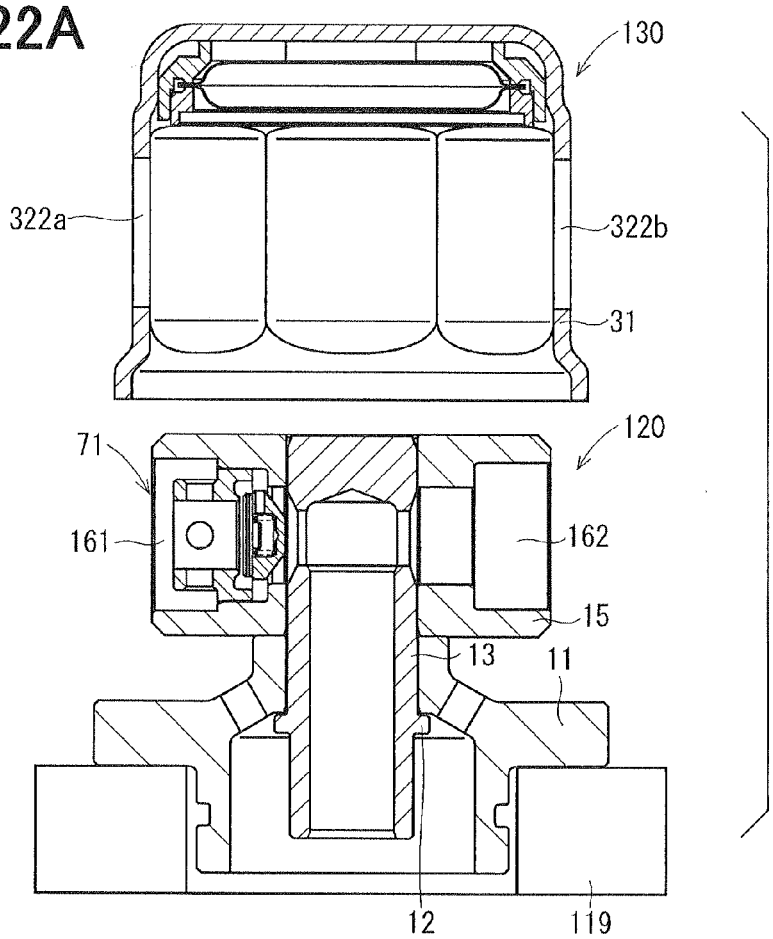
FIGS. 22A and 22B are schematic diagrams, showing further states in the manufacturing operation of the high pressure pump of the sixth embodiment, which are after the state of FIG. 21.
Figure 22B:
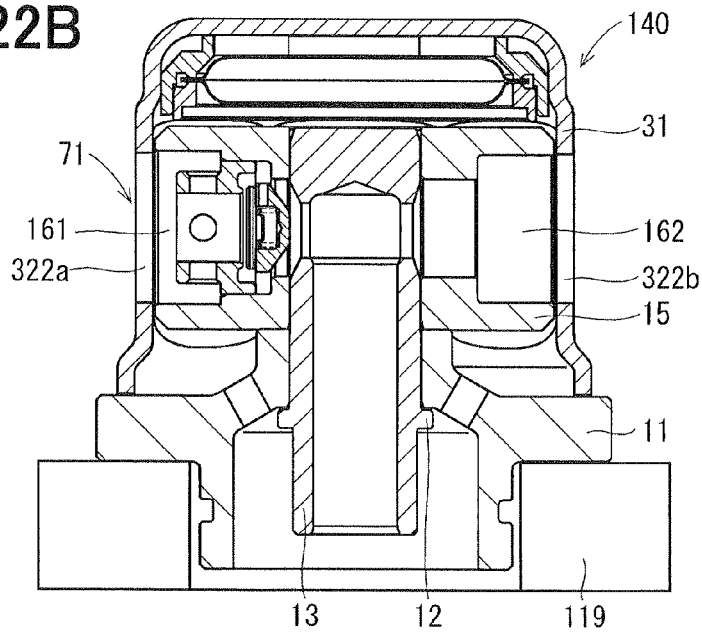

As shown in FIGS. 22A and 22B, the cover subassembly 130 is assembled to the housing subassembly 120 to form a head subassembly 140. This process will be hereinafter referred to as a head subassembly forming process. Specifically, as shown in FIG. 22A, the cover subassembly 130, which is placed in position, is installed to the housing subassembly 120, which is fixed to the jig 119, from the upper side of the housing subassembly 120. At this time, the first through-hole 322*a*, which is formed in the cover 31, is positioned (aligned) relative to the intake valve arrangement 71 of the upper housing 15.

Figure 23A:
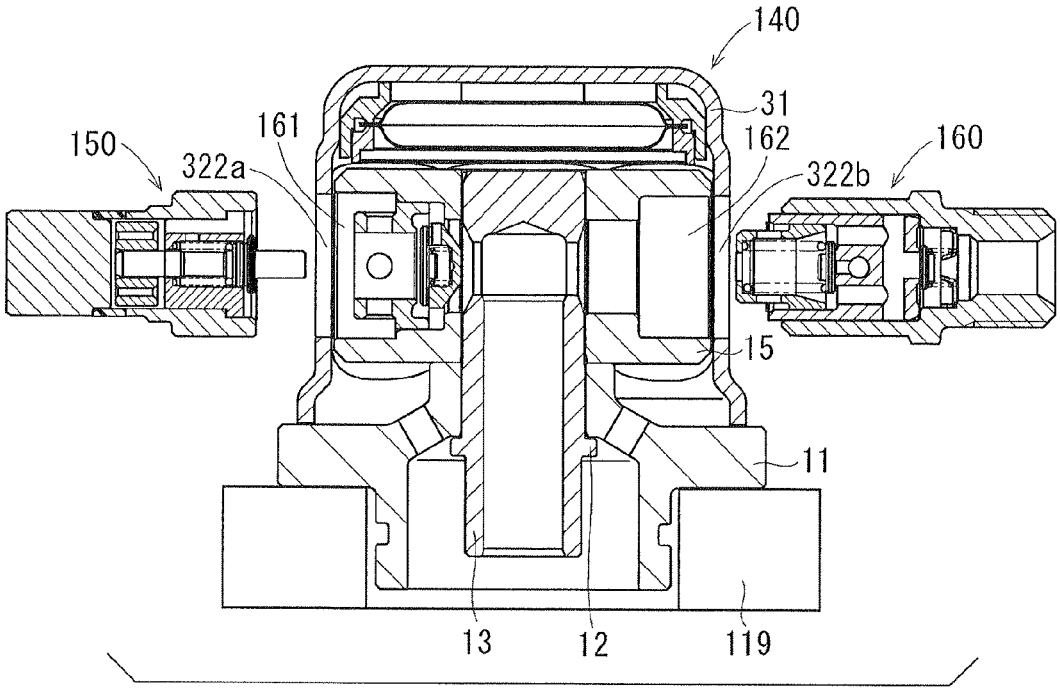
FIGS. 23A and 23B are schematic diagrams, showing further states in the manufacturing operation of the high pressure pump of the sixth embodiment, which are after the state of FIG. 22B.
Figure 23B:
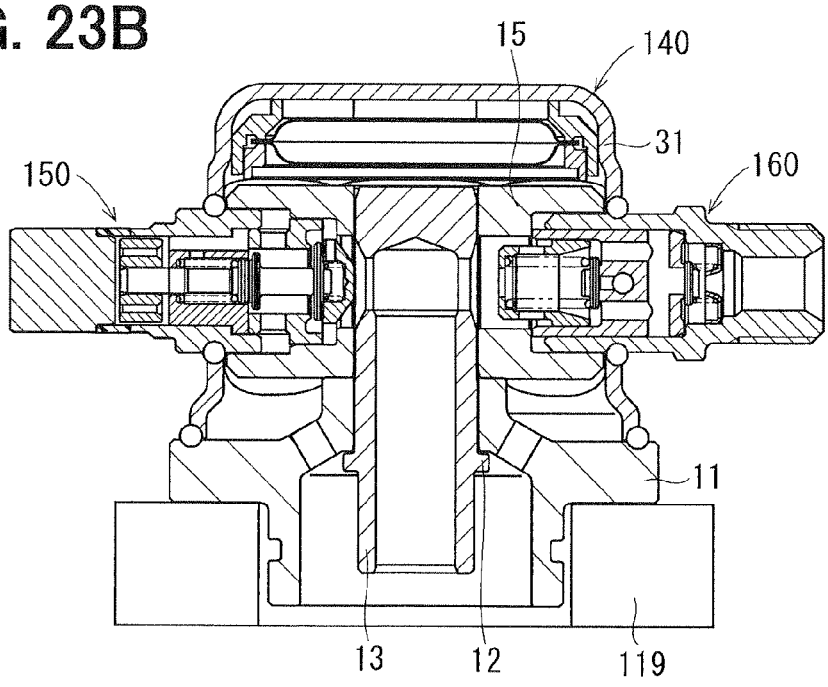

Next, as shown in FIGS. 23A and 23B, a needle subassembly 150 and a discharge relief subassembly 160 are installed to the head subassembly 140. Specifically, as shown in FIG. 23A, the needle subassembly 150 and the discharge relief subassembly 160 are installed to the upper housing 15, which is held in the head subassembly 140. At this time, the needle subassembly 150 and the discharge relief subassembly 160 are fixed to the upper housing 15 by, for example, press fit, cooling fit, bonding or welding. Thereafter, the cover subassembly 130 is joined to the needle subassembly 150, and the cover subassembly 130 is also joined to the discharge relief subassembly 160. Also, the cover subassembly 130 is joined to the lower housing 11. Thereby, the fluid tightness of the fuel gallery 32 in the cover 31 is maintained. The above joining process can be performed by, for example, welding, laser brazing, bonding or swaging.

Figure 24:
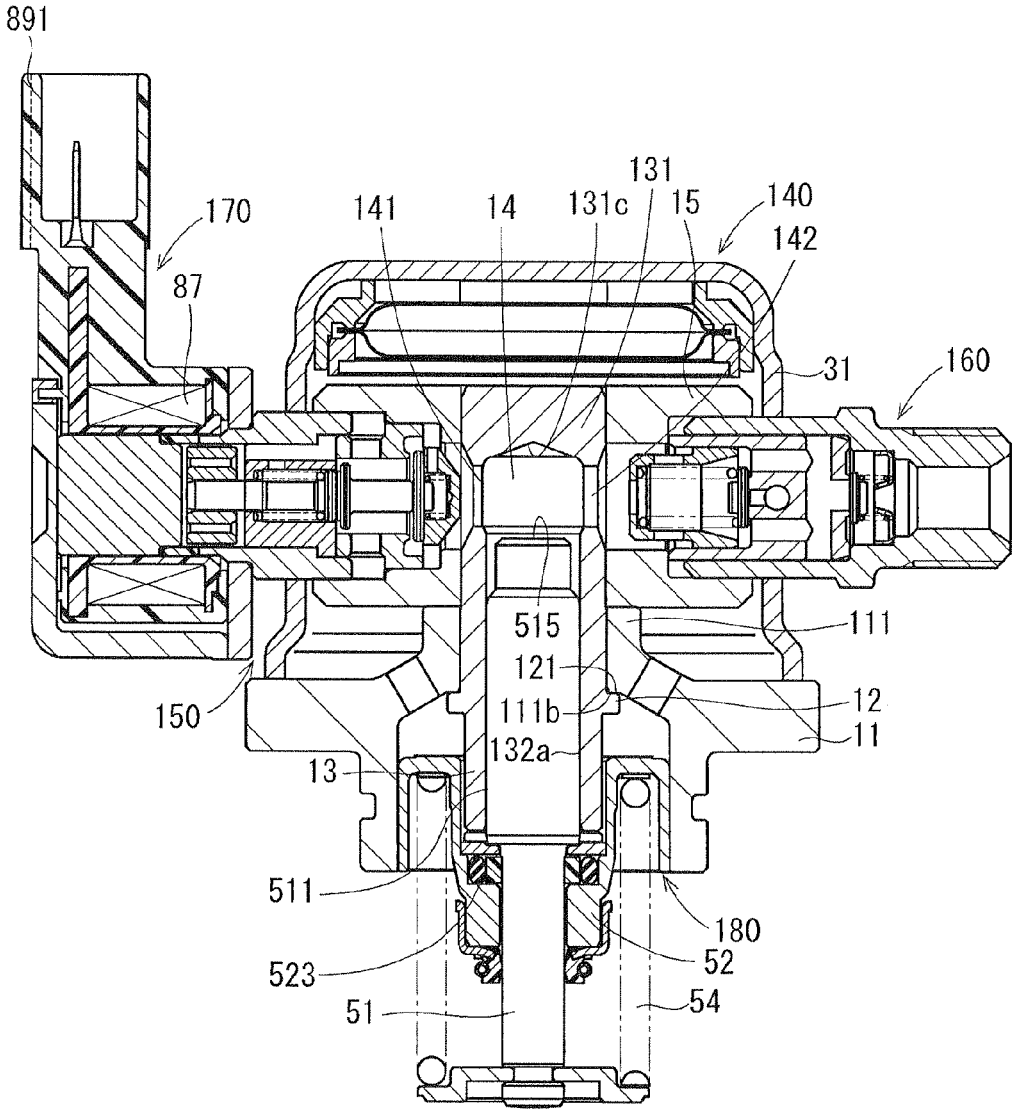
FIG. 24 is a schematic diagram, showing a further state in the manufacturing operation of the high pressure pump of the sixth embodiment, which is after the state of FIG. 23B.

Finally, as shown in FIG. 24, a coil assembly 170, a seal subassembly 180, the plunger spring 54 and the plunger 51 are assembled together to complete the assembling of the high pressure pump 10A. Here, the coil assembly 170 includes the coil 87 and the connector 891, and the seal subassembly 180 includes the oil seal holder 52 and the seal 523.

Next, the operation of the high pressure pump 10A will be described.

(I) Intake Stroke

When the plunger 51 is lowered from a top dead center toward a bottom dead center through rotation of the camshaft, the volume of the pressurizing chamber 14 is increased, and thereby the pressure of the fuel in the pressurizing chamber 14 is decreased. The discharge valve member 94 of the discharge valve 93 is seated against the discharge valve seat 947 to close the fuel discharge outlet 99. At this time, the energization of the coil 87 is stopped. Therefore, the movable core 84 and the needle 86 are moved toward the pressurizing chamber 14 by the urging force of the second spring 851. Therefore, the needle 86 urges the intake valve member 74, so that the intake valve member 74 is held in the valve open state thereof while the intake valve member 74 contacts the first spring holder 75. In this way, the fuel is drawn from the fuel gallery 32 into the pressurizing chamber 14 through the second intake passage 162, the intake passage 712, the intake chamber 711, the first intake passage 161 and the intake hole 141.

(II) Metering Stroke

When the plunger 51 is moved upward from the bottom dead center toward the top dead center through the rotation of the camshaft, the volume of the pressurizing chamber 14 is decreased. At this time, the energization of the coil 87 is stopped until predetermined timing (predetermined time point), so that the intake valve member 74 is held in the valve open state thereof. Therefore, the low pressure fuel, which is drawn into the pressurizing chamber 14 once, is returned to the intake chamber 711 through the intake hole 141 and the first intake passage 161.

When the energization of the coil 87 is started at the predetermined timing during the upward movement of the plunger 51, the magnetic attractive force is generated between the stationary core 83 and the movable core 84. When this magnetic attractive force becomes larger than the sum of the forces, in which the urging force of the first spring 76 is subtracted from the urging force of the second spring 851, the movable core 84 and the needle 86 are moved toward the stationary core 83. Thereby, the urging force of the needle 86 against the intake valve member 74 is released.

Then, the intake valve member 74 is moved by the urging force of the first spring 76 in a direction away from the first spring holder 75 toward the intake chamber 711. Therefore, the intake valve member 74 is seated against the valve seat 731, which is formed in the seat body 73, and thereby the intake valve member 74 is placed in the valve closed state.

(III) Pressurizing Stroke

Once the intake valve member 74 is held in the valve closed state, the pressure of the fuel in the pressurizing chamber 14 is increased in response to the upward movement of the plunger 51. The discharge valve 93 is opened when the pressure of the fuel in the pressurizing chamber 14 acting on the discharge valve member 94 becomes larger than the sum of the force of the pressure of fuel exerted on the discharge valve member 94 at the fuel discharge outlet 99 side and the urging force of the discharge valve spring 943. In this way, the high pressure fuel, which is pressurized in the pressurizing chamber 14, is discharged from the fuel discharge outlet 99.

In the middle of the pressurizing stroke, the energization of the coil 87 is stopped. The force, which is applied to the intake valve member 74 from the pressure of the fuel in the pressurizing chamber 14, is larger than the urging force of the second spring 851, so that the intake valve member 74 is kept in the valve closed state.

As discussed above, the high pressure pump 10A repeats the intake stroke, the metering stroke and the pressurizing stroke, so that the drawn fuel is pressurized in the pressurizing chamber 14 and is discharged from the fuel discharge outlet 99 toward the fuel rail. The fuel rail accumulates the discharged fuel. The fuel, which is accumulated in the fuel rail, is injected from each corresponding fuel injector upon energization thereof by the ECU. Here, the fuel rail, the fuel injectors and the ECU are not depicted for the sake of simplicity.

When the pressure of the fuel in the fuel rail is equal to or smaller than a predetermined value, the relief valve member 96 is seated against the relief valve seat 967 by the urging force of the relief valve spring 963. Therefore, the relief valve 95 is closed. However, the relief valve member 96 is moved toward the pressurizing chamber 14 side to open the relief valve 95 in the state where the pressure of the fuel in the fuel rail is increased due to some kind of abnormality, and thereby the force of the pressure of the fuel in the fuel rail acting on the relief valve member 96 becomes larger than the sum of the force of the pressure of fuel exerted on the relief valve member 96 at the pressurizing chamber 14 side and the urging force of the relief valve spring 963. In this way, the flow of the fuel from the fuel discharge outlet 99 toward the pressurizing chamber 14 is permitted.

Now, advantages of the high pressure pump 10A of the sixth embodiment will be described.

(A) In the prior art high pressure pump, the pressurizing chamber is formed by the portion of the inner wall of the housing. Therefore, the housing is required to have the rigidity, which can withstand the upward force exerted by the pressure of the fuel generated in the pressurizing chamber. In contrast, the pressurizing chamber 14 of the high pressure pump 10A of the sixth embodiment is formed by the inner peripheral wall 132*a* of the tubular portion 132 of the cylinder 13, the inner bottom wall 131*c* of the bottom portion 131 of the cylinder 13 and the upper end surface 515 of the large diameter portion 511 of the plunger 51. In this way, the housing is not required to withstand the upward force exerted by the pressure of the fuel generated in the pressurizing chamber. Thereby, the size of the housing can be reduced. Furthermore, when the size of the housing is reduced, the weight of the high pressure pump 10A can be reduced. Therefore, the manufacturing costs of the high pressure pump 10A can be reduced.

(B) In the high pressure pump 10A, the upper surface 121 of the projection 12 contacts the lower surface 111*b* of the cylinder holding portion 111 of the lower housing 11. In this way, when the fuel is pressurized in the pressurizing chamber 14, the force of the pressure of the fuel generated in the pressurizing chamber 14 is exerted against the cylinder 13 as the upward force, which is exerted against the bottom portion 131 of the cylinder 13. This force is conducted to the lower housing 11 through the projection 12. The projection 12 particularly limits the upward movement of the cylinder 13 relative to the lower housing 11, and thereby the position of the cylinder 13 relative to the lower housing 11 does not change. As a result, it is possible to limit the positional change of the cylinder 13 relative to the lower housing 11.

(C) The cylinder 13, which receives the plunger 51, is inserted into the cylinder receiving hole 118 of the lower housing 11. At this time, the inner peripheral wall (inner wall) 111*a* of the cylinder holding portion 111, which forms the cylinder receiving hole 118, contacts the outer peripheral wall 132*b* of the tubular portion 132 of the cylinder 13, which is radially opposite from the inner peripheral wall 132*a* of the tubular portion 132, along which the plunger 51 slides. Thereby, the force, which is applied from the plunger 51 against the cylinder 13 by the precession motion or the pendulum motion of the plunger 51 discussed above, can be effectively received by the cylinder 13 and the lower housing 11 to limit deformation of the cylinder.

(D) The high pressure pump 10A of the present embodiment includes the cover 31, which receives the upper housing 15 and is joined to the lower housing 11, in addition of the lower housing 11 and the upper housing 15, which cooperate together to serve as the housing. Among these components, the cylinder 13, to which the pressure of the fuel generated in the pressurizing chamber 14 is applied, and the lower housing 11, which is supported by the cylinder 13, need to be manufactured from the material having the high rigidity. However, the upward force of the pressure of the fuel generated in the pressurizing chamber 14 is not applied to the upper housing 15. Therefore, it is not required to manufacture the upper housing 15 from the material having the high rigidity. Particularly, the lower housing 11 has been made of the material having the high rigidity even in a previously proposed high pressure pump. Therefore, a substantial increase of the manufacturing costs does not occur. Thus, the size of the upper housing 15 can be reduced or minimized, and the processing of the complicated shape is not required unlike the previously proposed high pressure pump. Therefore, the manufacturing costs of the high pressure pump 10A can be reduced or minimized. The cover 31, which forms the outer contour of the high pressure pump 10A, can be formed from a thin metal plate, and thereby an inexpensive press working process may be used to form the cover 31. Furthermore, when the cover is used in combination with the upper housing 15, which can be made small, the space formed between the cover 31 and the upper housing 15 can be used as the fuel gallery 32. The fuel gallery 32, which has the larger volume in comparison to the fuel gallery of the previously proposed high pressure pump, can more effectively limit the pulsation of the pressure of the fuel at the low fuel pressure. Also, the fuel pressure drop at the fuel gallery 32 becomes small in comparison to the fuel gallery of the previously proposed high pressure pump. Thus, the intake efficiency (suction efficiency) of the high pressure pump can be improved.

(E) The projection 12, which is formed in the outer peripheral wall 132*b* of the cylinder 13, is configured into the annular form (ring form), which extends along the outer peripheral wall 132*b*. In the case where the force of the pressure of the fuel, which is generated in the pressurizing chamber 14, is conducted to the lower housing 11 through the projection 12, the force, which is conducted through the projection 12, can be uniformly spread to the lower housing 11 because of the annular form of the projection 12. Thereby, the deformation of the cylinder 13 and the lower housing 11 can be limited.

Seventh Embodiment

Figure 25:
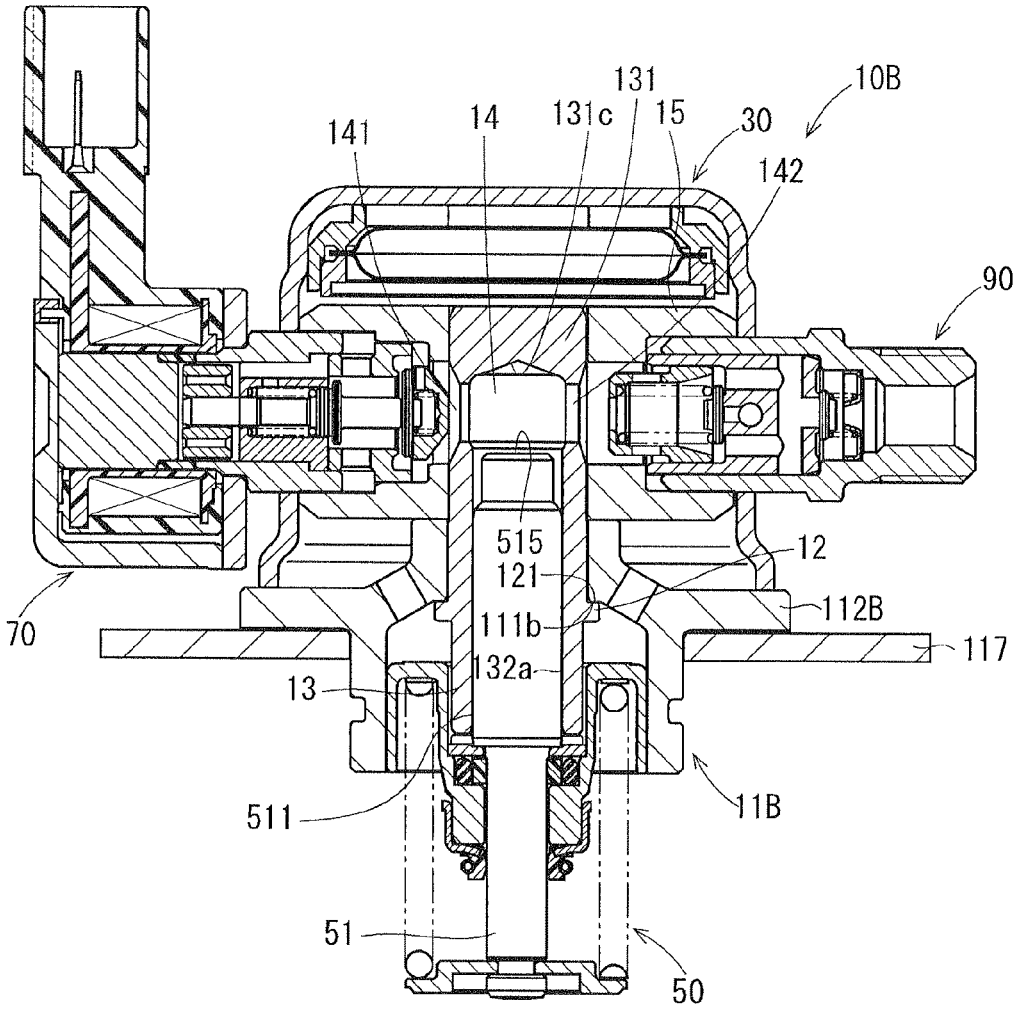
FIG. 25 is a schematic cross-sectional view of a high pressure pump according to a seventh embodiment of the present invention.

Next, a seventh embodiment of the present invention will be described with reference to FIG. 25. In the seventh embodiment, the shape of the lower housing is modified from that of the sixth embodiment. In the following description, components, which are similar to those of the sixth embodiment, will be indicated by the same reference numerals and will not be described further.

In the high pressure pump 10B of the seventh embodiment, a flange 117 is installed to the engine mount portion 112B of the lower housing 11B. The high pressure pump 10B is installed to, for example, the engine through the flange 117. In comparison to the high pressure pump 10A of the sixth embodiment, in the high pressure pump 10B of the seventh embodiment, a size of the engine mount portion 112B is made smaller, and a wall thickness of the engine mount portion 112B is made thinner. In this way, the amount of the material, which is required to manufacture the lower housing 11B, is reduced to enable a reduction in the manufacturing costs. The lower housing 11B may correspond to a part of the housing (also referred to as the pump housing) of the present invention.

Furthermore, the relative positioning (alignment) of the fuel intake arrangement 70 and the fuel discharge relief arrangement 90 relative to the mount holes 112*a* of the engine mount portion 112B of the lower housing 11B can be performed by adjusting the relative position of the flange 117 at the final process. Therefore, the number of intermediate assembling processes and the factory facility costs can be reduced, and thereby the assembling costs can be reduced.

Eighth Embodiment

Figure 26:
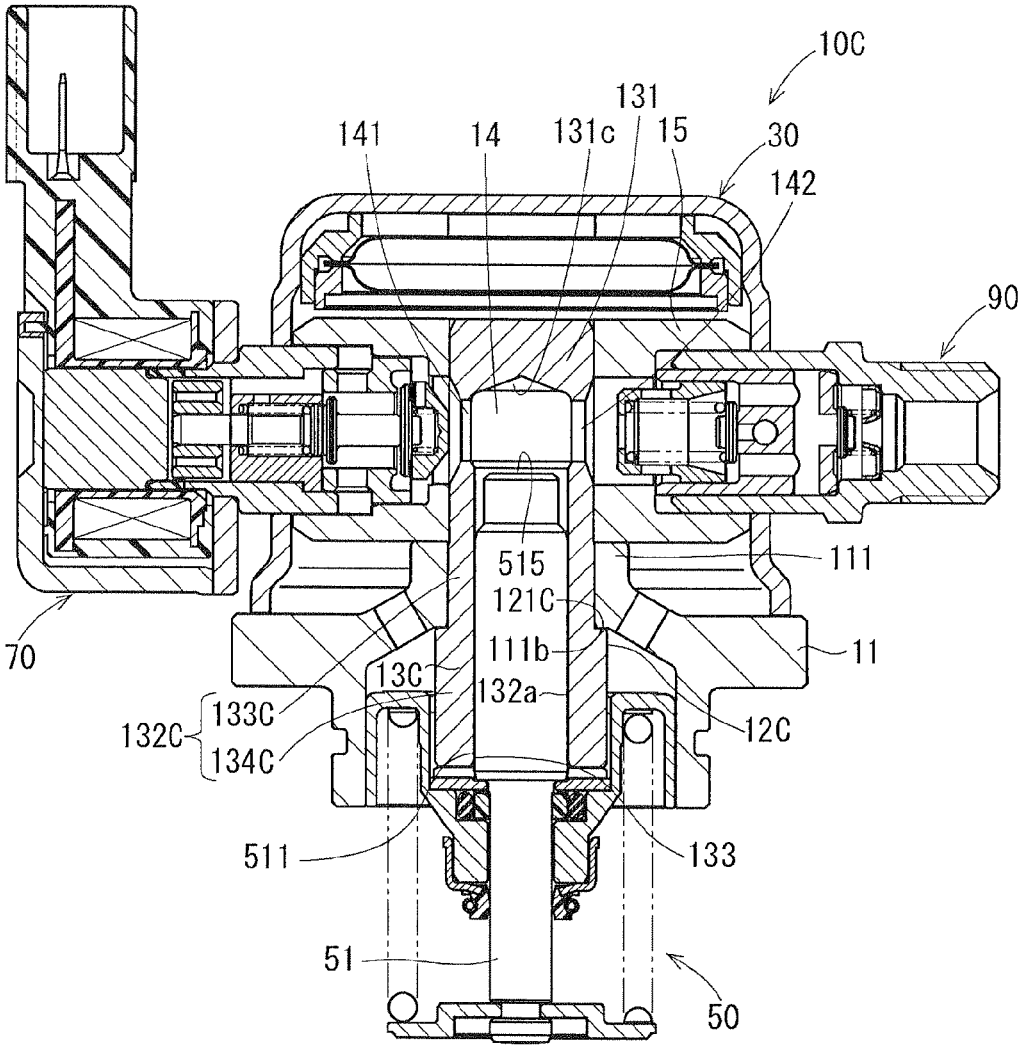
FIG. 26 is a schematic cross-sectional view of a high pressure pump according to an eighth embodiment of the present invention.

Next, an eighth embodiment of the present invention will be described with reference to FIG. 26. In the eighth embodiment, the shape of the projection of the cylinder is modified from the projection 12 of the sixth embodiment. In the following description, components, which are similar to those of the sixth embodiment, will be indicated by the same reference numerals and will not be described further.

In the eighth embodiment, the projection 12C, which is formed in the cylinder 13C, is formed in a large diameter portion 134C of the tubular portion 132C of the cylinder 13C. More specifically, as shown in FIG. 26, the tubular portion 132C of the cylinder 13C includes a small diameter portion 133C and the large diameter portion 134C. The large diameter portion 134C serves as the projection 12C. The projection 12C is formed to extend generally from an axial center part of the cylinder 13C to the opening end (the opening 133) of the cylinder 13C, through which the plunger 51 is inserted into the cylinder 13C. At this time, the upper surface 121C of the projection 12C contacts the lower surface 111*b* of the cylinder holding portion 111.

In the eighth embodiment, the large diameter portion 134C (i.e., the projection 12C) is formed to extend to the opening end of the cylinder 13C. In this way, for example, at the time of processing the outer wall of the cylinder 13C, the outer wall of the cylinder 13C can be formed by cutting or grinding an outer peripheral part of one end side portion of the cylindrical tubular material. Therefore, the processing of the cylinder 13C is eased. Therefore, the manufacturing costs of the high pressure pump 10C can be reduced.

Furthermore, the provision of the large diameter portion 134C can improve the rigidity of the cylinder 13C. Therefore, the seizing resistance of the plunger 51 can be improved at the time of occurrence of the precession motion or the pendulum motion of the plunger 51.

Ninth Embodiment

Figure 27:
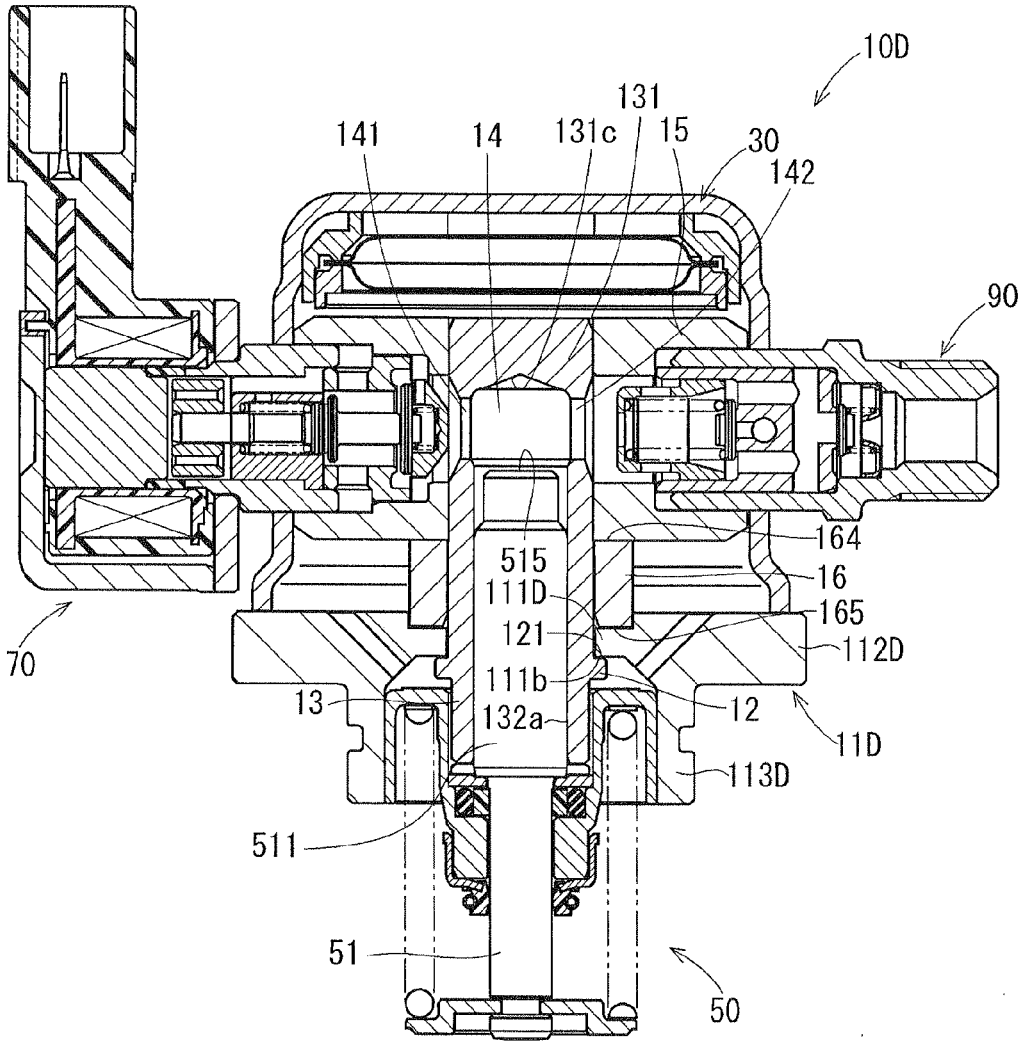
FIG. 27 is a schematic cross-sectional view of a high pressure pump according to a ninth embodiment of the present invention.
Figure 28:
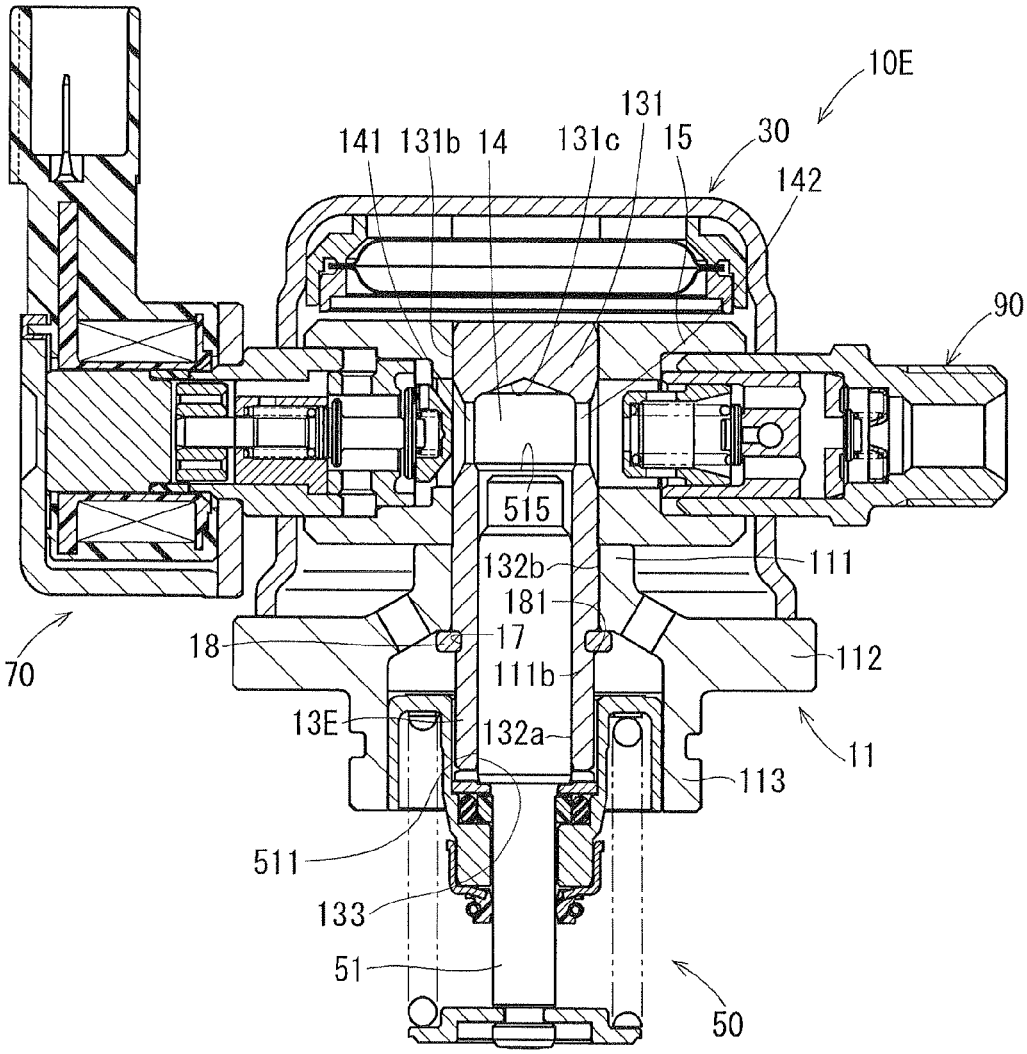
FIG. 28 is a schematic cross-sectional view of a high pressure pump according to a tenth embodiment of the present invention.

Next, a ninth embodiment of the present invention will be described with reference to FIG. 27. In the ninth embodiment, the shape of the lower housing is modified from that of the sixth embodiment. In the following description, components, which are similar to those of the sixth embodiment, will be indicated by the same reference numerals and will not be described further.

In the ninth embodiment, an intermediate support member 16 is provided between the upper housing 15 and the lower housing 11. More specifically, as shown in FIG. 27, the intermediate support member 16 is configured into a cylindrical tubular form and extends along the outer peripheral wall (outer wall) of the cylinder 13 toward the pressurizing chamber 14. A lower surface 165 of the intermediate support member 16 contacts the upper surface (surface of the outer wall) of the engine mount portion 112D of the lower housing 11D, from which the fitting portion 113D projects on the other side. An upper surface 164 of the intermediate support member 16 contacts a lower surface (surface of the outer wall) of the upper housing 15. In this way, radially outward movement of the cylinder 13 is limited mainly by the intermediate support member 16. The upper housing 15 may correspond to a first housing of the housing (also referred to as the pump housing) of the present invention. The lower housing 11D may correspond to a second housing of the housing (the pump housing) of the present invention. Furthermore, the intermediate support member 16 also forms a part of the housing (the pump housing) of the present invention.

In the ninth embodiment, at the time of manufacturing the lower housing 11D, it is not required to form a portion, which corresponds to the cylinder holding portion 111 of the lower housing 11 of the sixth embodiment. Therefore, the manufacturing costs of the high pressure pump 10D can be reduced or minimized.

Furthermore, the location, at which the intermediate support member 16 contacts the outer peripheral wall 132*b* of the cylinder 13, is within the slidable range of the plunger 51 along the cylinder 13. That is, an axial extent of the intermediate support member 16 is within an axial extent of the slidable range of the plunger 51 along the cylinder 13. The radially outward force of the plunger 51, which is generated by the precession motion or the pendulum motion of the plunger 51, is applied to the cylinder 13. At this time, since the intermediate support member 16, which has an appropriate strength, is provided on the radially outer side of the cylinder 13, it is possible to limit the deformation of the cylinder 13 caused by the precession motion or the pendulum motion of the plunger 51.

Tenth Embodiment

Next, a tenth embodiment of the present invention will be described with reference to FIGS. 28 to 32. In the tenth embodiment, the shape of the projection of the cylinder is modified from the projection 12 of the sixth embodiment. In the following description, components, which are similar to those of the sixth embodiment, will be indicated by the same reference numerals and will not be described further.

Figure 29A:
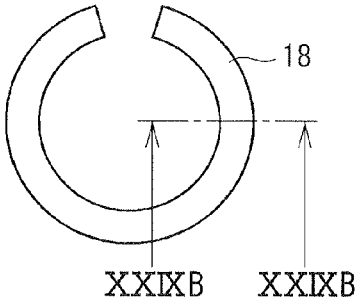
FIG. 29A is a plan view showing a fixing member used in the high pressure pump of the tenth embodiment.
Figure 29B:
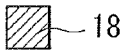
FIG. 29B is a cross-sectional view take along line XXIXB-XXIXB in FIG. 29A.

In the tenth embodiment, a recess (annular recess) 17 is radially inwardly recessed in the outer peripheral wall 132*b* of the cylinder 13E, and a fixing member (limiting means) 18 is fitted into the recess 17. An upper surface 181 of the fixing member 18, which is located on the pressurizing chamber 14 side, contacts the lower surface 111*b* of the cylinder holding portion 111 of the lower housing 11. The fixing member 18 is configured into a C-shaped form as shown in FIG. 29A and has a generally rectangular cross section as shown in FIG. 29B. Thereby, the upward force of the pressure of the fuel, which is generated in the pressurizing chamber 14 and is exerted against the bottom portion 131 of the cylinder 13E, is applied to the lower housing 11 as an upward lifting force for upwardly lifting the lower housing 11.

Next, a manufacturing method of the high pressure pump 10E of the tenth embodiment will be described with reference to FIGS. 30 to 32B. The manufacturing method of the high pressure pump 10E of the tenth embodiment differs from the manufacturing method of the high pressure pump 10A of the sixth embodiment with respect the first cylinder subassembly forming process.

Figure 30:
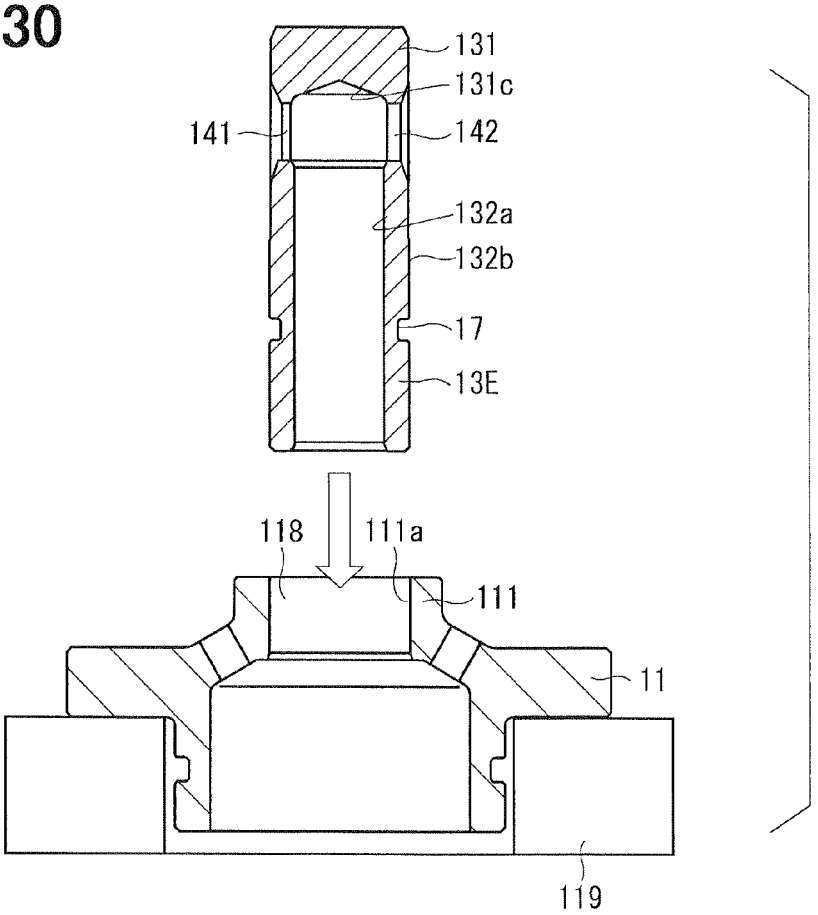
FIG. 30 is a schematic cross-sectional view indicating a cylinder and a lower housing installed to a jig for describing a manufacturing operation of the high pressure pump according to the tenth embodiment.

First of all, the cylinder 13E is installed to the lower housing 11. In this instance, the grinding and polishing of the outer peripheral wall 132*b* of the cylinder 13E may be performed in advance by a through-feed process. In the case of manufacturing the high pressure pump 10E of the tenth embodiment, as shown in FIG. 30, the cylinder 13E is inserted into the lower housing 11, which is fixed to the jig 119, from the upper side of the lower housing 11. At this time, an outer diameter of a portion of the cylinder 13E, to which the upper housing 15 is press fitted at a location adjacent to the pressurizing chamber 14, is generally the same as an outer diameter of another portion of the cylinder 13E, which is adjacent to the opening of the cylinder 13E for inserting the plunger 51. In contrast, in the high pressure pump 10A of the sixth embodiment, the outer diameter of the upper portion of the cylinder 13 is different from the outer diameter of the lower portion of the cylinder 13. Specifically, the outer diameter of the upper portion of the cylinder 13 is smaller than the outer diameter of the lower portion of the cylinder 13. This is due to the formation of the projection 12 in the outer peripheral wall (outer wall) 132*b* of the cylinder 13 in the high pressure pump 10A of the sixth embodiment. Therefore, the cylinder 13 needs to be inserted into the lower housing 11 and the upper housing 15 from the lower side thereof. This is made to limit occurrence of damage caused by contacting of the outer peripheral wall (outer wall) 131*b* of the bottom portion 131 of the cylinder 13 to the inner peripheral wall 111*a* of the lower housing 11 at the time of inserting the cylinder 13 into the lower housing 11 from the lower side of the lower housing 11. When the outer peripheral wall 131*b* of the bottom portion 131 is damaged (e.g., by scraping or scratching), the fuel cannot be effectively sealed even when the upper housing 15 and the cylinder 13 are joined together. However, according to the manufacturing method of the high pressure pump 10E of the tenth embodiment, the cylinder 13E is inserted into the lower housing 11 from the upper side of the lower housing 11. Therefore, the outer peripheral wall 131*b* of the bottom portion 131 of the cylinder 13E does not contact the inner peripheral wall (inner wall) 111*a* of the lower housing 11. At this time, the relative positioning (aligning) between the cylinder 13E and the lower housing 11 is performed in a manner similar to that of the sixth embodiment.

Figure 31A:
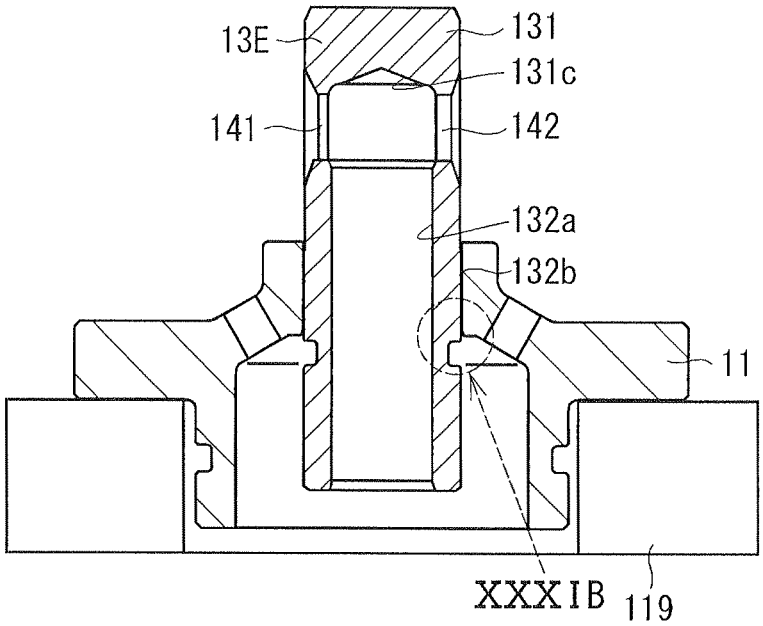
FIG. 31A is a schematic diagram, showing a further state in the manufacturing operation of the high pressure pump of the tenth embodiment, which is after the state of FIG. 30.
Figure 31B:
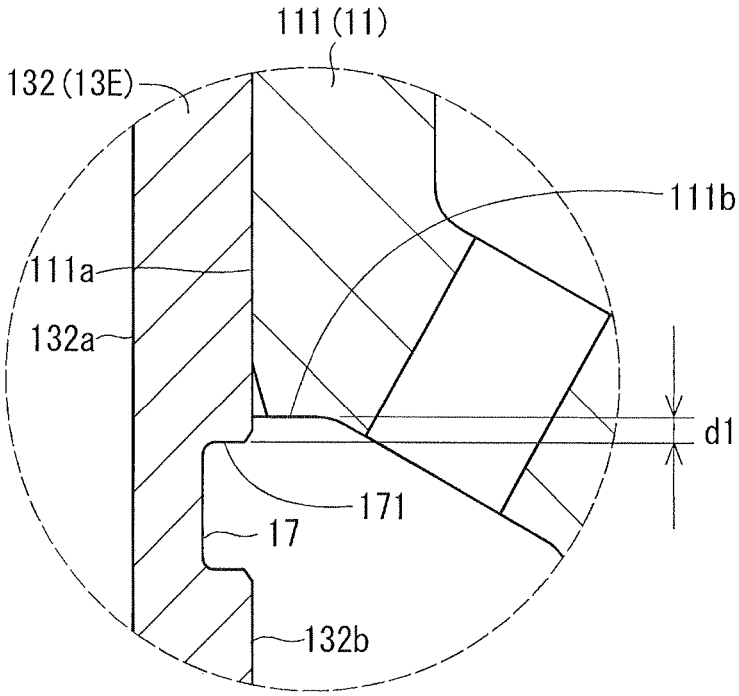
FIG. 31B is a partial enlarged view of an area XXXIB in FIG. 31A.

As indicated in the enlarged view of FIG. 31B, in the case where the cylinder 13E is inserted into the lower housing 11, a distance d1 is provided between a surface 171 of the recess 17, which is located on the pressurizing chamber 14 side, and the lower surface 111*b* of the cylinder holding portion 111 of the lower housing 11 to enable fitting of the fixing member 18 into the recess 17. The distance d1 is desirably equal to or larger than 0 (zero).

Figure 32A:
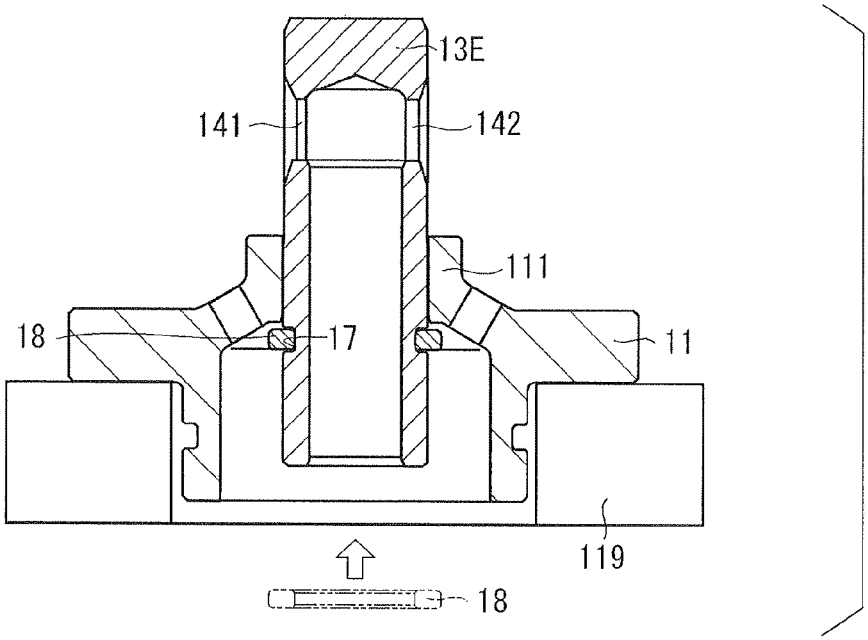
FIGS. 32A and 32B are schematic diagrams, showing further states in the manufacturing operation of the high pressure pump of the tenth embodiment, which are after the state of FIGS. 31A and 31B.
Figure 32B:
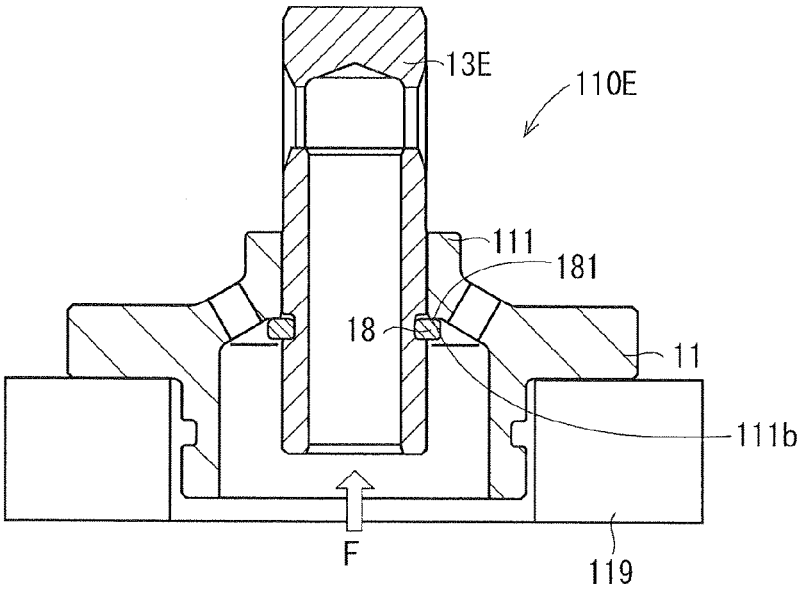

As shown in FIG. 32A, the fixing member 18 is inserted over the cylinder 13E from the lower side of the cylinder 13E and is fitted into the recess 17. Furthermore, as indicated in FIG. 32B, a force F is applied to the cylinder 13E toward the pressurizing chamber 14 after the fitting of the fixing member 18 into the recess 17. In this way, the upper surface 181 of the fixing member 18 and the lower surface 111*b* of the cylinder holding portion 111 contact with each other. Thereby, the cylinder subassembly 110E is formed. The remaining manufacturing processes of the manufacturing method of the high pressure pump 10E after this process are the same as those of the high pressure pump 10A of the sixth embodiment (i.e., the intake valve forming process and the following processes of the high pressure pump 10A of the sixth embodiment).

In addition to the advantages (A) to (E) of the high pressure pump 10A of the sixth embodiment, the following advantages are achieved in the high pressure pump 10E of the tenth embodiment.

(F) In the high pressure pump 10E of the tenth embodiment, the upper surface 181 of the fixing member 18 and the lower surface 111*b* of the cylinder holding portion 111 contact with each other. At this time, the recess 17, to which the fixing member 18 is fitted, is formed in the outer peripheral wall (outer wall) of the cylinder 13E. In the case where the outer peripheral wall of the cylinder 13E is processed, the material, which has a smaller outer diameter that is smaller than that of the cylinder 13 of the sixth embodiment, may be cut or ground to form the cylinder 13E since it is not required to provide an extra diameter to form the projection 12 of the sixth embodiment. Furthermore, the cylinder 13E may be ground and polished by the through-feed process from the bottom portion 131 to the opening 133 of the cylinder 13E after the forming of the recess 17. In this way, the processing costs of the cylinder 13E can be reduced. That is, the manufacturing costs of the high pressure pump 10E can be reduced.

(G) The fixing member 18 has the generally rectangular cross section. Thereby, the fixing member 18 can be formed by stamping a metal plate with, for example, a stamping die. Therefore, the manufacturing costs of the high pressure pump 10E can be reduced.

(H) In the manufacturing method of the high pressure pump 10E, at the time of installing the cylinder 13E to the lower housing 11, the cylinder 13E is inserted into the lower housing 11 from the upper side of the lower housing 11. In contrast, in the case where the cylinder 13E is installed to the upper housing 15, the cylinder 13E is inserted into the upper housing 15 from the lower side of the upper housing 15. Specifically, in comparison to the sixth embodiment, in which the lower housing 11 and the upper housing 15 are installed to the cylinder 13E from the upper side of the cylinder 13E, it is possible to insert the lower housing 11 to the cylinder 13E from the lower side thereof and to insert the upper housing 15 from the upper side thereof in the case of the high pressure pump 10E. Thereby, in the case of the high pressure pump 10E, it is possible to avid the damage of the outer peripheral wall 132*b* of the cylinder 13E at the time of installing the lower housing 11 to the cylinder 13E. Therefore, the outer peripheral wall of the cylinder 13E can have the constant outer diameter throughout its entire length. As a result, the outer peripheral wall of the cylinder 13E can be processed by the through-feed process. In this way, the processing costs can be reduced. That is, the manufacturing costs of the high pressure pump 10E can be reduced.

Eleventh Embodiment

Next, an eleventh embodiment of the present invention will be described with reference to FIGS. 33 to 34B. In the eleventh embodiment, the shape of fixing member is modified from the fixing member 18 of the tenth embodiment. In the following description, components, which are similar to those of the tenth embodiment, will be indicated by the same reference numerals and will not be described further.

Figure 33:
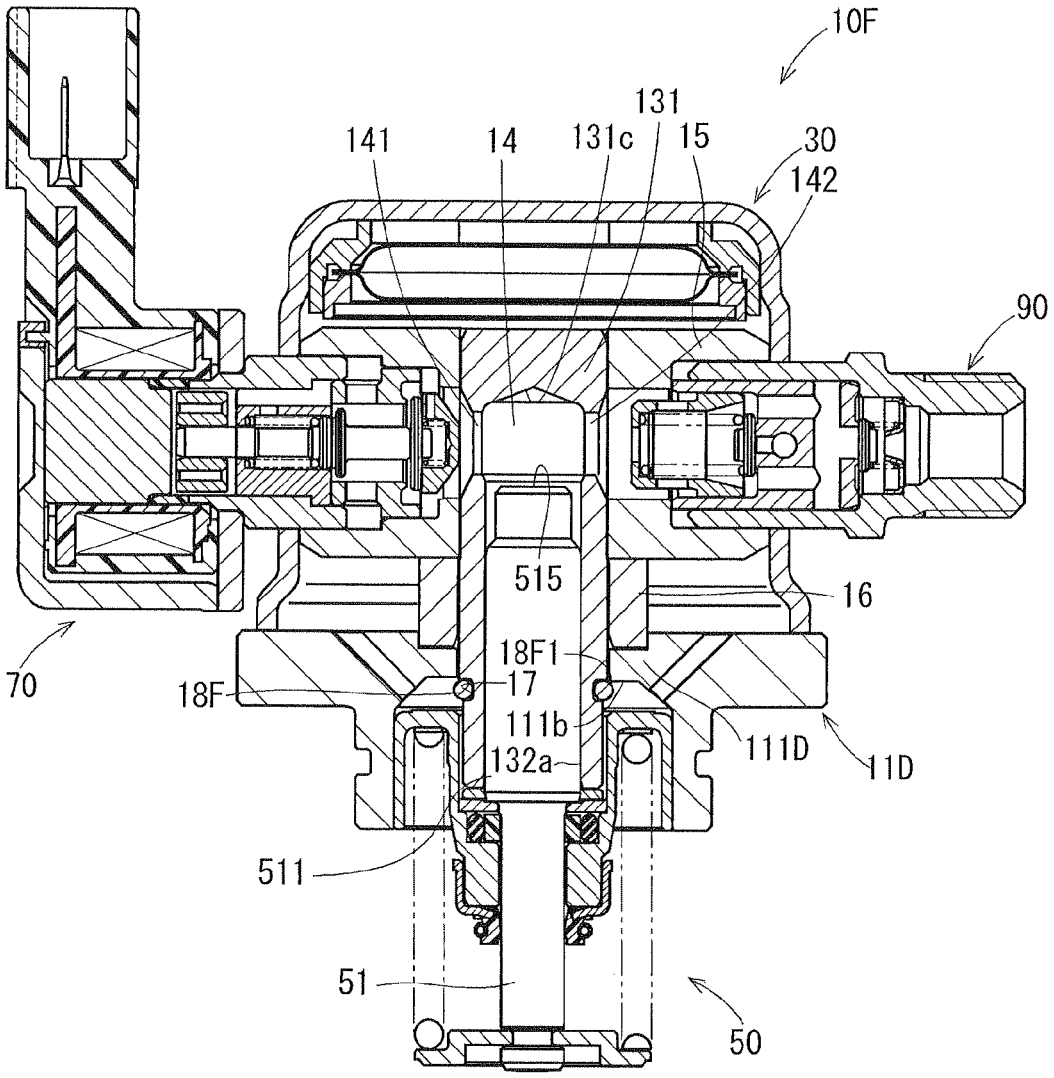
FIG. 33 is a schematic cross-sectional view of a high pressure pump according to an eleventh embodiment of the present invention.
Figure 34A:
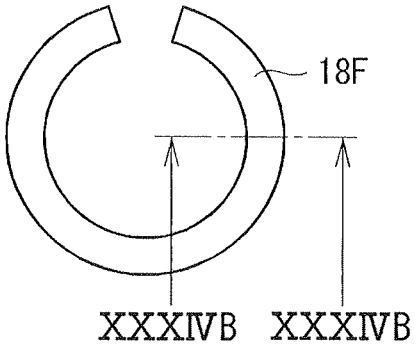
FIG. 34A is a plan view showing a fixing member used in the high pressure pump of the eleventh embodiment.
Figure 34B:
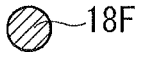
FIG. 34B is a cross-sectional view take along line XXXIVB-XXXIVB in FIG. 34A.

In the case of the high pressure pump 10F of the eleventh embodiment, as shown in FIG. 33, the fixing member (limiting means) 18F is fitted into the recess 17. An upper surface 18F1 of the fixing member 18F contacts the lower surface 111*b* of the cylinder holding portion 111D of the lower housing 11D. In this embodiment, the fixing member 18F is configured into a C-shaped form as shown in FIG. 34A and has a generally circular cross section as shown in FIG. 34B.

Twelfth Embodiment

Next, a twelfth embodiment of the present invention will be described with reference to FIG. 35. The twelfth embodiment differs from the sixth embodiment with respect to the wall surface, which forms the pressurizing chamber. In the following description, components, which are similar to those of the sixth embodiment, will be indicated by the same reference numerals and will not be described further.

Figure 35:
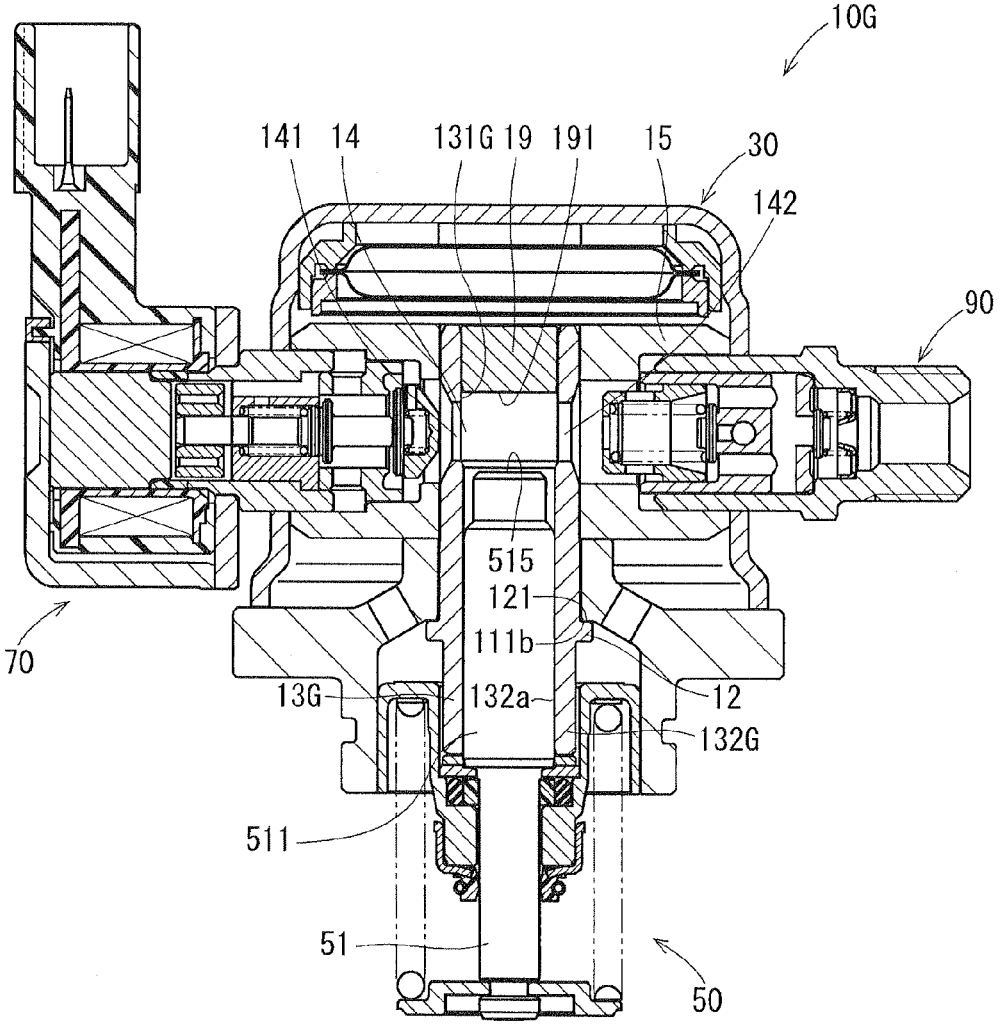
FIG. 35 is a schematic cross-sectional view of a high pressure pump according to a twelfth embodiment of the present invention.

In the twelfth embodiment, the cylinder 13G is configured into a tubular form, as shown in FIG. 35. A cover member 19 is fitted into an opening 131G of the cylinder 13G, which is adjacent to the pressurizing chamber 14. In this way, the pressurizing chamber 14 is formed by the inner peripheral wall 132*a* of the tubular portion 132G of the cylinder 13G, a lower surface 191 of the cover member 19 and the upper end surface 515 of the large diameter portion 511 of the plunger 51. The cover member 19 may correspond to a part of the cylinder of the present invention. The cover member 19 and a portion of the tubular portion 132G of the cylinder 13G located radially outward of the cover member 19 may form a bottom portion of the cylinder 13G.

In the high pressure pump 10G of the twelfth embodiment, the upward force exerted by the pressure of the fuel generated in the pressurizing chamber 14 is applied to the cover member 19. The cover member 19 is fitted to the opening 131G of the cylinder 13G. Therefore, the force of the pressure generated in the pressurizing chamber 14 is applied only to the cylinder 13G. In contrast, the force of the pressure of the fuel is not applied to the upper housing 15 and the cover 31. Therefore, the advantages (A) to (E) of the sixth embodiment are also achieved in this embodiment.

Thirteenth Embodiment

Figure 36:
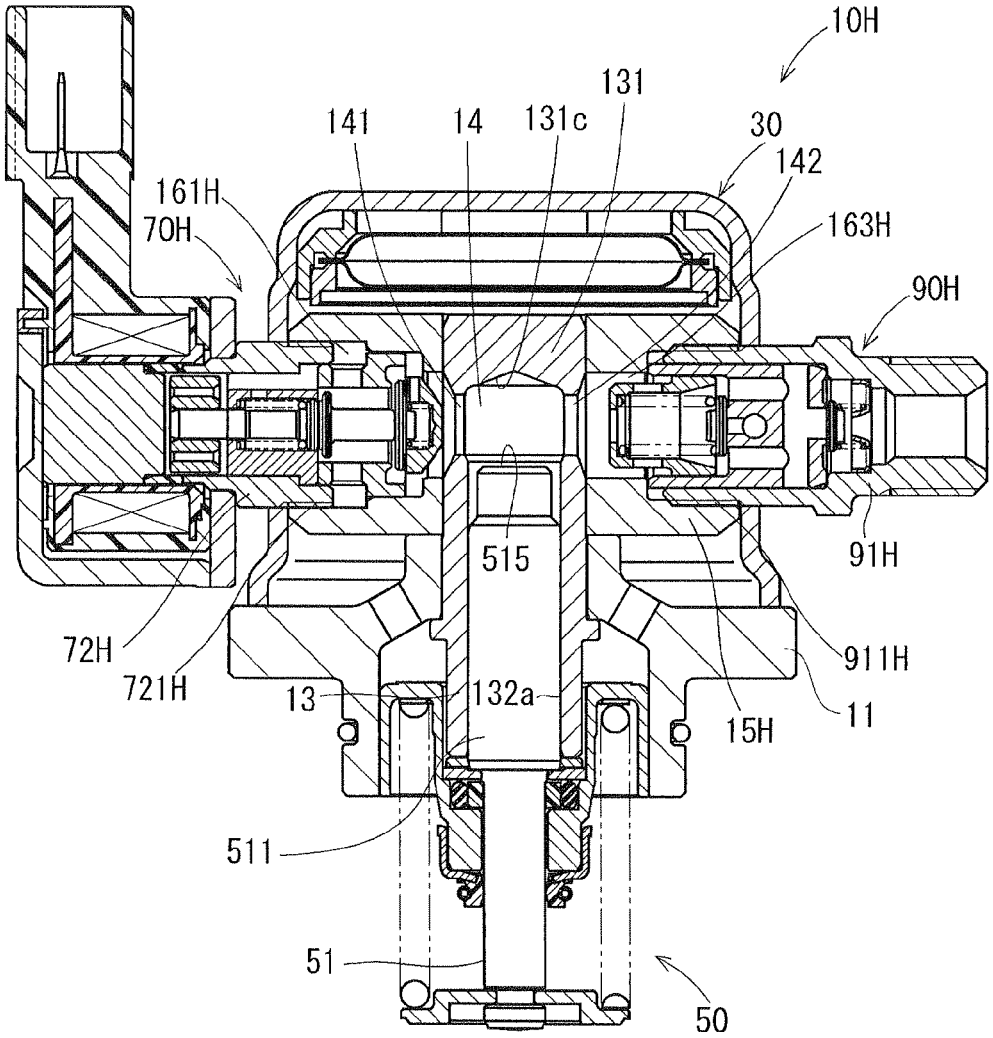
FIG. 36 is a schematic cross-sectional view of a high pressure pump according to a thirteenth embodiment of the present invention.

Next, a thirteenth embodiment of the present invention will be described with reference to FIG. 36. The thirteenth embodiment differs from the sixth embodiment with respect to the way of installing the fuel intake arrangement and the fuel discharge relief arrangement. In the following description, components, which are similar to those of the sixth embodiment, will be indicated by the same reference numerals and will not be described further.

In the thirteenth embodiment, the fuel intake arrangement 70H and the fuel discharge relief arrangement 90H are threadably fixed to the upper housing 15H. More specifically, as shown in FIG. 36, the fuel intake arrangement 70H and the upper housing 15H are threadably fixed such that an intake valve threaded portion 721G of the intake valve body 72H is threadably fixed to a threaded portion, which is threaded in an inner peripheral wall (inner wall) of the first intake passage 161H of the upper housing 15H. Furthermore, fuel discharge relief arrangement 90H and the upper housing 15H are threadably fixed such that a fuel discharge relief threaded portion 911H of the fuel discharge relief housing 91H is threadably fixed to a threaded portion, which is threaded in an inner peripheral wall (inner wall) of the first discharge passage 163H of the upper housing 15H.

Figure 37A:
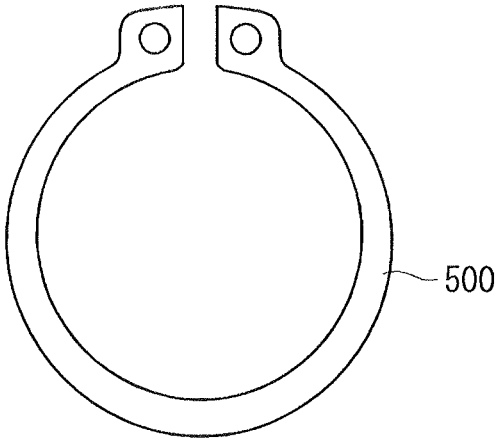
FIG. 37A is a schematic diagram showing a snap ring in a modification of the high pressure pump of the tenth or eleventh embodiment.
Figure 37B:
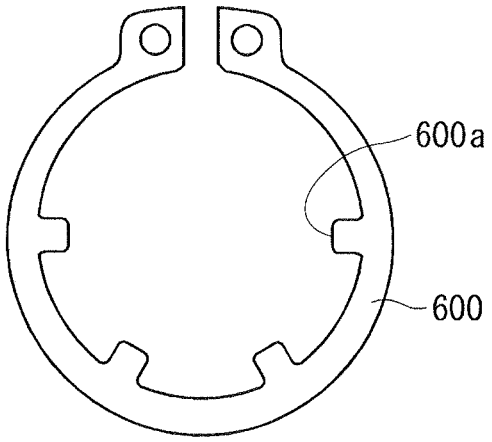
FIG. 37B is a schematic diagram showing a snap ring in another modification of the high pressure pump of the tenth or eleventh embodiment.

In the tenth and eleventh embodiments, the fixing member is configured into the simple C-shaped form. However, the shape of the fixing member is not limited to this. For instance, the fixing member may be formed as a snap ring 500 of FIG. 37A having a sort of C-shaped form with smooth inner peripheral surface. Alternatively, the fixing member may be formed as a snap ring 600 of FIG. 37B having a sort of C-shaped form with a plurality of radially inward projections 600*a*.

In the sixth to thirteenth embodiments, the number of the fuel passages formed in the lower housing is two. However, the number of the fuel passages is not limited to two. That is, the number of the fuel passages formed in the lower housing may be one or more than two.

The present invention is not limited to the above embodiments, and the above embodiments may be modified within the spirit and scope of the present invention. Furthermore, it should be noted that any one or more components of any one of the above embodiments and modifications thereof may be combined with any one or more components of any other one of the above embodiments and modifications thereof within the spirit and scope of the present invention.

What is claimed is:

1. A high pressure pump comprising:

a plunger that is adapted to reciprocate;

a cylinder that is configured into a bottomed tubular form and includes:

an inner peripheral wall that slidably guides the plunger;

an inner bottom wall that is continuous from the inner peripheral wall, wherein the inner bottom wall is configured into a generally conical form, which has an increasing diameter toward the plunger;

an outer peripheral wall; and an intake hole and a discharge hole, which communicate between the inner peripheral wall and the outer peripheral wall; and a pump housing that includes:

a cylinder receiving hole that includes an inner peripheral wall, into which the cylinder is inserted, wherein the inner peripheral wall of the cylinder receiving hole contacts the outer peripheral wall of the cylinder;

an intake passage that is communicated with the intake hole; and a discharge passage that is communicated with the discharge hole, wherein a pressurizing chamber is formed by the inner peripheral wall and the inner bottom wall of the cylinder and a distal end outer wall of the plunger upon installation of the cylinder and the plunger into the cylinder receiving hole, wherein the pump housing further includes:

a first housing that is engaged with a bottom portion of the outer peripheral wall of the cylinder, which is located on a radially outer side of the inner bottom wall of the cylinder; and a second housing that is engaged with a tubular portion of the outer peripheral wall of the cylinder, which is located on a radially outer side of the inner peripheral wall of the cylinder;

the cylinder has a limiting portion that limits movement of the cylinder toward the bottom portion of the cylinder relative to the housing when a pressure of the pressurizing chamber is increased; and the second housing is placed between and contact with the first housing and the limiting portion of the cylinder.

2. The high pressure pump according to claim 1, further comprising:

an intake valve that is installed in the intake passage of the pump housing and meters fuel to be drawn in to the pressurizing chamber; and a discharge valve that limits backflow of fuel, which is discharged from the pressurizing chamber into the discharge passage in the pump housing.

3. The high pressure pump according to claim 1, wherein a portion of the outer peripheral wall of the cylinder, which is axially located between the inner bottom wall and an outer bottom wall of the cylinder, is fitted to the inner peripheral wall of the cylinder receiving hole.

4. A high pressure pump comprising:

a plunger that is adapted to reciprocate;

a cylinder that is formed into a bottomed tubular form and includes a bottom portion and a tubular portion, wherein:

the bottom portion closes one end of the tubular portion;

the plunger is slidably supported by an inner wall of the tubular portion;

a pressurizing chamber is formed by an upper end of the plunger, the inner wall of the tubular portion and an inner bottom wall of the bottom portion; and an intake hole and a discharge hole are formed through at least one of the bottom portion and the tubular portion to radially communicate between an inside and an outside of the pressurizing chamber; and a housing that is engaged with an outer wall of the bottom portion and an outer wall of the tubular portion, wherein:

the housing includes:

a first housing that is engaged with the outer wall of the bottom portion of the cylinder; and a second housing that is engaged with the outer wall of the tubular portion of the cylinder;

the cylinder has a limiting portion that limits movement of the cylinder toward the bottom portion of the cylinder relative to the housing when a pressure of the pressurizing chamber is increased; and the second housing is placed between and contacts with the first housing and the limiting portion of the cylinder.

5. The high pressure pump according to claim 4, wherein the limiting portions a projection, which is formed in the outer wall of the tubular portion and projects radially outward from the outer wall of the tubular portion.

6. The high pressure pump according to claim 5, wherein the projection is formed in the outer wall of the tubular portion at a location within a slidable range of the plunger along the inner wall of the tubular portion of the cylinder.

7. The high pressure pump according to claim 5, wherein the projection extends to an opening end of the tubular portion of the cylinder, which is opposite from the bottom portion.

8. The high pressure pump according to claim 5, wherein the projection is configured into an annular form and extends all around the outer wall of the tubular portion of the cylinder in a circumferential direction of the tubular portion.

9. The high pressure pump according to claim 4, wherein the limiting portion is a fixing member, which is fitted into a recess that is formed in the outer wall of the tubular portion of the cylinder.

10. The high pressure pump according to claim 9, wherein the fixing member is configured into a generally C-shaped form and extends along the outer wall of the tubular portion of the cylinder.

11. The high pressure pump according to claim 4, wherein the housing includes:

an intermediate support member that supports the cylinder on a radially outer side of the cylinder and has:

one end portion, which contacts an outer wall of the first housing located on a side opposite from the bottom portion of the cylinder; and the other end portion, which contacts an outer wall of the second housing located on a side where the bottom portion of the cylinder is placed.

* * * * *